US006289195B1

(12) United States Patent
Ichikawa et al.

(10) Patent No.: US 6,289,195 B1
(45) Date of Patent: Sep. 11, 2001

(54) DEVELOPER REPLENISHING DEVICE AND DEVELOPER CONTAINER FOR USE THEREWITH

(75) Inventors: Hideo Ichikawa, Numazu; Takeshi Saito, Tokyo; Sunao Ikeda, Numazu; Nobuhiro Makita, Numazu; Seiji Ozawa, Numazu; Shigeru Yoshiki, Kawasaki; Takaaki Yanagisawa, Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/549,510

(22) Filed: Apr. 14, 2000

Related U.S. Application Data

(62) Division of application No. 09/306,048, filed on May 6, 1999, now Pat. No. 6,075,963, which is a continuation of application No. 09/161,317, filed on Sep. 28, 1998, now Pat. No. 5,918,090, which is a continuation of application No. 08/751,617, filed on Nov. 18, 1996, now Pat. No. 5,822,663, which is a continuation of application No. 08/587,966, filed on Jan. 17, 1996, now Pat. No. 5,627,631, which is a continuation of application No. 08/386,875, filed on Feb. 10, 1995, now Pat. No. 5,500,719, which is a continuation of application No. 08/174,698, filed on Dec. 28, 1993, now Pat. No. 5,455,662.

(30) Foreign Application Priority Data

Dec. 30, 1992 (JP) ..... 4-361012

(51) Int. Cl.[7] ..... G03G 15/08

(52) U.S. Cl. ..... 399/262

(58) Field of Search ..... 399/119, 120, 399/262, 263

(56) References Cited

U.S. PATENT DOCUMENTS

| | | |
|---|---|---|
| D. 193,637 | 9/1962 | Ferraro . |
| 3,185,353 | 5/1965 | Mercier . |
| 3,853,246 | 12/1974 | Dubois . |
| 3,915,340 | 10/1975 | Koeleman . |
| 3,979,026 | 9/1976 | Lee . |
| 4,060,105 | 11/1977 | Feldeisen et al. . |
| 4,212,264 | 7/1980 | Knechtel et al. . |
| 4,436,203 | 3/1984 | Reyner . |
| 5,057,872 | 10/1991 | Saijo et al. . |

(List continued on next page.)

FOREIGN PATENT DOCUMENTS

| | | |
|---|---|---|
| 0 441 227 A2 | 8/1991 | (EP) . |
| 63075769 | 4/1988 | (JP) . |

OTHER PUBLICATIONS

European Search Report.

*Primary Examiner*—William J. Royer
(74) *Attorney, Agent, or Firm*—Oblon, Spivak, McClelland, Maier & Neustadt, P.C.

(57) ABSTRACT

A developer replenishing device for replenishing a developing device with a developer, and a developer container for use therewith. The developer container, or toner bottle, has a mouth portion at one end thereof which is smaller in diameter than a hollow cylindrical main body. At the end of the bottle provided with the mouth portion, a shoulder has the inner periphery thereof partly raised to the edge of the mouth portion to form a raised portion for scooping up a toner. In addition, a part of the inner periphery of the circumferental wall of the bottle, which is contiguous with the raised portion, is also raised toward the axis of the bottle, about which the bottle is rotatable, thereby forming another raised portion. When the bottle is mounted on a bottle holder, which is included in the replienishing device, substantially horizontally with the mouth portion oriented sideways, the bottle is rotated to raise the toner from the bottom of the main body to the mouth portion. As a result, the toner is discharged to the outside via the mouth portion smoothly.

31 Claims, 42 Drawing Sheets

U.S. PATENT DOCUMENTS

| | | |
|---|---|---|
| 5,217,737 | 6/1993 | Gygax et al. . |
| 5,409,750 | 4/1995 | Hamada et al. . |
| 5,441,177 | 8/1995 | Yanagisawa . |
| 5,455,662 | 10/1995 | Ichikawa et al. . |
| 5,489,976 | 2/1996 | Ichikawa . |
| 5,495,323 | 2/1996 | Meetze, Jr. . |
| 5,500,719 | 3/1996 | Ichikawa et al. . |
| 5,627,631 | 5/1997 | Ichikawa et al. . |
| 5,648,840 | 7/1997 | Ikunami et al. . |
| 5,655,195 | 8/1997 | Ichikawa et al. . |
| 5,822,663 | 10/1998 | Ichikawa et al. . |
| 5,918,090 | 6/1999 | Ichikawa et al. . |

DEVELOPER REPLENISHING DEVICE AND DEVELOPER CONTAINER FOR USE THEREWITH

This application is a Division of application Ser. No. 09/306,048 Filed on May 6, 1999 now U.S. Pat No. 6,075,963; which is a continuation of application Ser. No. 09/161,317, filed Sep. 28, 1998 (U.S Pat. No. 5,918,090); which is a continuation of application Ser. No. 08/751,617, filed Nov. 18, 1996 (U.S. Pat No. 5,822,663, which is a continuation of application Ser. No. 08/587,966, filed Jan. 17, 1996 (U.S. Pat No. 5,627,631), which is a continuation of application Ser. No. 08/386,875, filed Feb. 10, 1995 (U.S. Pat No. 5,500,719) which is a continuation of application Ser. No. 08/174,698, filed Dec. 28, 1993 (U.S. Pat No. 5,455,662).

BACKGROUND OF THE INVENTION

1. Field of the Invention

The present invention relates to a developing device included in a copier, facsimile apparatus, printer or similar image forming apparatus and, more particularly, to a developer replenishing device for replenishing the developing device with a developer, and a developer container for use therewith.

2. Discussion of Background

Copiers, facsimile apparatus, printers or similar electrophotographic image forming apparatus, which electrostatically form a latent image on a photoconductive element, develop the latent image with charged color particles, i.e., a developer, and then transfers the developed image to a paper, are well known. It is a common practice with this type of apparatus to supplement a fresh developer when a developer stored in a vessel is consumed. A device for replenishing the developer may be implemented with a hollow cylindrical container storing the developer, as taught in, for example, Japanese Patent Laid-Open Publication (Kokai) Nos. 59-188678 and 60-146265. The container is substantially entirely open at a first end thereof to form a developer outlet and is rotated about the longitudinal axis thereof to sequentially discharge the developer, or powder, to the vessel of the image forming apparatus via the outlet. To replace the container with a new container filled with a fresh developer, a holder, which is positioned horizontally on the body of the image forming apparatus, is rotated downwardly to a vertical position around the first end thereof. In this condition, the empty container is removed from the holder, and then a new container is mounted on the holder. Subsequently, the holder is again rotated to the horizontal position where the new container can replenish the apparatus with the developer. Before the new container is put on the holder, which is maintained in the vertical position, the container is positioned such that the opening, or developer outlet, thereof faces upwardly, and then a cap, which closes the opening, is removed. The container, without the cap, is mounted on the holder with the opening facing upwardly, so that the powder filling the container will not fall out.

However, a prerequisite with the conventional scheme described above is that the length of the holder should not be greater than the height of the apparatus, because the holder has to rotated between the horizontal position and the vertical position around the first end thereof. Generally, the apparatus is provided with as small a height as possible to meet the demand for a miniature configuration, requiring the holder and, therefore, the container, to be as short as possible. As a result, the quantity of developer available within a single container is reduced, resulting in the frequent replacement of the container. In any case, the conventional replenishing device cannot be reduced in size and suffers from design limitations in relation to the internal arrangement of an image forming apparatus.

In light of the above, a series of studies and experiments were conducted in order to implement an arrangement for allowing a person to replace the cylindrical container, while maintaining the holder in the horizontal position. However, since the container is substantially fully open at the first end thereof, the developer stored therein falls through the outlet of the container, when the container is mounted on the holder. Therefore, in Japanese Patent Laid-Open Publication No. 3-2881, a developer replenishing device is proposed which uses a container closed at both ends thereof and which is formed with a developer outlet in the circumferential wall thereof adjacent to one of the closed ends. This kind of container is placed on a holder with the outlet facing upwardly. However, considering the fact that an image forming apparatus is most often used by ordinary clerks, it is likely that the container may be inadvertently mounted on the holder with the outlet facing downwardly. In this case, the developer may fall out of the container and smear the apparatus and the floor. In addition, a dead space is produced between the outlet and the adjoining end of the container, requiring the container to be provided with an additional length matching the dead space.

SUMMARY OF THE INVENTION

It is, therefore, an object of the present invention to provide a new and improved developer replenishing device free from the drawbacks discussed above.

It is another object of the present invention to provide a developer replenishing device which prevents a developer from falling out of a container despite the container being set in a horizontal position.

It is another object of the present invention to provide a new and improved developer container for use with such a developer replenishing device.

It is another object of the present invention to provide a developer container capable of replenishing a developing device installed in an image forming apparatus with all the developer stored therein.

In accordance with the present invention, a developer container for use with a developer replenishing device is provided. The developer container includes a holder for holding the developer container to allow a developer to be discharged from a mouth portion of the developer container into the developer replenishing device. The developer container also includes a drive unit for causing the developer container, held by the holder, to rotate about the axis thereof A hollow cylindrical main body of the developer container has a mouth portion on a first end. The mouth portion is smaller in diameter than a shoulder portion which forms a circumferential wall adjacent to the first end. A guide portion is provided on a part of the shoulder portion for guiding the developer, stored in the developer container, to the mouth portion.

Also in accordance with the present invention, a toner bottle for use with a toner replenishing device is provided. The toner bottle is held in a bottle holder by a mouth portion of the toner bottle being fitted into the bottle holder in order to discharge toner, contained in the toner bottle, into the toner replenishing device. A drive unit rotatably drives the toner bottle, when the toner bottle is mounted on the toner replenishing device. A main body includes a substantially hollow container having, adjacent to a first end of the toner bottle, a first diameter portion. A discharge mouth, at the first end, includes a mouth portion. The discharge mouth has a second diameter substantially smaller than the first diameter. A circumferential and radially extending ramp surface configuration of the peripheral surface of the main body at the first end radially connects the first diameter portion and a radial position no greater than the second diameter portion.

Further, in accordance with the present invention, a toner bottle for use with a toner replenishing device is provided. A mouth portion of the toner bottle may fit into a bottle holder for discharge of the toner, in the toner bottle, into the toner replenishing device. A drive unit rotatably drives the toner bottle about a longitudinal axis thereof, when the toner bottle is mounted on the toner replenishing device. A main body includes a substantially hollow container, and a rotational force transfer projection or recess on the radially extending surface of the main body. The rotational force transfer projection cooperates with the bottle holder for transferring the rotation of the bottle holder to the toner bottle.

Moreover, in accordance with the present invention, a toner bottle for use with a toner replenishing device includes a mouth portion for discharge of toner from the toner bottle into the toner replenishing device, and a drive unit, which rotatably drives the toner bottle, when the toner bottle is mounted on the toner replenishing device. A main body includes a substantially hollow container which has a first diameter portion adjacent to a first end of the bottle, a discharge mouth at the first end, wherein the discharge mouth includes the mouth portion and has a second diameter substantially smaller than the first diameter, and a circumferential and radially extending ramp surface configuration at the first end radially connecting the first diameter portion and a radial position no greater than the second diameter portion. In this way, a controllable quantity of toner in the toner bottle is raised radially form the first diameter portion to the second diameter portion for feeding the controllable quantity of toner to the discharge mouth, when the toner bottle is rotated by the drive unit.

In addition, in accordance with the present invention, a device for replenishing a developing device of an image forming apparatus with a developer is provided. A developer container contains a developer and has a mouth portion. A holder communicates with a developer replenishing section and holds the developer container, while orienting the mouth portion toward the developer replenishing section. The holder is rotatable around a first end in a substantially horizontal plane.

BRIEF DESCRIPTION OF THE DRAWINGS

The above and other objects, features, and advantages of the present invention will become more apparent from the following detailed description read in accordance with the accompanying drawings in which.

DESCRIPTION OF THE PREFERRED EMBODIMENTS

A preferred embodiment of the present invention will be described which is applied to an electrophotographic copier belonging to a family of image forming apparatuses.

Figure 1A:
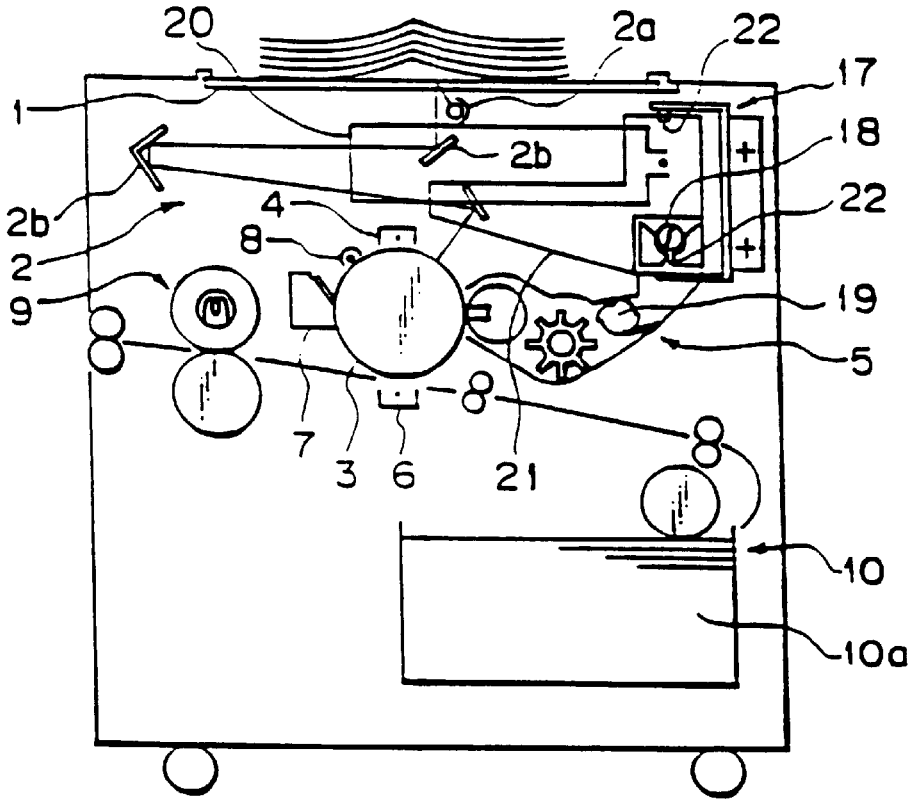
FIGS. 1A and 1B are a cross-sectional view and a front view, respectively, showing a copier to which the present invention is applicable.

Referring to FIG. 1A, the copier has a glass platen 1 on the top thereof on which a document to be copied may be laid. An optical unit 2 is disposed below the glass platen 1 and includes a lamp 2*a* for illuminating the document, a mirror 2*b*, and a lens (not shown). A photoconductive element, in the form of a drum 3, is rotatably located below the optical unit 2. A main charger 4, a developing unit 5, a transfer charger 6, a cleaning unit 7, a discharger 8 and other conventional units for implementing an electrophotographic process, are arranged around a drum 3. A fixing unit 9, is positioned at the left-hand side of the drum 3, as viewed in the figure, for fixing a toner image transferred from the drum 3 to a paper by the transfer charger 6. A paper feed section 10 is provided in the lower portion of the copier and loaded with a stack of papers 10*a*. The papers 10*a* are sequentially fed from the paper feed section 10 to the drum 3. The operation of this kind of copier is well known in the art and will not be described more specifically.

Figure 2:
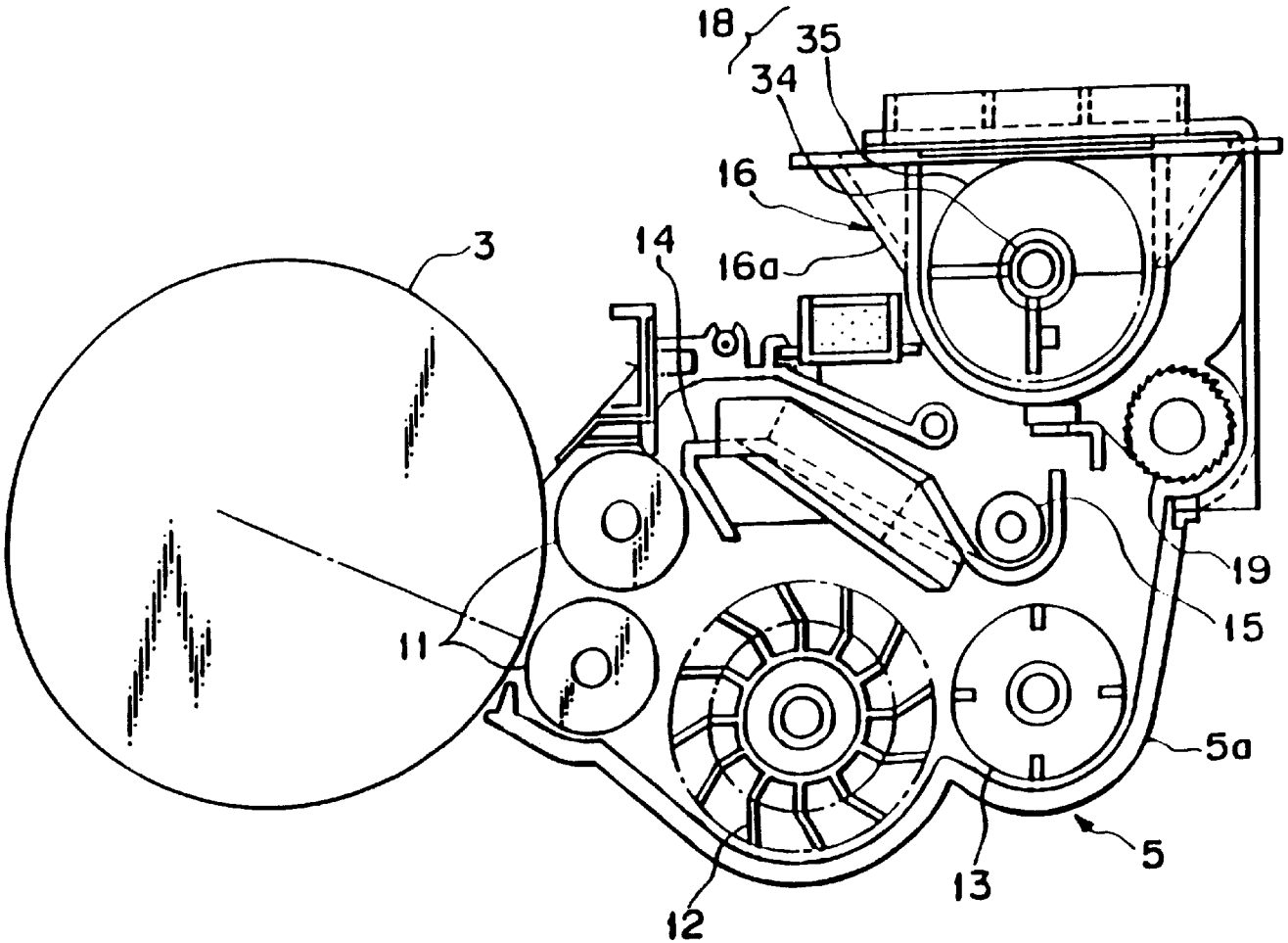
FIG. 2 is a cross-sectional view showing the general construction of a developing device incorporated in the copier.

As shown in FIG. 2, the developing unit 5 is a conventional dry process unit using a two component type developer, i.e., a toner and carrier mixture. The developing unit 5 has a casing 5*a* accommodating developing rollers 11, a paddle wheel 12 for agitation, a mixing roller 13, a separator 14, and a horizontally extending screw 15 for agitation, etc. A hopper 16 is contiguous with the casing 5 and is disposed above such constituents of the developing unit 5. A toner is supplied from the hopper 16 into the developing unit 5. A screw conveyor 18 is accommodated in the hopper 16 and is made up of a shaft 34 and a spiral member 35, affixed to the shaft 34. The screw conveyor 18 conveys a toner from a toner supply unit 17 while agitating the toner, as will be described in more detail below. A toner supply roller 19 is disposed in a portion where the hopper 16 communicates with the developing unit 5. The toner supply roller 19 is rotated in response to an output signal of a toner concentration sensor (not shown).

Figure 1B:
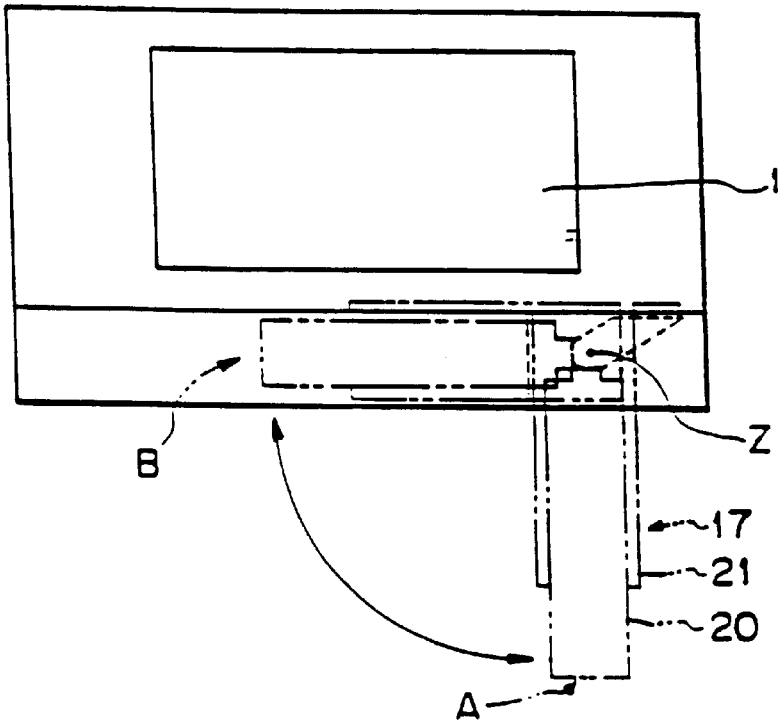

As shown in FIG. 1A, the toner supply unit 17 is located in the upper front portion of the copier and includes a bottle holder 21. The bottle holder 21 plays the role of a holding means for holding a toner bottle or developer container 20. As shown in FIGS. 1A and 1B, the bottle holder 21 is mounted on a shaft 22, which is located at the right end of the toner supply unit 17. The bottle holder 21 is rotatable approximately 90 degrees around the axis Z of the shaft 22 in a substantially horizontal plane. Specifically, the bottle holder 21 is movable between two positions A and B, as illustrated. In position A, the left portion of the bottle holder 21 is pulled out and pivoted toward the front end of the copier to allow the bottle 20 to be mounted thereto. In position B, the entire toner supply unit 17 remains parallel to the front end of the copier. The bottle holder 21 is formed with an opening in the bottom wall thereof for letting a toner fall therethrough. At least in position B, the bottom opening of the bottle holder 21 is positioned above a toner receiving portion 16, shown in FIG. 2, which is included in the hopper 16 and which extends to the front end of the copier. Preferably, the toner supply unit 17 is located inwardly of a front cover (not shown), which covers the front end of the copier. When the front cover (not shown) is opened, the toner supply unit 17 can be pulled out and pivoted to position A.

Figure 3A:
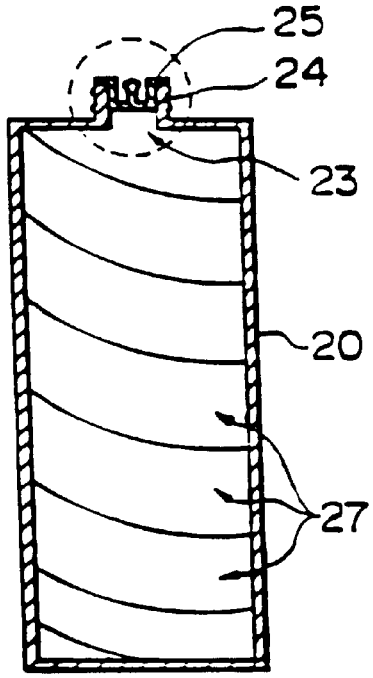
FIGS. 3A and 3B are a cross-sectional view and a fragmentary enlarged cross-sectional view, respectively, showing a toner bottle 20 for use with the copier.
Figure 3B:
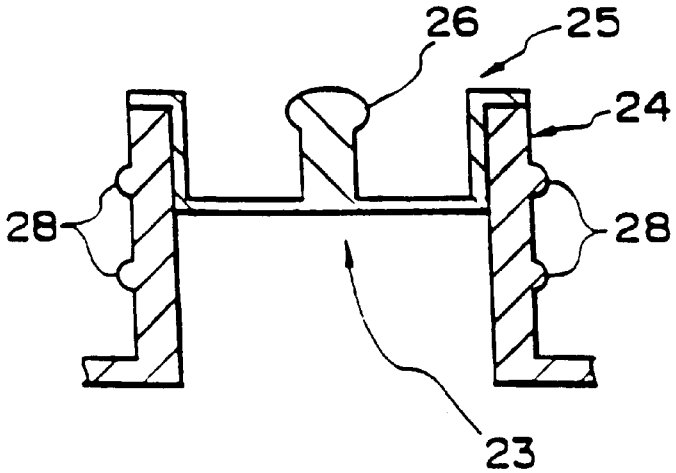
Figure 12A:
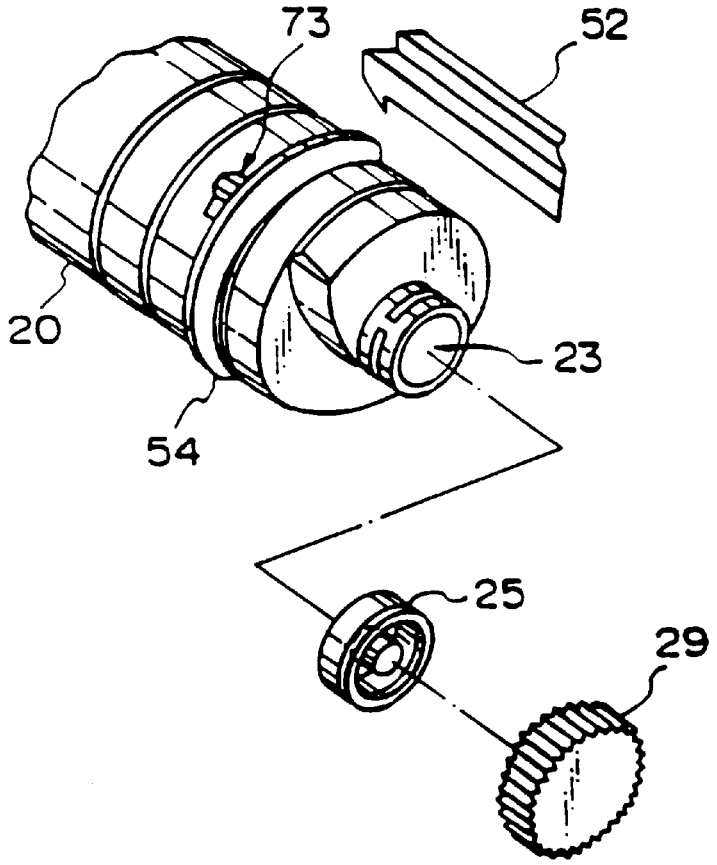
FIG. 12A is an exploded perspective view showing another part of the toner supply unit 17.

FIG. 3A shows a specific configuration of the toner bottle 20, while FIG. 3B shows a mouth portion 23 forming the outlet of the bottle 20. As shown , the bottle 20 is substantially cylindrical and is provided with the mouth portion 23 at substantially the center of a first end thereof. The mouth portion 23 has a smaller diameter than the diameter of the cylinder constituting the bottle 20 and the mouth portion 23 has a circular cross-section. In the specific configuration, the mouth portion 23 is formed at the end of a collar 24 extending outwardly from the bottle 20. The mouth portion 23 is plugged by a lid 25. A mushroom-like lug 26 protrudes from the center of the lid 25. A spiral guide groove 27 is formed in the inner periphery of the bottle 20, similar to the bottle taught in previously mentioned Japanese Patent Laid-Open Publication No. 59-188678. When the bottle 20 is rotated around the longitudinal axis thereof, the spiral guide groove 27 guides the toner contained in the bottle 20 toward the mouth portion 23. Annular ribs 28 are formed on the outer periphery of the collar 24. A cap 29, as shown in FIG. 12A, closes the entire collar 24, while mating with the annular ribs 28 during transport of the bottle 20. In this sense, the annular ribs 28 constitute an engaging portion. For this purpose, the cap 29 is provided with lugs or grooves on the inner periphery thereof which are complementary to the annular ribs 28.

Figure 4A:
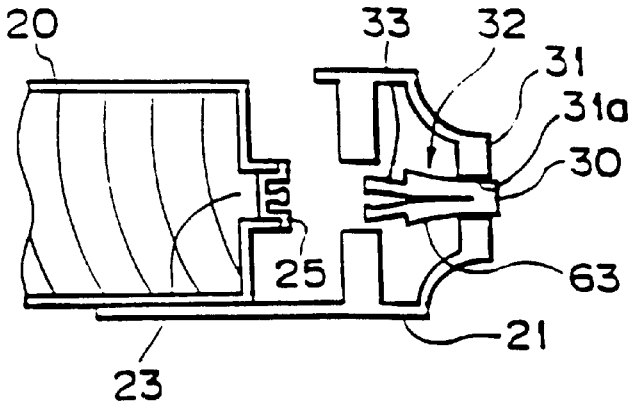
FIGS. 4A–4C are cross-sectional views showing a sequence of steps for removing a lid 25 from the toner bottle 20.
Figure 4B:
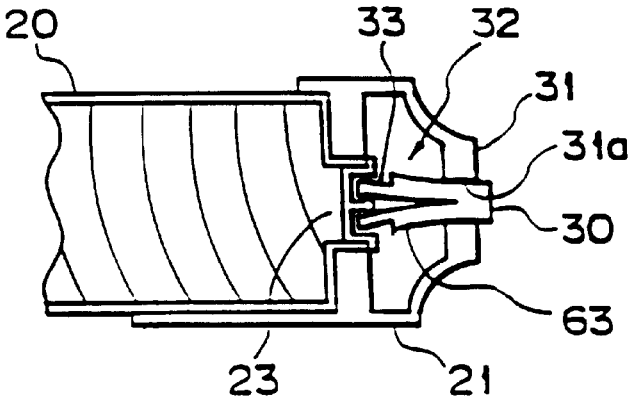
Figure 4C:
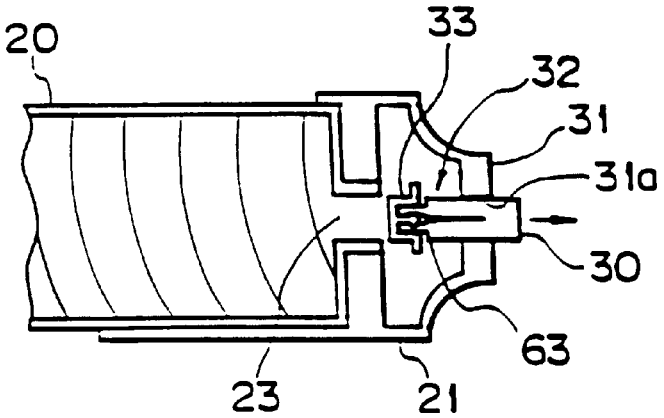

FIGS. 4A–4C show a mechanism 32 for removing the lid 25 from the mouth portion 23 of the bottle 20. As shown, the mechanism 32 is made up of a collet chuck or retaining means 30 and moving means (not shown), for moving the collet chuck 30 toward and away from the bottle 20. The collet chuck 30 has a chucking portion 33 at the tip thereof and is supported by a hole 31*a*, formed in a wall 31, which forms a part of the bottle holder 21. When the collet chuck 30 is in a free state, the chucking portion 33 is held open, as shown in FIG. 4A. FIG. 4B shows a condition where the bottle 20 has been put in a predetermined position on the bottle holder 21. When the collet chuck 30 is moved away from the bottle 20 by the moving means, the peripheral larger diameter portion of the collet chuck 30 is pressed by the wall 31, with the result that the chucking portion 33 is squeezed to retain the lug 26 of the lid 25. Subsequently, as shown in FIG. 4C, the collet chuck 30 moves the lid 25 to a position where the mouth portion 23 of the bottle 20 is filly uncovered, thereby chucking the lug 26 of the lid 25.

The mechanism 32, described above, is provided on the toner supply unit 17 and allows the bottle 20 to be mounted on the bottle holder 21 with the mouth portion 23 of the bottle 20 being sealed by the lid 25. Hence, despite that the bottle 20 is set on the bottle holder 21 in a substantially horizontal position, as shown in FIGS. 1A and 1B, the toner is prevented from falling out of the mouth portion 23.

When the toner in the bottle 20 is entirely consumed, the empty bottle 20 is taken out of the bottle holder 21. At this instant, the moving means may move the collet chuck 30 toward the bottle 20 to fit the lid 25 in the mouth portion 23. Then, when the bottle 20 is removed from the bottle holder 21, the mouth portion 23 will have been closed by the lid 25. This prevents the toner deposited on the mouth portion 23 from falling and smearing the hands and clothes of the person replacing the bottle 20.

Figure 5A:
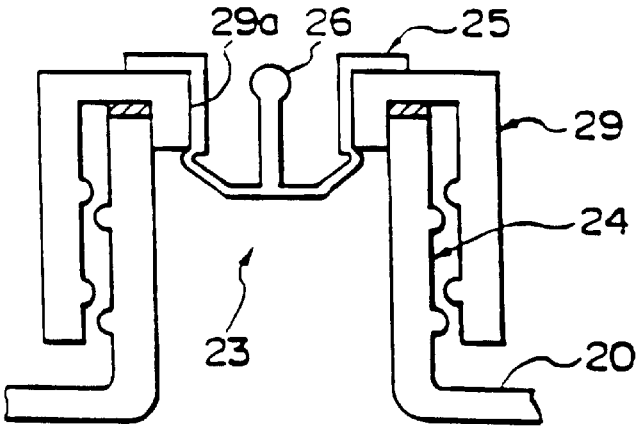
FIG 5A is a cross-sectional view showing a specific configuration of the lid 25.

FIG. 5A shows a modified form of the mouth portion 23 of the bottle 20. As shown, the cap 29, e.g., screw cap to be fitted on the collar 24 of the mouth portion 23, is formed with a hole 29*a* in the end wall thereof. The lid 25 having the lug 26 is removably received in the hole 29*a* of the cap 29.

Figure 5B:
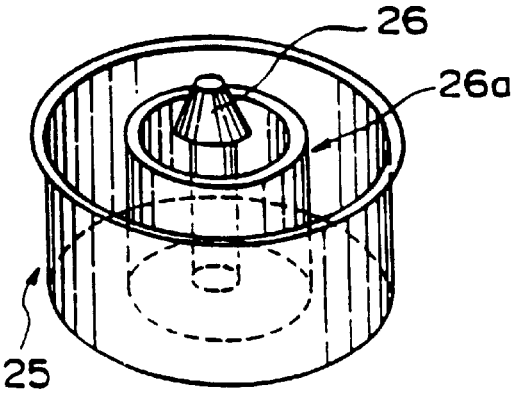
FIGS. 5B and 5C are perspective views each showing another specific configuration of the lid 25.
Figure 5C:
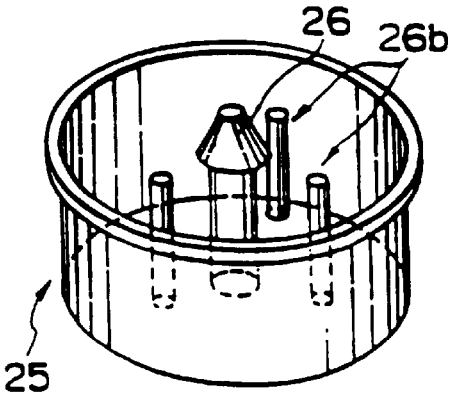

FIGS. 5B and 5C each shows a modification of the lid 25 shown in FIG. 3B or 5A. It is likely that an inexperienced person intends to remove the lid 25 of a new toner bottle 20 by nipping the lug 26 of the lid 25, without using the collet chuck 30. This is apt to cause a fresh toner to fall from the bottle 20. To eliminate this, the lids 25, shown in FIGS. 5B and 5C, are each provided with an annular obstruction 26*a* or pin-like obstructions 26*b* around the lug 26. The obstructions 26*a* and 26*b* prevent the easy access of the person's fingers to the lug 26.

Figure 5D:
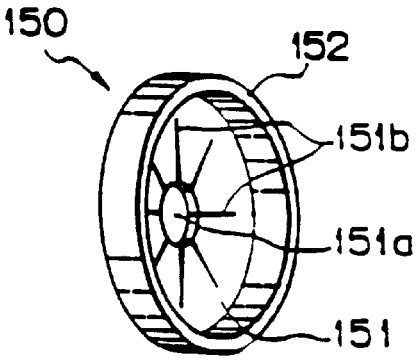
FIG. 5D is a perspective view showing a thin flat piece to be attached to the lid 25 of the toner bottle 20.
Figure 5E:
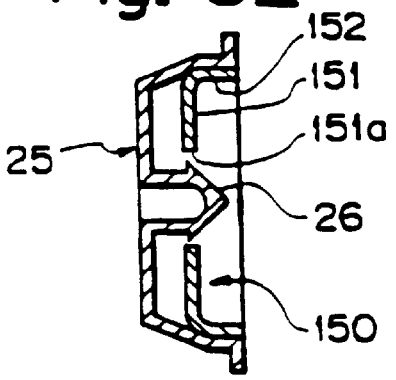
FIG. 5E is a cross-sectional view showing the lid 25 with the thin flat piece attached thereto.

FIG. 5D shows a cover 150 which is a specific substitute for the obstruction 26*a* or obstructions 26*b*. As shown, the cover 150 is made up of a thin flat piece 151 for concealing the portion of the lid 25 surrounding the lug 26, and an annular wall 152 extending outwardly from the outer edge of the thin flat piece 151. A hole 151 a is formed in the center of the piece 151 and is slightly greater in diameter than the diameter of the lug 26 of the lid 25. A number of slits 151*b* extend radially from the edge of the hole 151*a*. As shown in FIG. 5E, when the cover 150 is fitted on the lid 25, only the tip of the lug 26 is visible. This prevents even an inexperienced person from mistaking the tip of the lug 26 as a member for removing the lid 25.

Figure 6:
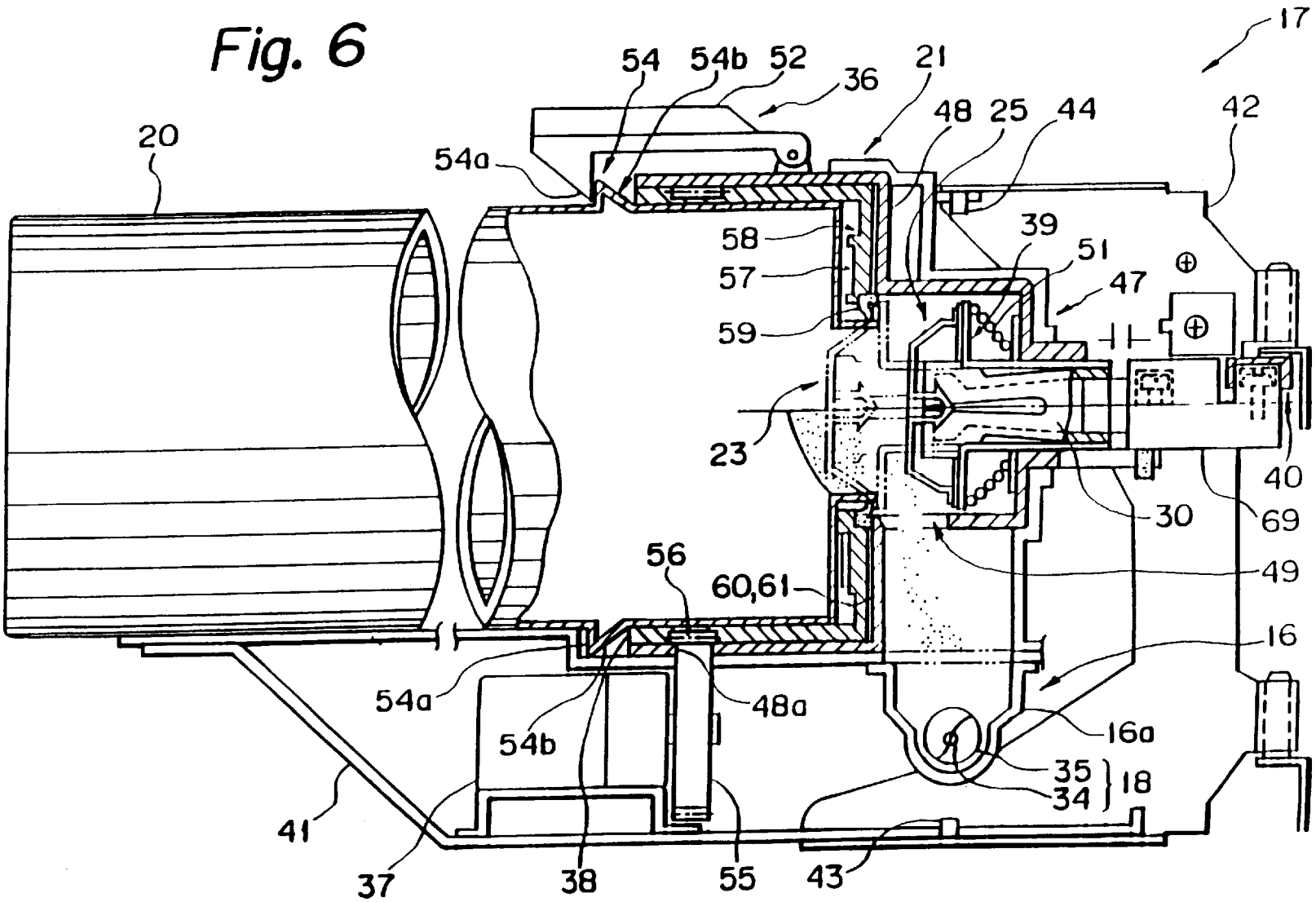
FIG. 6 is a cross-sectional view showing a toner supply unit 17 included in an embodiment of the present invention.
Figure 7:
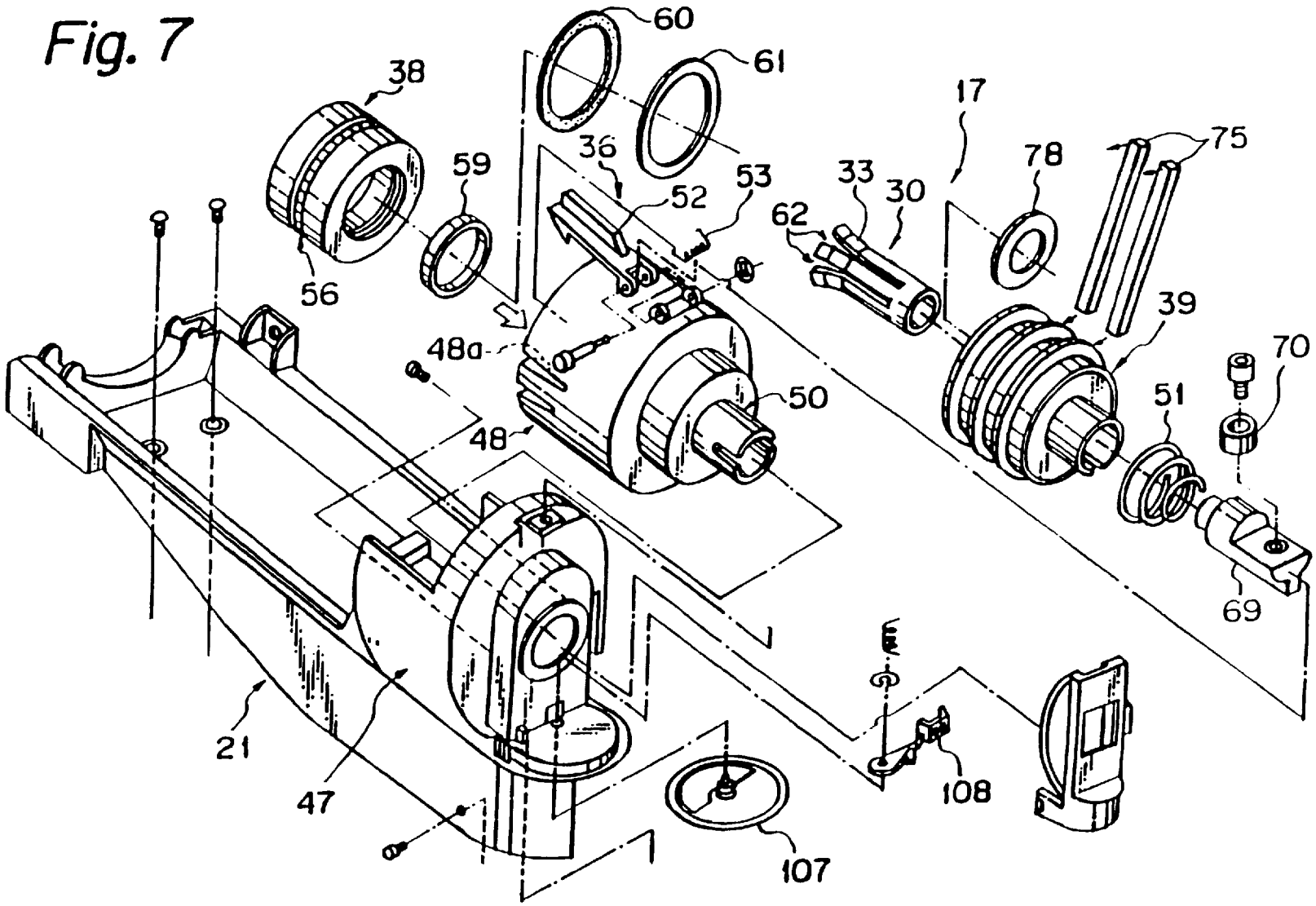
FIGS. 7 and 8 are exploded perspective views each showing a particular part of the toner supply unit 17.
Figure 8:
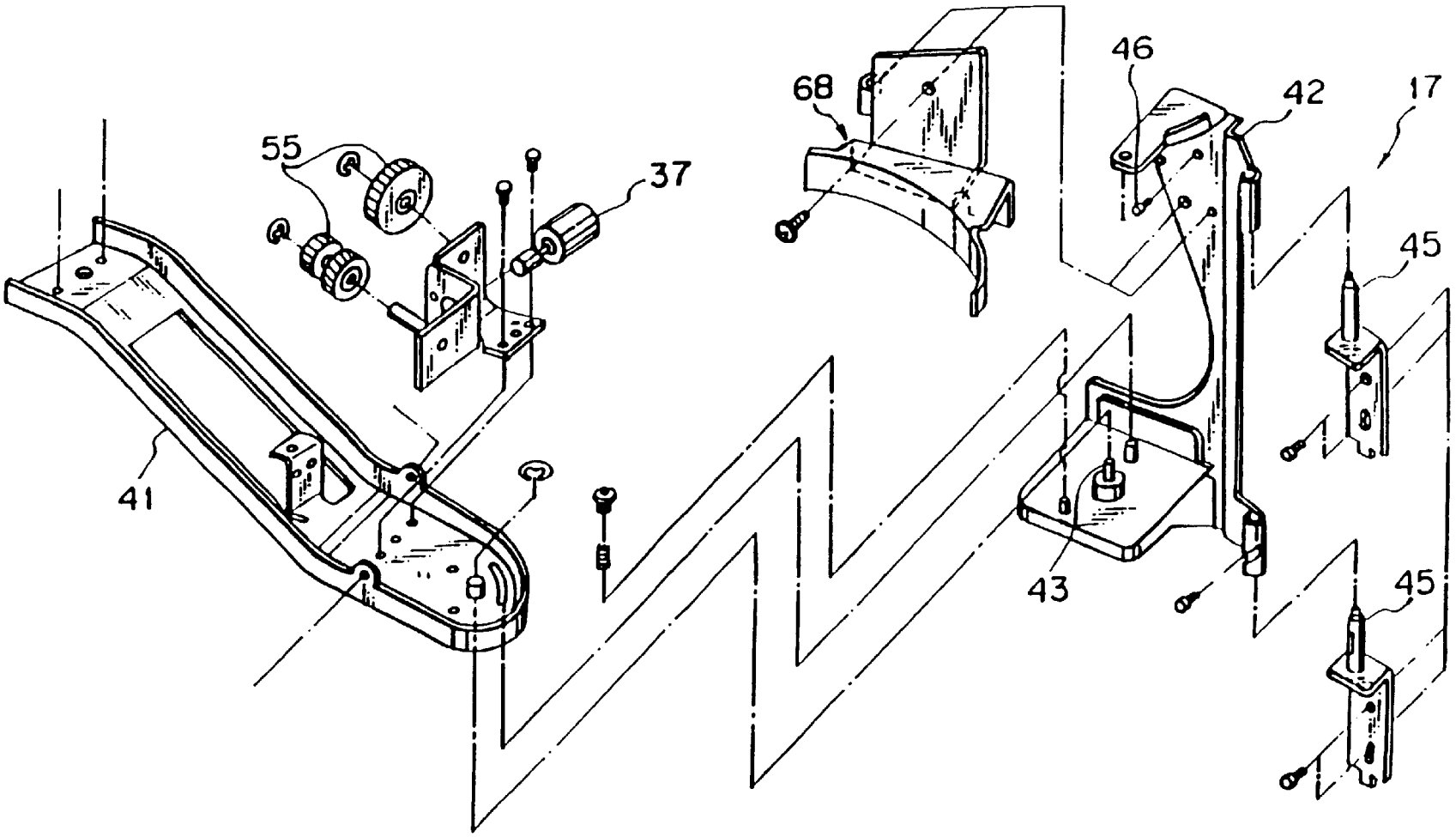

The toner supply unit 17 will be described more specifically. FIG. 6 shows the toner supply unit 17 held in position B, while FIGS. 7 and 8 show the toner supply unit 17 as including some modified parts. The toner supply unit 17 is constructed so as to hold the bottle 20 and rotate the bottle 20 in synchronism with the rotation of the toner supply roller 19. As a result, a fresh toner is sequentially supplemented to the toner receiving portion 16*a* of the hopper 16 via the mouth 23 of the bottle 20.

As shown in FIG. 6, the toner receiving portion 16*a* is implemented as an open-topped trough and extends to the front from a side wall of the hopper 16 located at the operating side. A shaft 34 extends from the inside of the hopper 16 and extends throughout the center of the toner receiving portion or trough 16*a*. A spiral member or toner feed plate 35 is affixed to the shaft 34 for conveying the toner, dropped from the mouth portion 23 of the bottle 20, to the hopper 16. The shaft 34 and spiral member 35 constitute the previously mentioned screw conveyor 18, shown in FIG. 2. The bottle holder 21 is rotatably supported by the front wall of the copier and is capable of holding the bottle 20 in a substantially horizontal position. A locking mechanism 36 positions the bottle 20 on the bottle holder 21 in the axial direction of the bottle 20. A motor 37 causes the bottle 20, set on the bottle holder 21, to rotate about an axis thereof. An annular gear link 38 transmits the rotation of the motor 37 to the bottle 20. The collet chuck 30 chucks the lid 25 on the bottle 20 held on the bottle holder 21. A core 39 is slidably coupled over the collet chuck 30. A cam device 40 moves the collet chuck 30 toward and away from the bottle 20.

As shown in FIGS. 7 and 8, the bottle holder 21 is mounted on a movable bracket 41. A stationary bracket 42 is affixed to the front wall of the copier and has a lower pin 43 and an upper pin 44, as shown in FIG. 6, studded thereon. The movable bracket 41 is rotatable supported by the lower pin 43 and rotatably retained by the upper pin 44. Therefore, the movable bracket 41 is rotatable around a substantially vertical axis extending through the upper and lower pins 44, 43. As shown in FIG. 8, the stationary bracket 42 is rotatable supported by stays 45 fastened to the front wall by screws, and the stationary bracket 42 is affixed to the front wall by screws 46.

The bottle holder 21 further includes a lid-like seat 47 for covering the end of the mouth portion 23 of the bottle 20. A cylindrical stop cover 48 is disposed in the seat 47 to cover the mouth portion 23 of the bottle 20 in an air-tight condition. The stop cover 48 has a link receiving portion rotatably accommodating the gear link 38, and a core receiving portion accommodating the core 39. The core receiving portion has a slightly great inside diameter than the diameter of the mouth portion 23 of the bottle 20. The core receiving portion is formed with an opening 49, as shown in FIG. 6, in the bottom wall thereof for letting the toner to fall. The core receiving portion also has a hole and a boss 50 on the end wall thereof for slidably supporting the collet chuck 30. An auger-like spring 51 is also accommodated in the core receiving portion to constantly bias the core 39 toward the bottle 20. The core 39, shown in FIG. 7, is a modification and has an advantage which will be described later. In FIG. 7, the reference numeral 48*a* designates a link stop for stopping an annular link formed at the edge of the open end that faces the bottle 20.

The locking mechanism 36 described above positions the bottle 20 in the axial direction of the bottle 20. The mechanism 36 has a locking member 52 and a spring 53 acting on the locking member 52. The locking member 52 is rotatably supported at the base end thereof by a member included in the bottle holder 21, e.g., the stop cover 48 shown in FIGS. 6 and 7. The free end of the locking member 52 is so shaped as to mate with an engaging portion, i.e., a projection or recess formed in the outer periphery of the bottle 20. The spring 53 constantly biases the locking member 52 toward the outer periphery of the bottle 20. In the configuration shown in FIG. 6, the engaging portion of the bottle 20 is implemented as a ring 54, having a rightangled triangular cross-section defined by a substantially vertical contact surface 54*a*, and a slanted surface 54*b*, extending from the surface 54*a* toward the mouth portion 23. The contact surface 54*a* may be overhung in such a manner as to incline toward the rear end of the bottle 20.

As shown in FIG. 6 or 8, the motor 37 for driving the bottle 20 may be mounted on the movable bracket 41, together with a gear 55. Alternatively, the motor 37 may be affixed to the copier body at a position where it can be engaged with the gear link 38, when the bottle holder 21 is brought to position B.

The gear link 38 is formed with gear teeth 56 meshing with the gear 55 associated with the motor 37 and is provided with an inside diameter greater than the outside diameter of the bottle 20. A hole is formed in the end wall of the gear link 38 to allow the collar 24 of the bottle 20 to extend therethrough. As shown in FIG. 6, the end wall of the gear link 38 is provided with, for example, a plurality of radially extending ribs 58 (referred to as link ribs hereinafter) capable of mating with ribs 57 (referred to as bottle ribs hereinafter) provided on the bottle 20 (see FIG. 34D).

In the specific arrangement shown in FIG. 6, the stop cover 48 is formed with an opening in the lower portion thereof to allow the gear 55 of the motor 37 to mesh with the gear teeth of the gear link 38. An annular seal 59 is fitted around the hole of the end wall to seal the gap between the outer periphery of the collar 24 of the bottle 20 and the stop cover 48, thereby preventing the toner coming out of the mouth portion 23 from depositing on, for example, the outer periphery of the bottle 20. At the same time, the seal 59 cleans the outer periphery of the collar 24 when the bottle 20 is replaced with a new toner bottle 20. The seal 59 is bent so as to be convex toward the collet chuck 30, so that the bottle 20 can be set with ease.

Also shown in FIG. 7 is a seal 60 made of sponge or similar soft material, which is adhered to the end of the gear link 38, a flexible thin seal 61 (e.g., 0.188 mm thick) adhered to the same end over the seal 60, and a shutter 107 for closing the opening which is formed in the seat 47 of the bottle holder 21 for letting the toner fall. Usually, the shutter 107 is held in a position when an opening formed therein is aligned with the opening of the seat 47. In the event of maintenance, a serviceman may rotate the shutter 107 by holding a thumb piece 108 in order to close the opening of the seat 47.

Figure 9A:
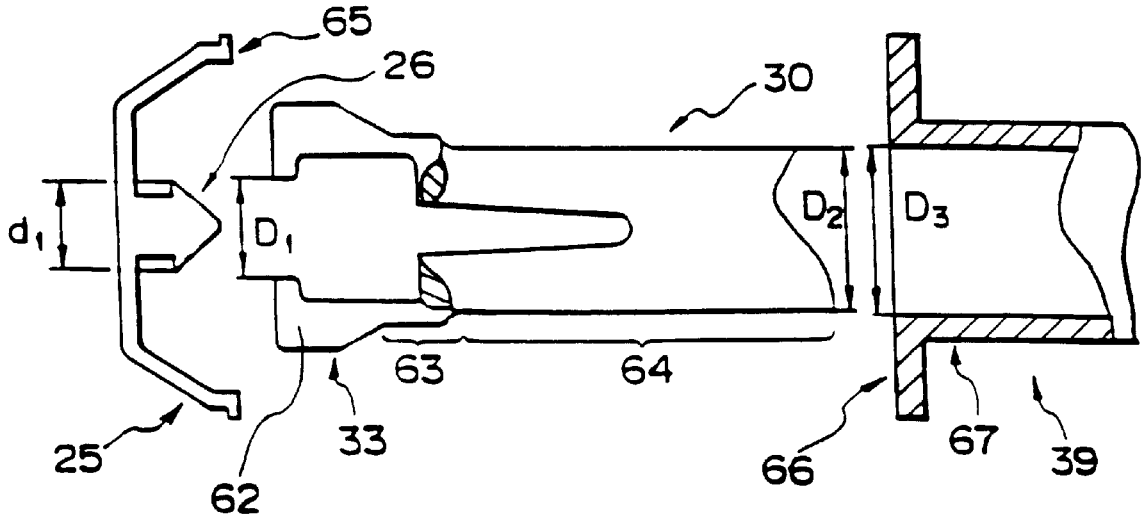
FIGS. 9A, 9B,10A, 10B, 11A, and 11B are cross-sectional views each showing a collet chuck 30 included in the toner supply unit 17.

As shown in FIG. 7, the collet chuck 30 is formed with a plurality of slits 62 to have the chucking portion 33 thereof squeezed by an external force. In the illustrative embodiment, as shown in FIG. 9A, in an unstressed position, the chucking portion 33 is open over a distance $D_1$, greater than the maximum diameter $d_1$ of the tip of the lug 26 of the lid 25. The chuck 30 includes a larger diameter portion 63, adjoining the chucking portion 33, and a smaller diameter portion 64, following the larger diameter portion 63. In an unstressed position, the larger diameter portion 63 has an outside diameter greater than the outside diameter $D_2$ of the smaller diameter portion 64.

Figure 9B:
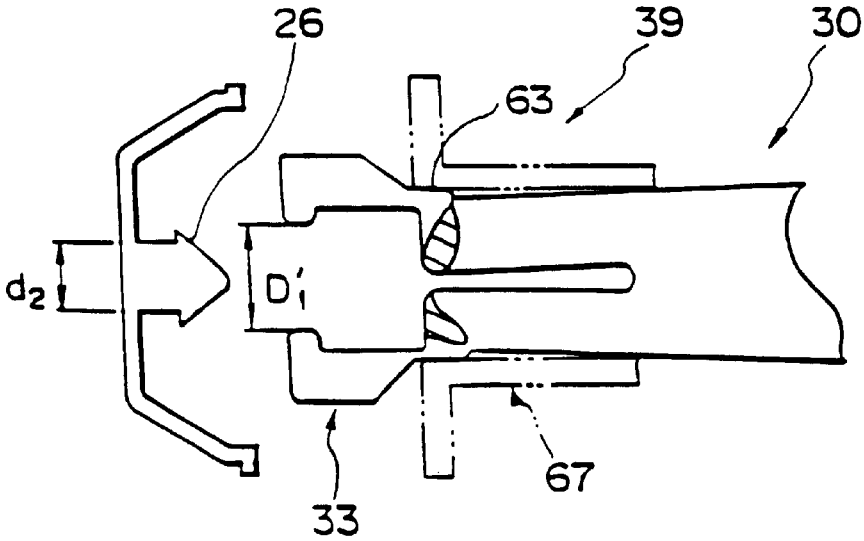

The core 39 is made up of a flange 66 capable of abutting a flange 65 provided on the lid 25, and a cylindrical slider 67, on and along which the collet chuck 30, is slidable. The slider 67 has an inside diameter $D_3$, greater than the outside diameter $D_2$ of the smaller diameter portion 64 of the chuck 30, and smaller than the outside diameter of the larger diameter portion 63, when the portion 63 is not stressed. In this configuration, when the core 39 is brought to the larger diameter portion 63 of the collet chuck 30, the former runs onto the latter to reduce the opening of the chucking portion 33, as indicated by a dash-and-dot line in FIG. 9B. The resulting opening $D'_1$ of the chucking portion 33 is selected to be at least smaller than the maximum diameter $d_1$ of the lug 26 and, preferably, equal to the diameter $d_2$ of the root of the lug 26.

The cam device 40, shown in FIG. 6, is constructed a s follows. When the bottle holder 21 is moved from position B to position A, the cam device 40 moves the collet chuck 30 away from the bottle 20. Also, when the bottle holder 21 is moved from position A to position B, the cam device 40 moves the collet chuck 30 toward the bottle 20. In the illustrative embodiment, the cam device 40 has a flat cam member 68 and a roller 70, which is rotatably mounted on a chuck shaft 69. The chuck shaft 69 is affixed to the rear end of the collet chuck 30.

Figure 10A:
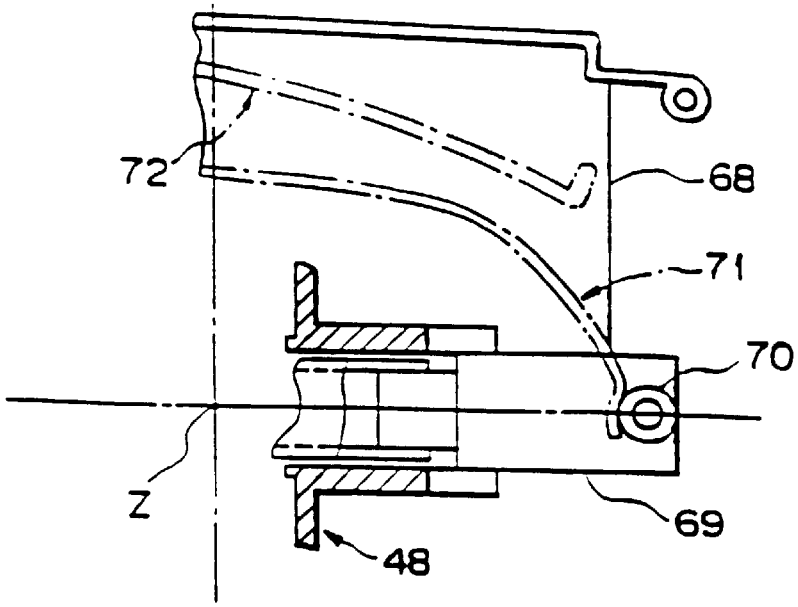
Figure 10B:
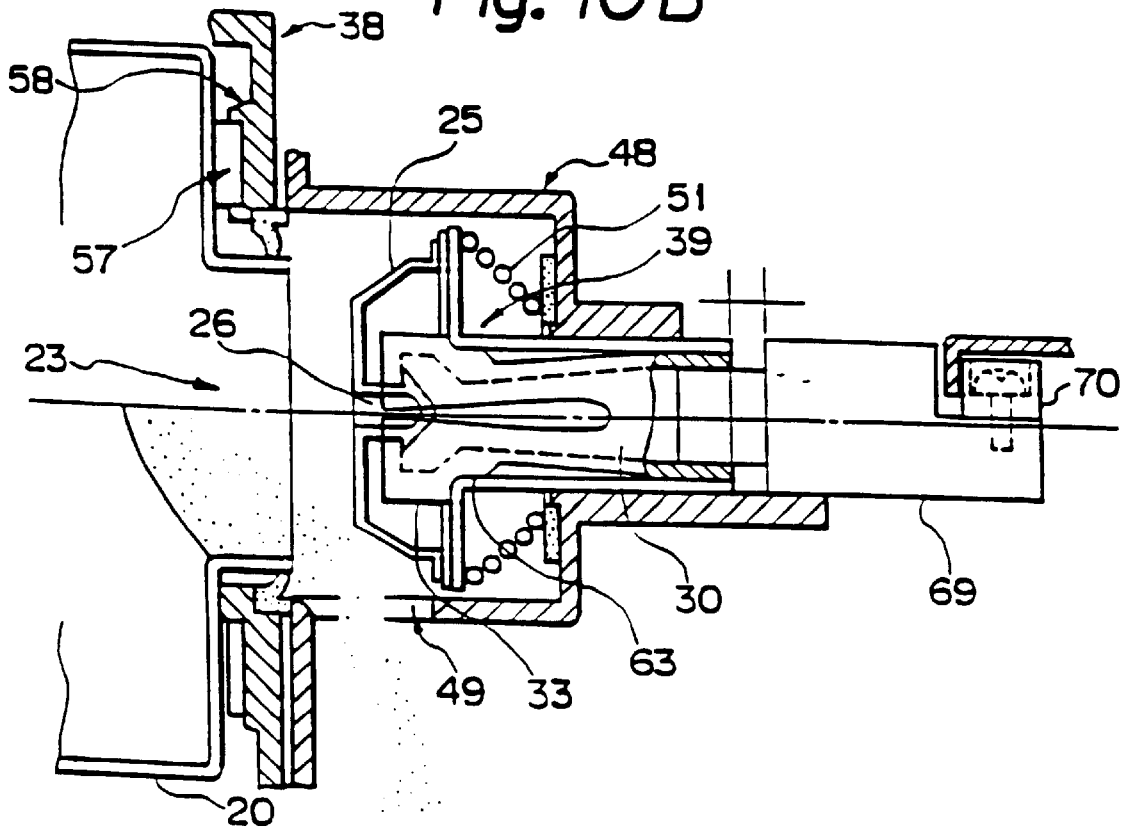

As shown in FIGS. 10A and 10B, the cam member 68 has a first surface 71 for guiding the roller 70 from the side adjoining the center of rotation Z of the bottle holder 21 is located, and a second surface 72 for guiding it from the side opposite to the center of rotation Z. As specifically shown in FIG. 10B, when the bottle holder 21 is moved from position B to position A, the first surface 71 guides the roller 70 such that the collet chuck 30, biased toward the bottle 20, by the spring 51 via the core 39, which is engaged with the larger diameter portion 63 of the collet chuck 30, moves away from the bottle 20. When the bottle holder 21 is moved from position A to position B, the first surface 71 guides the roller 70 such that the collet chuck 30, biased by the spring 51, moves toward the bottle 20.

Figure 11A:
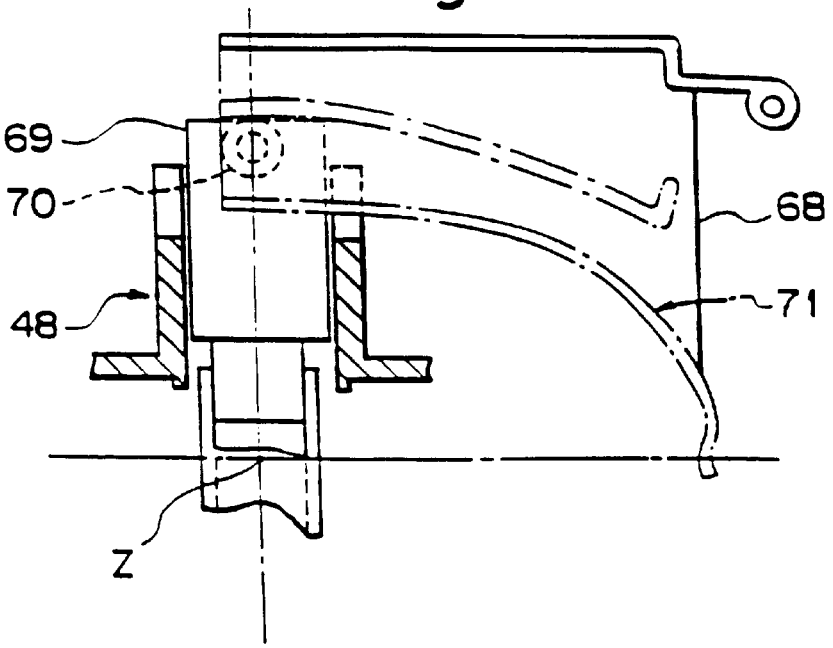
Figure 11B:
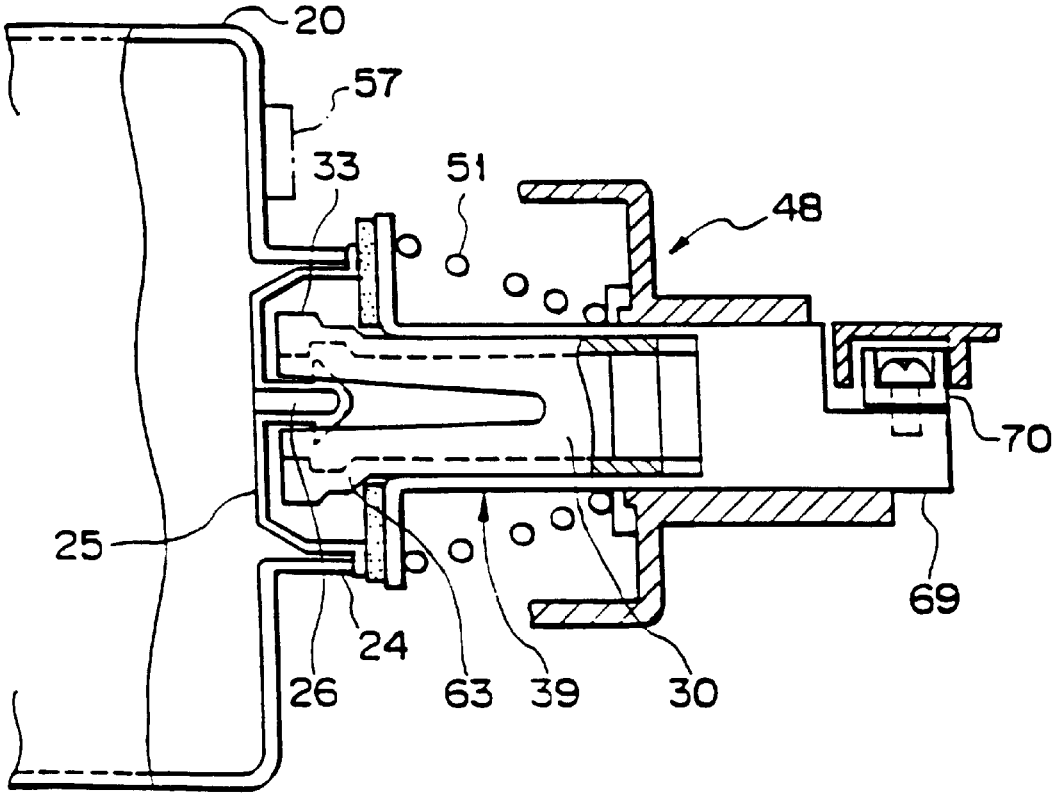

As specifically shown in FIG. 11B, just before the completion of movement of the bottle holder 21 from position A to position B, the core 39 abuts the edge of the collar 24 of the bottle 20 positioned by the locking mechanism 36. As a result, the core 39 is released from the larger diameter portion 63 of the collet chuck 30, preventing the force of the spring 51 from acting on the collet chuck 30. From this instant, to the instant when the movement of the bottle holder 21 to position B is completed, the second surface 72 of the cam member 68 guides the roller 70 such that the collet chuck 30 approaches the bottle 20.

The cam device 40 is located in the vicinity of the center of rotation Z of the bottle holder 21, as stated above. Hence, when the person intending to replace the bottle 20 pulls or pushes the bottle holder 21 between positions A and B, the point of the bottle holder 21 where the resulting force acts and the center of rotation Z are spaced apart a greater distance than the engaging point of the first surface 71 or the second surface 72 and the roller 70 and the center of rotation Z. This allows the bottle holder 21 to be moved by a relatively small force, based on leverage.

In the above-described construction, while an ordinary copying operation is under way, the toner supply unit 17 has the bottle holder 21 thereof located at position B. To position the bottle holder 21 at position B, it is preferable that a locking mechanism 36, e.g., one using a magnet, be provided on the front wall of the copier and bottle holder 21. As shown in FIG. 6, in position B, the bottle 20, set on the bottle holder 21, is positioned with the ring 54 thereof abutting the end of the locking member 52 of the locking mechanism 36. In this condition, the bottle ribs 57 of the bottle 20 are engaged with the link ribs 58 of the gear link 38. As shown in FIGS. 10A and 10B, the collet chuck 30 assumes a position remotest from the bottle 20. In this position, the core 39, biased by the spring 51, is positioned at the larger diameter portion 63 of the collet chuck 30 to squeeze the chucking portion 33. As a result, the chucking portion 33 unseals the mouth portion 23 of the bottle 20, chucking the lug 26, i.e., lid 25. The toner receiving portion 16*a*, shown in FIG. 6, of the hopper 16, is disposed below the opening 49 of the stop cover 48.

As the toner concentration in the developing unit decreases due to repeated development, the toner supply roller 19 starts rotating in response to the output signal of a toner concentration sensor (now shown). At the same time, the motor 37 starts rotating. The rotation of the motor 37 is transmitted to the bottle 20 via the gear 55 and gear link 38, thereby causing the bottle 20 to rotate. The spiral guide groove 27, formed in the inner periphery of the bottle 20, sequentially drives the toner toward the mouth portion 23 of the bottle 20, until it falls from the mouth portion 23. The toner, dropped from the bottle 20, is received by the toner receiving portion 16*a* of the hopper 16 via the opening 49 of the stop cover 48. Then, the screw conveyor 18 conveys the toner from the toner receiving portion 16*a* to the hopper 16 deeper into the copier. This operation is continued until the toner concentration in the developing unit increases to a predetermined value, i.e., until the toner supply roller 19 stops rotating. Alternatively, the bottle 20 may be rotated at an adequate time when the toner in the hopper 16 decreases.

Figure 12B:
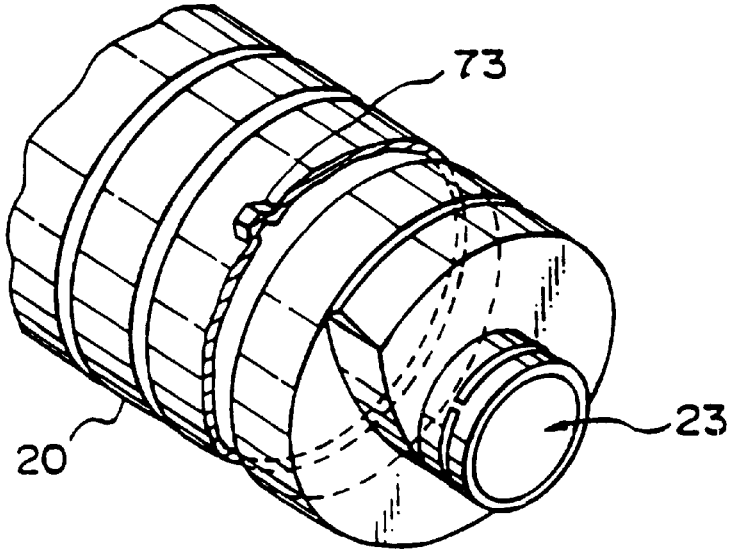
FIG. 12B is a cross-sectional perspective view of the toner bottle 20.

As shown in FIGS. 12A and 12B, a projection 73 may be provided on the toner bottle 20 at a position where it can face a part of the locking member 52 of the above-described positioning mechanism. Then, when the bottle 20 is rotated, the projection 73 contacts a part of the locking member 52 and raises the free end of the member 52 against the action of the spring 53, as shown in FIG. 7, but only to such a degree that the member 52 is not fully released from the ring 54. Subsequently, as the projection 73 moves away from the locking member 52, the member 52 is restored and hits against the outer periphery of the bottle 20, causing the wall of the bottle 20 to vibrate. This is successful in increasing the fluidity of the toner in the bottle 20 and, therefore, causing a greater quantity of toner to flow out of the bottle 20 via the mouth portion 23. In addition, a minimum of toner is caused to adhere to the inner periphery of the bottle 20.

In FIGS. 12A and 12B, the particular configuration of the bottle 20 around the mouth portion 23 promotes the efficient discharge of the toner from the bottle 20, as will be described in detail later.

To remove the bottle 20 from the bottle holder 21 for replacement or a similar purpose, the bottle holder 21 is moved from position B to position A. While the bottle holder 21 is in movement, the cam device 40 guides the roller 70 with the first surface 71 thereof, such that the collet chuck 30 carying the lid 25 therewith moves toward the mouth portion 23 of the bottle 20. Consequently, the flange 66 of the core 39 abuts the edge of the collar 24 of the bottle 20 via the flange 65 of the lid 25. Even after the movement of the core 39 has been restricted by the collar 24, the cam device 40 guides the roller 70 with the second surface thereof to continuously move the collet chuck 30, until the larger diameter portion 63 of the collet chuck 30 has been released from the core 39. As a result, the chucking portion 33 is opened due to the restoring force of the collet chuck 30, releasing the lug 26 of the lid 25. By the procedure described so far, the lid 25 is inserted into the collar 24 of the toner bottle 20, thereby sealing the mouth portion 23. When the bottle holder 21 is fully brought to position A, the chucking portion 33 of the collet chuck 30 is open over a distance greater than the maximum diameter $D_1$ of the lug 26 of the lid 25, as shown in FIGS. 9A, 11A, and 11B.

Subsequently, when the bottle holder 21 is held in position A, the locking member 52 of the locking mechanism 36 is manually pulled up away from the bottle 20 against the action of the spring 53 until the member 52 has been released from the ring 54 of the bottle 20. Then, the bottle 20 is pulled out from the stop cover 48 and taken out from the bottle holder 21.

Figure 13A:
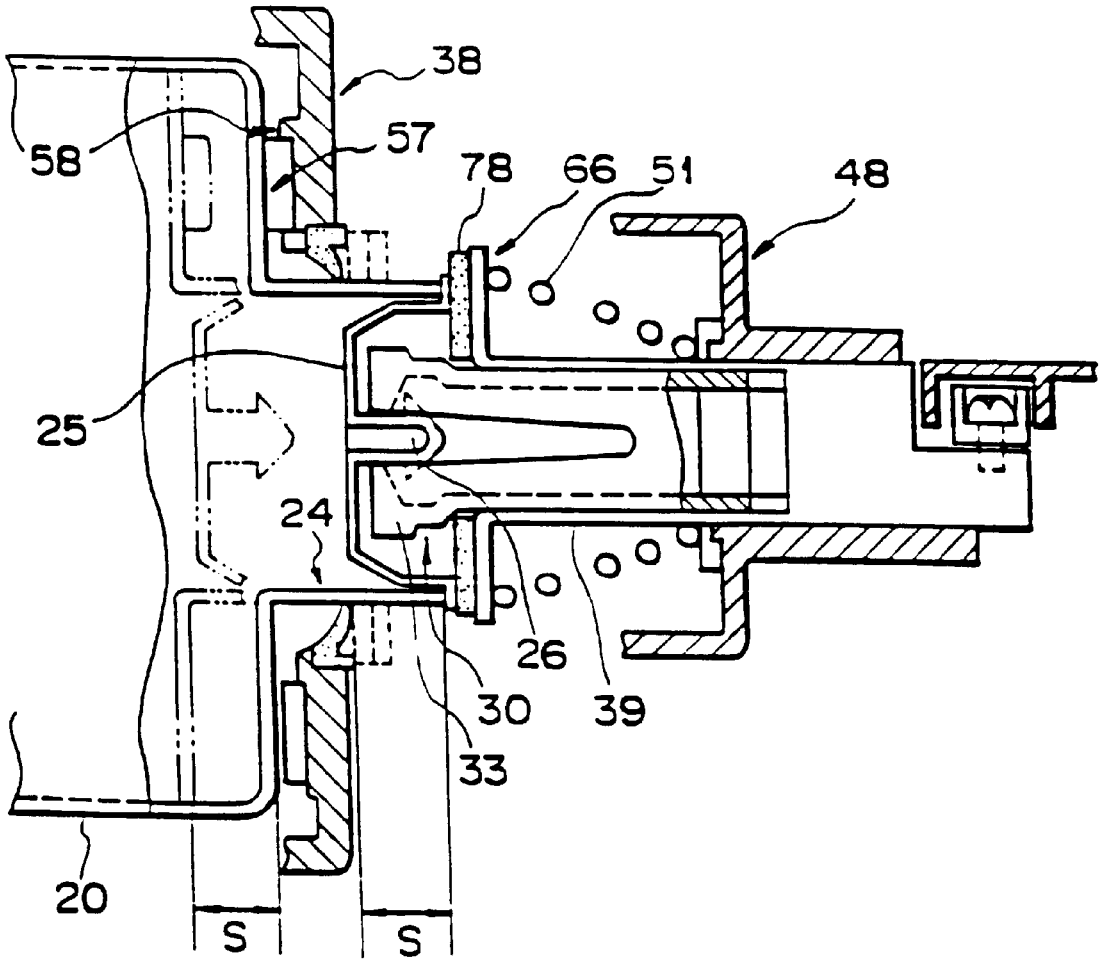
FIG. 13A is a cross-sectional view of the collet chuck 30.

The locking member 52 is constantly biased toward the bottle 20 by the spring 53. Hence, when the locking member 52, being manually pulled up, as mentioned above, is released, the free end thereof will drop and again mates with the ring 54 of the bottle 20. Therefore, it is necessary to maintain the free end of the locking member 52 in the lifted position in the event when the bottle 20 should be pulled out. To meet this requisite, the bottle 20 should preferably be automatically displaced when the locking member 52 is lifted away from the bottle 20. FIG. 13 shows a specific implementation in which the spring 51 forces out the toner bottle 20 via the core 39 when the bottle 20 is released from the locking mechanism 36. As shown, the height of the collar 24, as well as other factors, is selected, such that when the bottle 20 is positioned by the locking mechanism 36, the edge of the collar 24 protrudes a predetermined quantity S from the stop cover 48. In this configuration, at the moment when the locking member 52 is lifted away from the ring 54 of the bottle 20, the core 39 is moved by the spring 51 until the flange 66 thereof hits against the gear link 38. As a result, the bottle 20 is forced out by the predetermined quantity S.

Assume that in the initial state of movement of the core 39 and before the lug 26 of the lid 25 has been fully released from the chucking portion 33 of the collet chuck 30, the core 39 has engaged with the larger diameter portion 63 of the collet chuck 30 and squeezed the chucking portion 33. Then, the lid 25 is continuously held by the collet chuck 30, i.e., the mouth portion 23 of the bottle 20 is open even when the bottle 20 is pulled out. As a result, the toner deposited on the inner surface of the mouth portion 23 is apt to fall and smear the hands and clothes. Moreover, when the chucking portion 33 is so squeezed, it is likely that when a new toner bottle 20 is set, the lug 26 of its lid 25 cannot enter the chucking portion 33.

In light of this, the above-mentioned quantity S should preferably be selected such that even after the flange 66 of the core 39 has abutted the gear link 38, the core 39 does not contact the larger diameter portion 63 of the collet chuck 30, thereby maintaining the chucking portion 33 in an open position. Specifically, the gear link 38 should preferably be positioned such that when the bottle 20 is released from the locking mechanism 36, the core 39 abuts the gear link 38 before it engages the larger diameter portion 63 of the collet chuck 30. While the gear link 38 is used to restrict the movement of the core 39, it may be replaced with an exclusive member for restriction.

At position A, the empty bottle 20 is replaced with a new bottle 20. Specifically, a new bottle 20 is filled with a fresh toner and has the mouth portion 23 thereof sealed by a lid 25. The new bottle 20 is mounted to the bottle holder 21 with the head portion thereof facing the stop cover 48. Then, the head portion of the bottle 20 is inserted into the stop cover 48. At this instant, the locking member 52 of the locking mechanism 36 catches the ring 54 of the bottle 20 being moved into the stop cover 48. As a result, the toner bottle 20 is positioned on the bottle holder 21. In the illustrative embodiment, while the bottle 20 is moved deeper into the stop cover 48, the free end of the locking member 52 runs onto the slanted surface **54*b* of the ring 54. This, coupled with the fact that the ring 54 raises the inclined surface of the member 52, makes it needless to lift the locking member 52** manually.

The core 39 is held in a position where it does not contact the larger diameter portion 63 of the collet chuck 30 in the stop cover 48, as stated earlier. Hence, the chucking portion 33 of the collet chuck 30 is left open. It follows that the lug 26 of the lid 25 can be moved into the chucking portion 33 smoothly.

A particular arrangement is assumed wherein, when the bottle 20 is forced out by the core 39, as stated previously, the chucking portion 33 of the collet chuck 30 is closed after the lug 26 of the lid 25 has been released from the chucking portion 33. In such a case, the lid 25 should preferably be configured such that the flange 65 thereof protrudes sufficiently more than the lug 26. Then, when a new bottle 20 is inserted into the stop cover 48, the edge of the collar 24 pushes the flange 66 of the core 39 via such a flange 65 of the lid 25 to release the core 39 from the larger diameter portion 63 of the collet chuck 30, thereby opening the chucking portion 33. In this condition, the lug 26 of the lid 25 enters the chucking portion 33 which is the open.

Thereafter, the bottle holder 21 is moved from position A to position B. At this instant, the cam device 40 guides the roller 70 with the first surface 71 thereof such that the collet chuck 30, carrying the lid 25 therewith, moves away from the mouth portion 23 of the bottle 20. In the initial stage of movement, the collet chuck 30 has the larger diameter portion 63 thereof brought into engagement with the core 39 and has the chucking portion 33 squeezed thereby. As a result, the chucking portion 33 chucks the lug 26 of the lid 25. Even after this, the core 39 and larger diameter portion 63 are continuously engaged by the force of the spring 51, so that the chucking portion 33 holds the lid 25 continuously. Consequently, the lid 25 is removed from the mouth portion 23 to thereby unseal the bottle 20. In this way, the bottle holder 21 is fully moved to position B, as shown in FIGS. 6, 10A and 10B. In position B, a fresh toner is sequentially supplemented from the bottle 20, while the bottle 20 is in rotation.

As stated above, with the toner supply unit 17 of the embodiment, it is possible to replace the bottle 20 simply by moving the bottle holder 21 and then replacing the bottle 20. At this instant, the toner is prevented from leaking from the mouth portion 23 of the bottle 20.

Figure 13B:
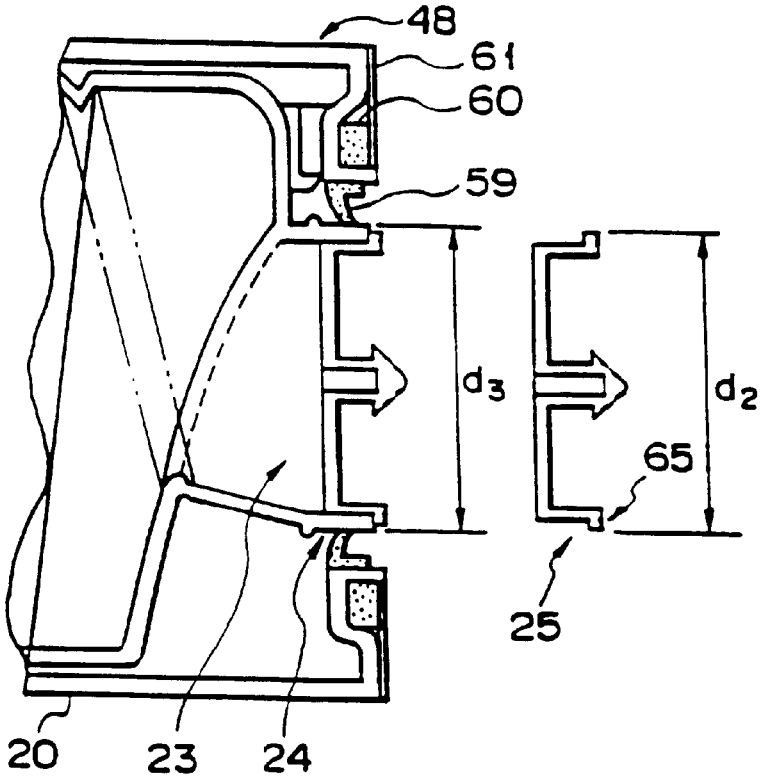
FIGS. 13B and 13C are cross-sectional views each showing another specific configuration of the toner bottle 20.
Figure 13C:
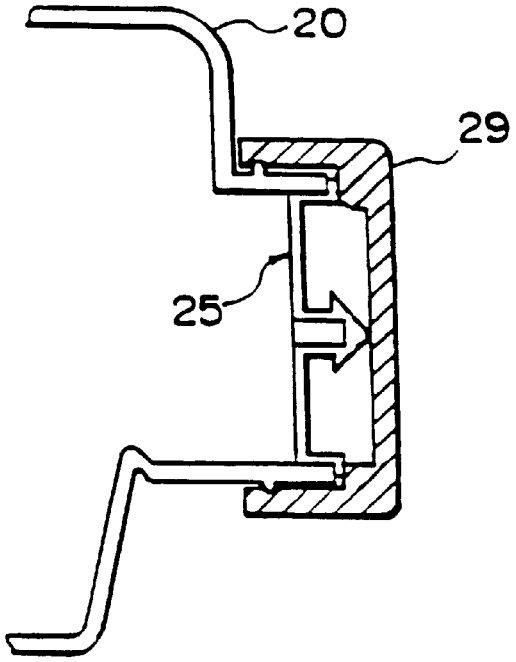

As shown in FIG. 13B, the flange 65 of the lid 25 should preferably be provided with an outside diameter $d_2$ which is smaller than the outside diameter $d_3$ of the collar 24. Otherwise, when the bottle 20 is moved into and out of the stop cover 38, the flange 65 is apt to contact the seal 59 fitted on the inner periphery of the stop cover 38, causing the lid 25 to be removed. Further, as shown in FIG. 13C, the cap 29 is fitted on the bottle 20 over the lid 25. The cap 29 prevents the lid 25 from being accidentally removed from the bottle 20 when the bottle 20 is transported, particularly, over high land or by aircraft. In addition, since the cap 29 protects the lid 25, it is not necessary for the lid 25 to be rigidly coupled to the collar 24, reducing the force required of the automatic lid attaching and detaching mechanism.

Figure 14A:
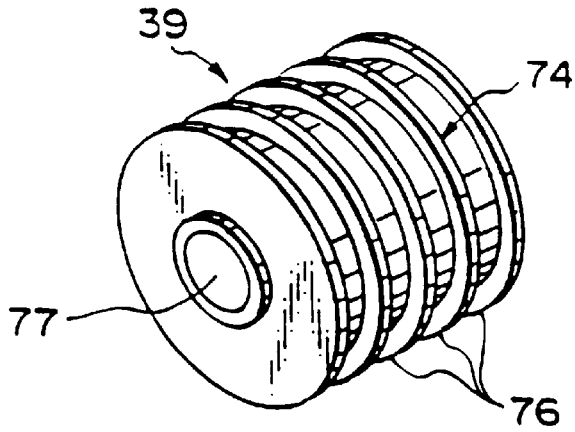
FIGS. 14A–14E are perspective views each showing a specific constituent part included in a core 39, shown in FIG. 7.
Figure 14B:
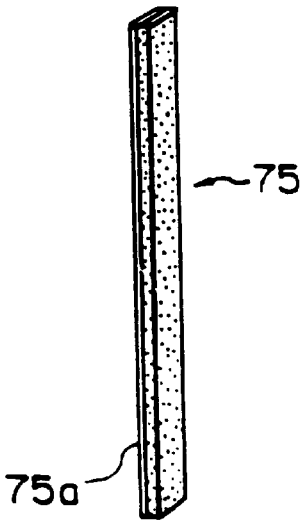
Figure 14C:
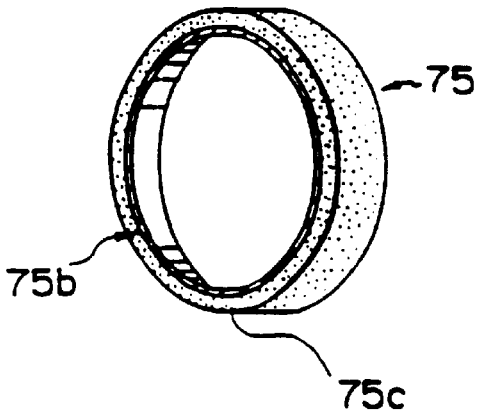

A modified form of the core 39, shown in FIG. 7, will be described with reference to FIGS. 14A–14E. As shown in FIG. 14A, the core 39 has a cylindrical drum portion 74 having a diameter slightly smaller than the inside diameter of the stop cover 48. Flanges 76 are provided on the circumferential surface of the drum portion 74 to form a plurality of annular recesses. Annular seal members 75, shown in FIGS. 14B and 14C, are fitted in the individual annular recesses of the drum portion 74 and arranged side by side in the axial direction of the drum portion 74. The seal members 75 seal the gap between the outer periphery of the core 39 and the inner periphery of the stop cover 48. As shown in FIG. 14B, each seal member 75 may be implemented as an elongate member having an adhesive layer **75*a* and having opposite ends thereof abutting each other. Alternatively, as shown in FIG. 14C, the seal member 75 may be implemented as a ring and adhered to the drum portion 74. Preferably, the seal members 75, having the configuration shown in FIG. 14B, should be positioned such that their portions where opposite ends abut each other deviate in the axial direction of the core 39. Also, the annular seal member 75, shown in FIG. 14C, should preferably be constituted by an elastic member 75*b*, enriched in elasticity mainly in the circumferential direction, e.g., a non-foam elastic body, and an elastic body 75*c*, provided on the elastic body 75*b*** and enriched in elasticity mainly in the direction of thickness, e.g., a foam elastic body.

Figure 14D:
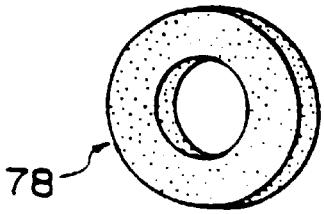
Figure 14E:
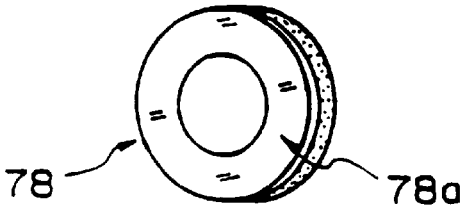

The core 39, shown in FIG. 14A, is formed with a boss 77 at the end thereof which abuts the flange 65 of the lid 25. A hole for the collet chuck 30 to extend into is formed throughout the core 39 in the boss 77. The boss 77 also serves to position a flat annular end seal 78, shown in FIG. 14D or 14E, when the seal 78 is fitted on the end of the flange by adhesion. The end seal 78 may be implemented by a single material, as shown in FIG. 14D, or by a plurality of annular elements adhered to each other. It is preferably that at least the front end 78*a* of the end seal 78 be constituted by silicone resin, fluorine resin, or similar resin having, for example, small surface energy, so that the toner may not deposit thereon easily.

A reference will be made to FIGS. 15–18 for describing an improved implementation for reducing the force to be manually exerted on the bottle holder 21. Assume that the toner is deposited on the inner periphery of the collar 24 of the bottle 20 and the portion of the lid 25 contacting it. Then, the force necessary for the lid 25 to be inserted into and removed from the mouth portion 23 of the bottle 20 is increased. As a result, the force necessary for the bottle holder 21 to be pushed from position A to position B (causing the end 25 to be removed from the mouth portion 23) and the force necessary for it to be pulled from position B to position A (causing the lid 25 to be inserted into the mouth portion 23) are increased.

Figure 15:
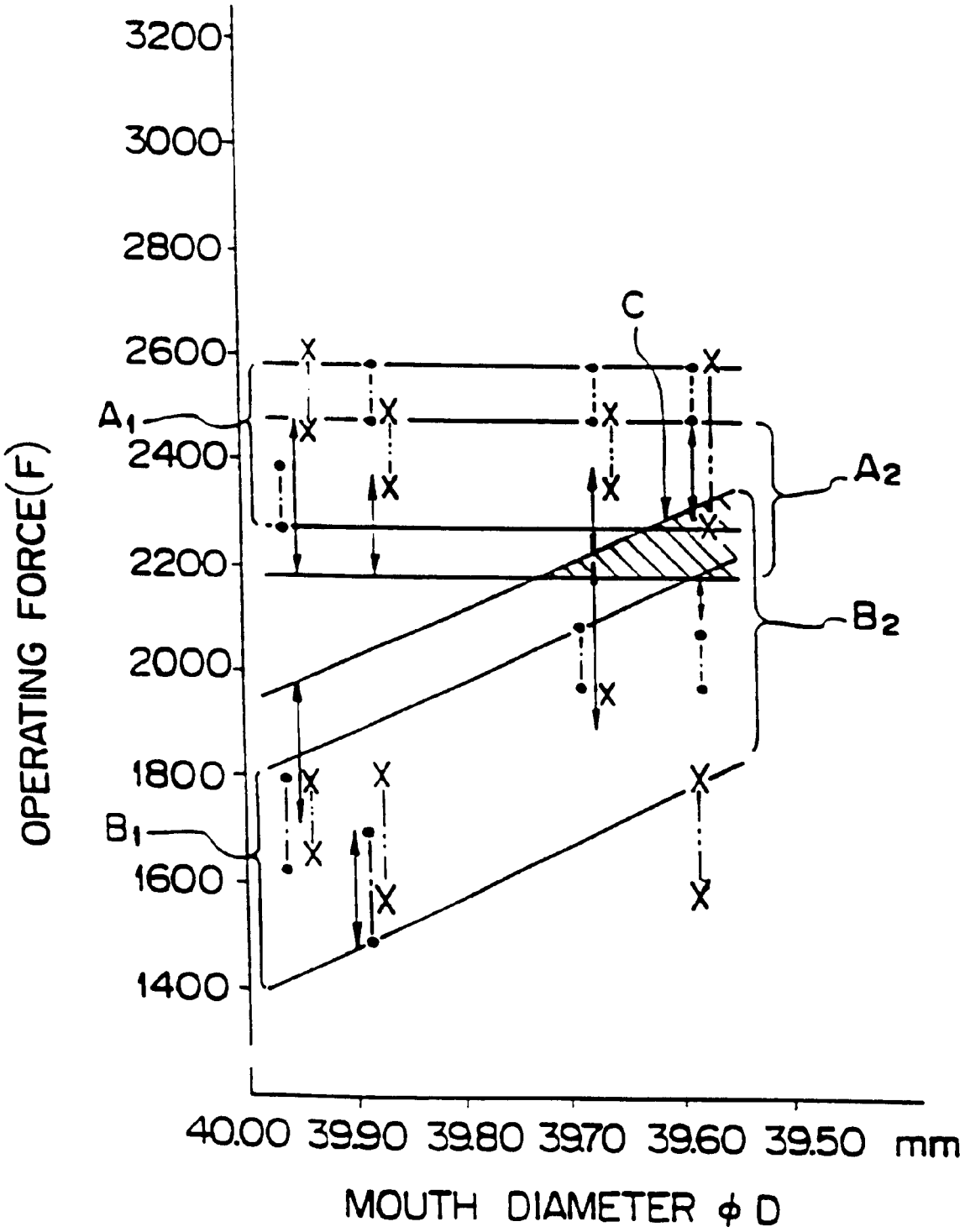
FIG. 15 is a graph indicative of a relationship between the force necessary for a person to operate the toner supply unit 17 and the diameter of the mouth portion 23 of the toner bottle 20.

The pushing force and pulling force mentioned above were measured with three different types of toner supply units 17 (referred to as types I, II, and III hereinafter) different in the shape of the collet chuck 30 and that of the core 39, and with toner bottles 20 having various mouth diameters. A toner was deposited on, for example, the inner periphery of the collars 24 of such bottles 20. FIG. 15 is indicative of the results of measurement. In FIG. 15, the abscissa and the ordinate indicate the diameter of the mouth portion 23 of the bottle 20 and the force needed to move the bottle holder 21, respectively. The graph includes dash-and-dot lines representative of the results of measurement. Among them, a dash-and-dot line marked with arrows and a dash-and-dot line marked with dots are associated with types I and II, respectively. A dash-and-dot line marked with crosses is associated with type III. The pushing forces measured with the type I are distributed in a region $A_1$ indicated by a brace, while the pulling forces also measured with the type I are distributed in a region $B_1$. The pushing forces measured with the type II are distributed in a region $A_2$ while the pulling forces measured with the type II are distributed in a region $B_2$. Although distributions measured with the type III are not shown in the graph, the pushing forces measured lie in the regions $A_1$ and $A_2$ while the pulling forces lie in the regions $B_1$ and $B_2$ and below them. Defective insertion occurred in a region C indicated by hatching (enclosed by a horizontal line representative of a force of 2200 g and an inclined line representative of the upper limit of the region $A_2$).

As FIG. 15 indicates, the required pushing force is greater than the required pulling force and should be, for example, greater than 2 kg. Further, when the pulling force exceeds, for example, 2.2 kg due to the diameter of the mouth portion 23 and the configuration of the collet chuck 30 and core 39, the lid 25 is inserted defectively.

Figure 16:
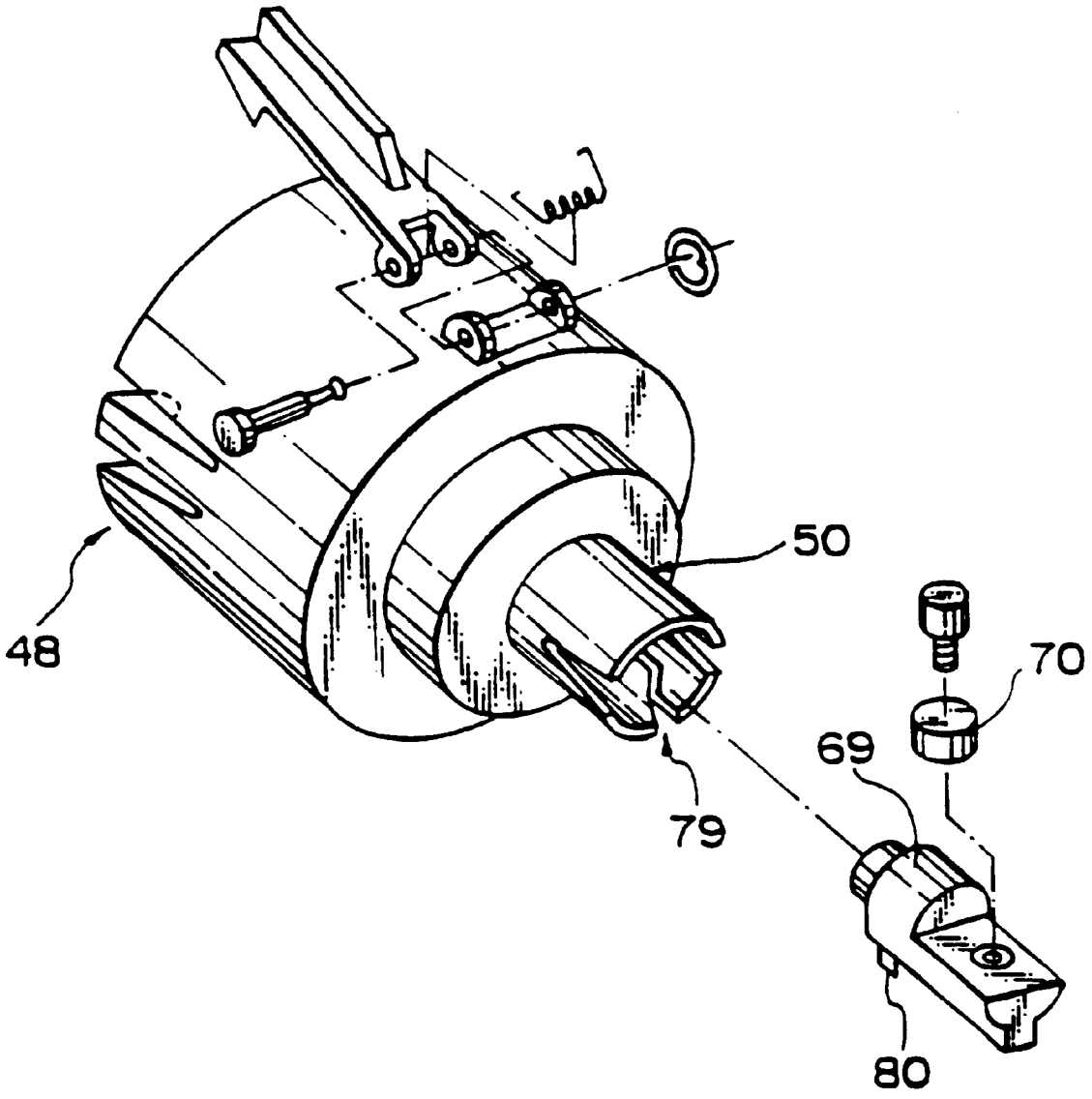
FIG. 16 is a perspective view showing a stop cover 48 and a collet chuck shaft 69 included in a modified embodiment.

FIG. 16 is a fragmentary view of an improved mechanism which causes, when the lid 25 is attached to or detached from the mouth portion 23 of the bottle 20, the lid 25 to rotate about the axis thereof. As a result, the lid 25 is attached to and detached from the mouth portion 23 smoothly, reducing the pushing force and pulling force. To cause the lid 25 to rotate about the axis thereof, the boss 50 of the stop cover 48, in which the collet chuck 30 slides, is formed with a cam slit 79 for causing the collet chuck 30 to rotate while moving toward and away from the bottle 20. A pin 80 is studded on the chuck shaft 69 of the collet chuck 30 and movably received in the cam slit 79.

Figure 17A:
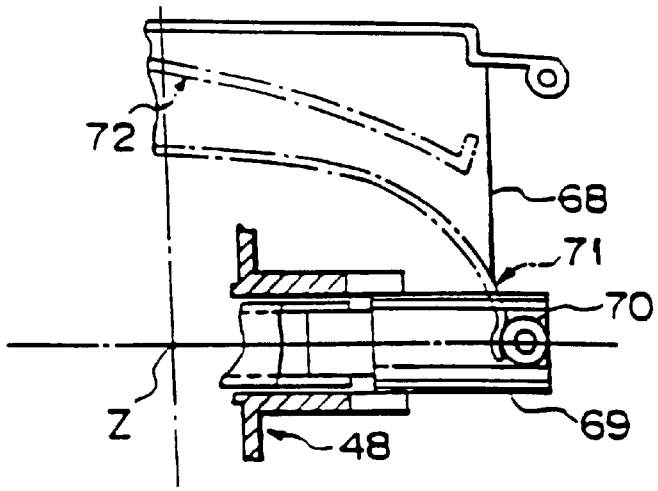
FIGS. 17A–17D demonstrate the operation of the modified embodiment.
Figure 17B:
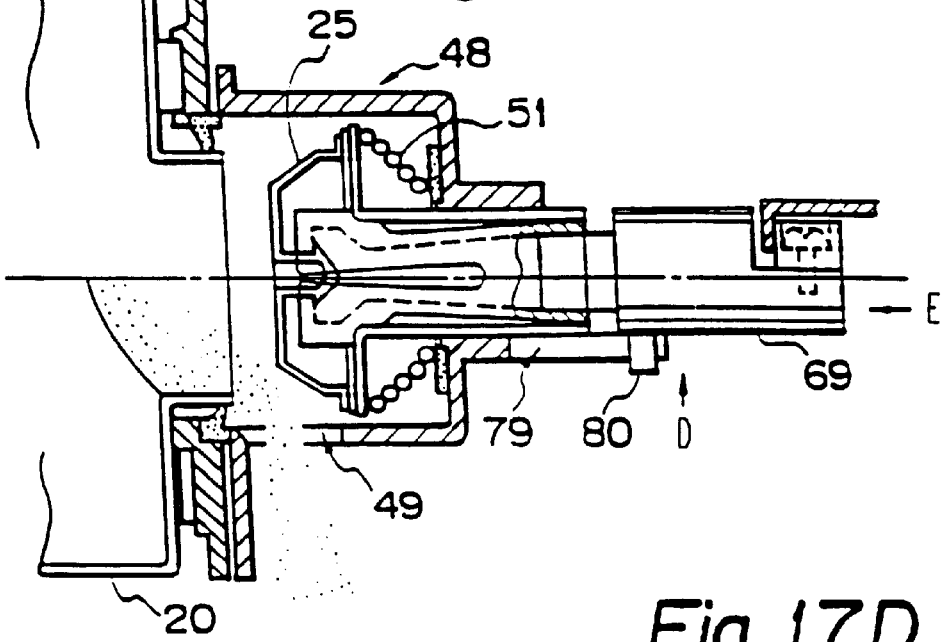
Figure 17D:
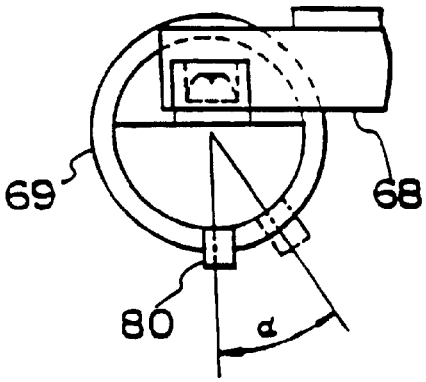
Figure 17C:
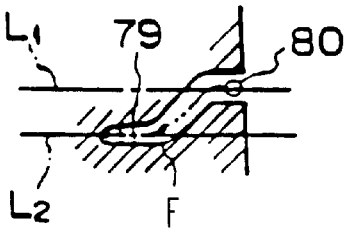
Figure 18A:
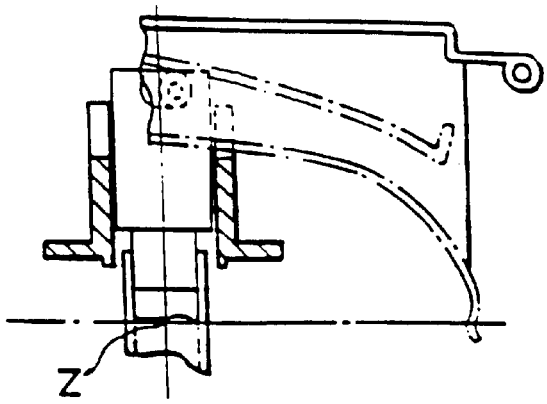
FIGS. 18A–18D show another operation of the modified embodiment.
Figure 18B:
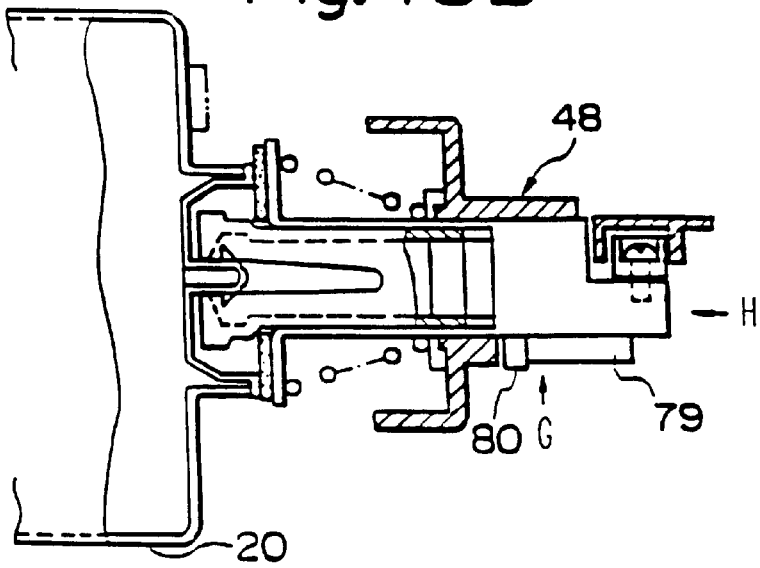
Figure 18C:
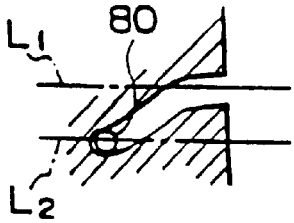
Figure 18D:
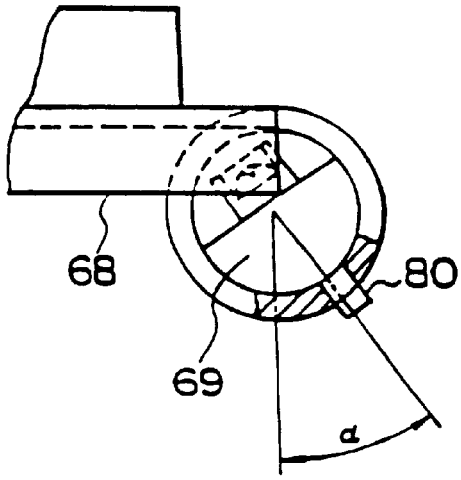

FIGS. 17A and 17B correspond to FIGS. 10A and 10B, respectively, and show the improved mechanism in a condition wherein the bottle holder 21 is located at position B. FIG. 10C is an enlarged view of the mechanism, as seen in the direction indicated by an arrow D in FIG. 17B. FIG. 17D is an enlarged view of the mechanism, as seen in the direction indicated by an arrow E in FIG. 17B. As shown, the pin 80 is positioned in the outermost portion of the cam slit 79 formed in the circumferential lowermost portion of the boss 50, which is indicated by a dash-and-dot line $L_1$ in FIG. 17C. The innermost end of the cam slit 79 assumes a position indicated by a dash-and-dot line $L_2$, as shown in FIG. 10C, which deviates by a predetermined angle a, e.g., 90 degrees from the position $L_1$. While the pin 80 moves from the outermost portion to the innermost portion of the cam slit 79, as indicated by a dash-and-dots line C in FIG. 17C, the slit 79 causes the pin 80 to rotate the predetermined angle $\alpha$ about the axis of the boss 50, as indicated by FIG. 17D. FIGS. 18A and 18B correspond to FIGS. 11A and 11B, respectively, and show the mechanism in the condition wherein the bottle holder 21 is located at position A. FIG. 18C is an enlarged view as seen in the direction indicated by an arrow G in FIG. 18B. FIG. 18D is an enlarged view as seen in the direction indicated by an arrow H in FIG. 18B.

In operation, when the bottle holder 21 is moved from position B toward position A, the chuck shaft 69 of the collet chuck 30 moves toward the toner bottle 20, while sliding within the boss 50 of the stop cover 48. At the same time, the pin 80 rotates the predetermined angle a about the axis of the boss 50 of the stop cover 48 by being guided by the cam slit 79, as indicated by the line F in FIG. 17C. As a result, the lid 25 held by the collet chuck 30 is sequentially inserted into the collar 24 of the bottle 20, while rotating about the axis of the boss 50.

Conversely, when the bottle holder 21 is moved from position A toward position B, the chuck shaft 69 moves away from the bottle 20 while sliding within the boss 50 of the stop cover 48. At this instant, the pin 80 rotates the angle $\alpha$ around the axis of the boss 50 in the opposite direction by being guided by the cam slit 79. Consequently, the lid 25, held by the collet chuck 30, is removed from the collar 24 of the bottle 20, while rotating about the axis of the boss 50.

As stated above, the lid 25 is inserted and removed from the mouth portion 23 of the bottle 20, while rotating about the axis of the boss 50 of the stop cover 48. This promotes smooth insertion and removal of the lid 25 from the mouth portion 23 and, therefore, reduces the required forces for pushing and pulling the bottle holder 21, compared to the case wherein the lid 25 does not rotate.

Figure 19A:
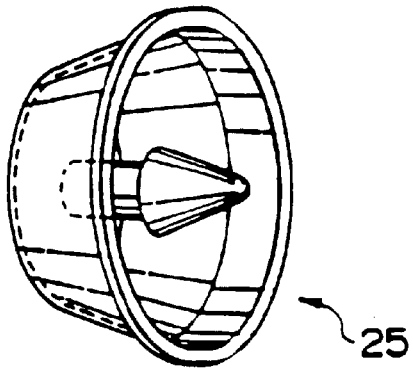
FIG. 19A is a perspective view showing the lid 25.
Figure 19B:
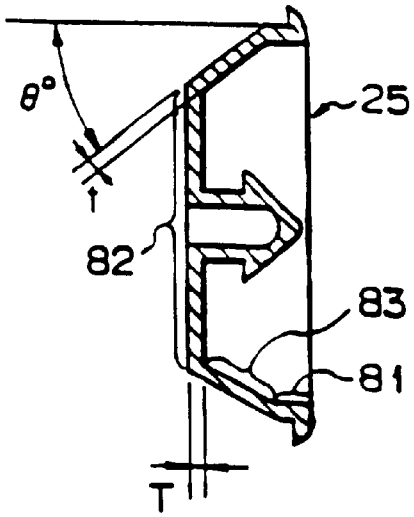
FIG. 19B is a cross-sectional view of the lid 25, shown in FIG. 19A.
Figure 19C:
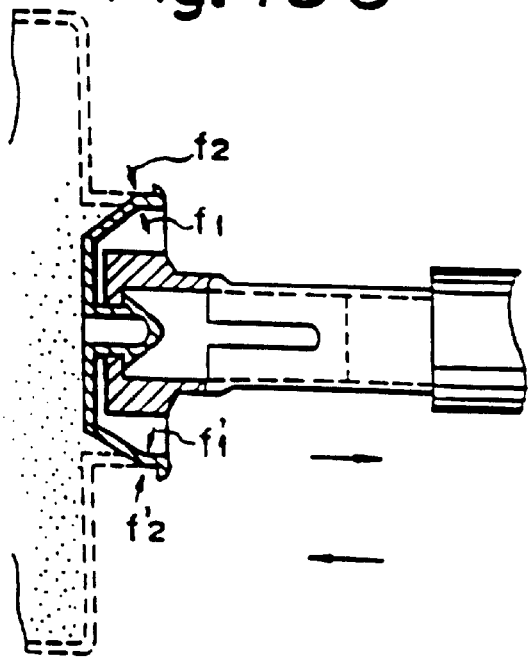
FIG. 19C illustrates forces for acting on the lid 25, when the lid 25 is attached and detached.

Another improved mechanism for reducing the forces necessary for the bottle holder 21 to be pushed and pulled will be described with reference to FIGS. 19A–19D. FIGS. 19A and 19B show a specific configuration of the lid 25 which promotes easy attachment and detachment of the lid 25 to the mouth portion 23 of the toner bottle 20. As shown, the lid 25 has an annular wall portion 81 which contacts the inner periphery of the collar 24, a bottom wall portion 82, and an inclined wall portion 83 connecting the two wall portions 81 and 82. The wall portion 83 is inclined a predetermined angle $\theta$, preferably less than 45 degrees. The bottom wall portion 82 has a diameter smaller than the outside diameter of the annular wall 81.

Preferably, the inclined wall 83 has a thickness t smaller than the thickness T of the bottom wall 82, e.g., one half of the thickness T ($t \approx \frac{1}{2} \cdot T$). As a result, when the collet chuck 30 inserts the lid 25 into the mouth portion 23, the forces $f_1$ and $f_1$ (see FIG. 19C), necessary for the circumferential wall of the lid 25 to press the collar 24, are reduced, compared to a case wherein the thickness t and T are equal. Also, when the collet chuck 30 pulls out the lid 25 from the mouth portion 23, the forces $f_2$ and $f_2$ (see FIG. 19C), exerted by the collar 24 on the circumferential wall of the lid 25, are reduced. This prevents the lid 25 from being inserted in or pulled out from the mouth portion 23 defectively due to the deformation thereof.

If desired, the surface of the bottom wall portion 82 of the lid 25 that contacts the toner may be provided with undulations. Then, although the toner may have aggregated during storage, it can start being discharged easily when the lid 25 is removed. The undulations may be implemented by wavy ribs formed on the above-mentioned surface of the bottom wall portion 82.

Figure 19D:
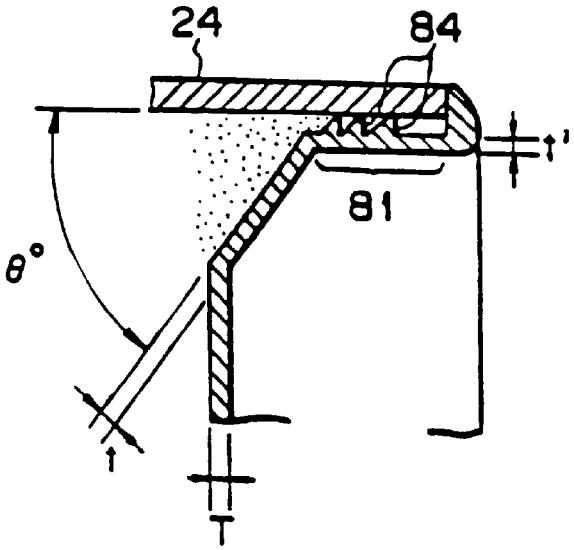
FIG. 19D is a cross-sectional view showing another specific configuration of the lid 25.

Further, as shown in FIG. 19D, the outer surface of the annular wall portion 81 may be provided with a saw-toothed portion 84. When the lid 25 is inserted into the mouth portion 23, the saw-toothed portion 84 will scrape off the toner deposited on the inner periphery of the collar 24 of the bottle 20 and drive it into the bottle 20. As a result, the force, necessary for the lid 25 to be inserted into the collar 24, is maintained constant. This eliminates an occurrence that the force, necessary for the lid 25 to be put into the mouth portion 23, is increased by 1.5 times due to the toner deposited on the inner surface of the collar 24. For example, a collet chuck 30 and lid 25 combination could be selected which reduced, when the mouth portion 23 had a diameter of 39–90 mm, the force for pulling the lid 25 to 950 g at maximum, when the toner was not deposited, and the force for pulling the lid 25 to 1570 g at maximum, even when the toner was deposited. Also, such a combination reduced the force necessary for the lid 25 to be inserted to 1370 g at maximum, when the toner was not deposited, and to 1770 g at maximum, when the toner was deposited.

Referring to FIGS. 20A–24G, 21A–21D, 22A–22D, 23A–23D, and 24A–24C, a specific configuration of a part of the bottle 20 adjacent to the mouth portion 23 will be described which allows the toner to be discharged in a desirable manner. In the figures, the bottle ribs 57, to receive a rotating force from the ring, are not shown (see FIGS. 34A and 34B).

Figure 21A:
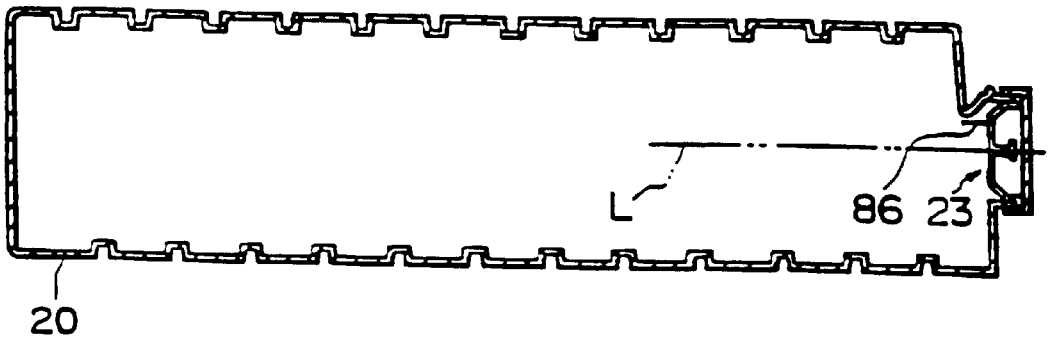
FIG. 21A is a cross-sectional view taken along line 21A—21A of FIG. 20A.

Briefly, the bottle 20 shown in the figures is configured such that when the bottle 20 is set on the bottle holder 21 in a substantially horizontal position with the mouth portion 23 oriented sideways, the toner existing in the lower portion of the cylindrical body of the bottle 20 is raised to the mouth portion 23 by the rotation of the bottle 20 and then, discharged via the mouth portion 23. As a result, the toner is desirably driven out of the bottle 20 via the mouth portion 23, which has a smaller diameter than the cylindrical body of the bottle 20. Specifically, the end or shoulder of the bottle 20, where the mouth portion 23 is provided, has the inner periphery thereof partly raised to the edge of the mouth portion 23 to thereby form a raised portion 85, indicated by hatching. The raised portion 85 moves the toner upwardly, when the bottle 20 is in rotation, as will be described specifically later. As shown in FIG. 21A, since the end wall and circumferential wall of the bottle 20 have substantially the same thickness, the internal configuration of the bottle 20 directly appears on the outer periphery also. For this reason, in the other figures (e.g. FIG. 20E), the reference numerals attached to the inner periphery of the bottle 20 are also used to designate the corresponding portions of the outer periphery.

Figure 20A:
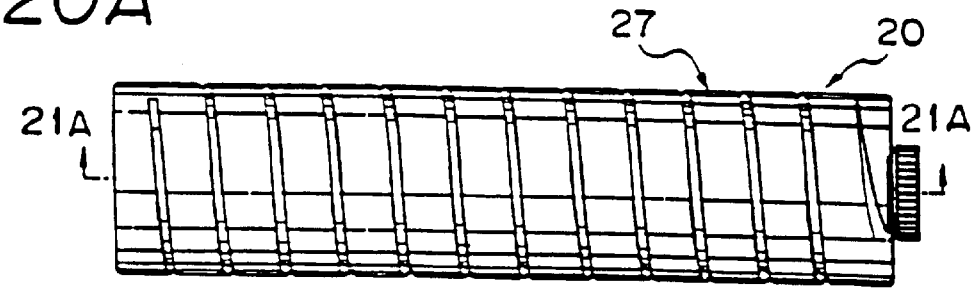
FIG. 20A is a front view of the toner bottle 20 to which a cap 29 is attached.
Figure 20B:
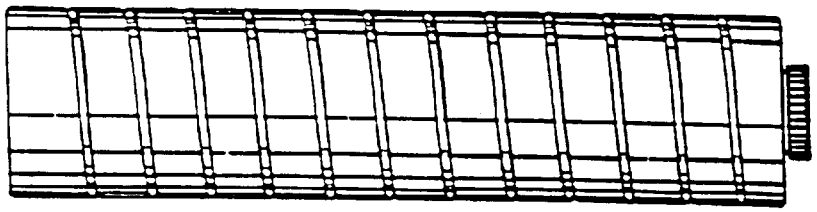
FIGS. 20B–20D, 20E, and 20F are front, top plan, and bottom views, respectively, showing the toner bottle 20 of FIG. 20A.
Figure 20C:
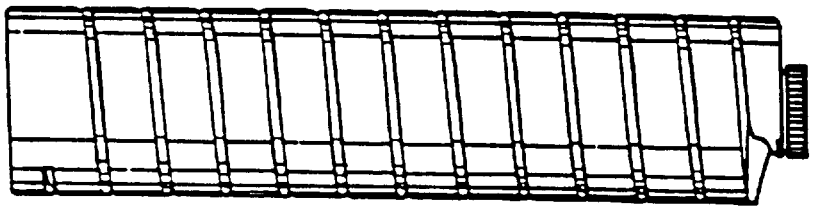
Figure 20D:
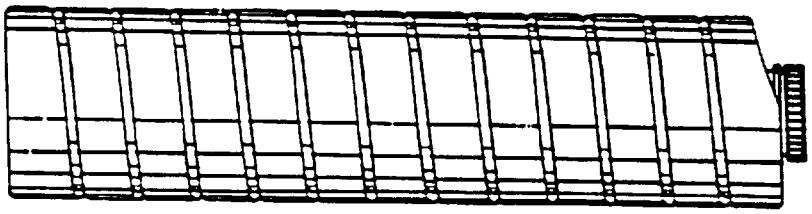
Figure 20E:
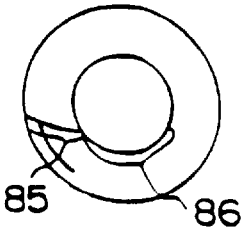
Figure 20F:
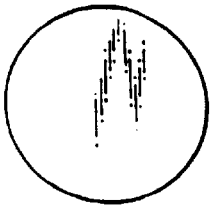
Figure 20G:
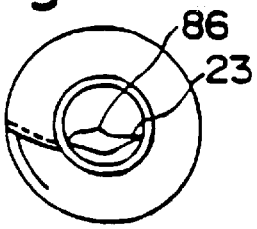
FIG. 20G is a top plan view of the toner bottle 20 from which the cap 29 is removed.
Figure 21B:
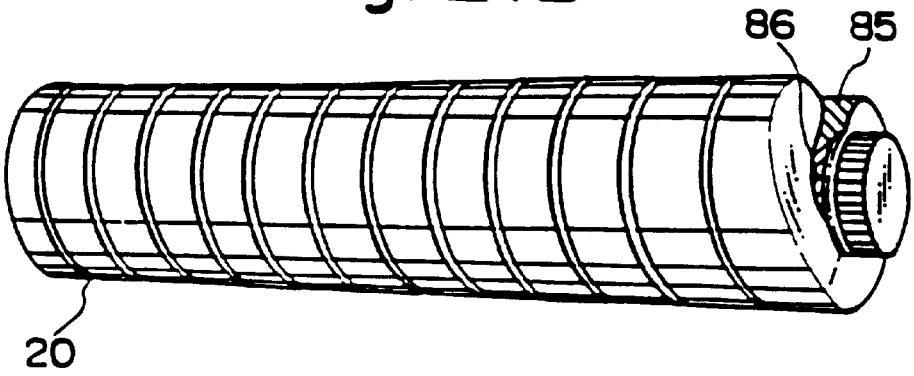
FIG. 21B is a perspective view of the toner bottle 20.
Figure 21C:
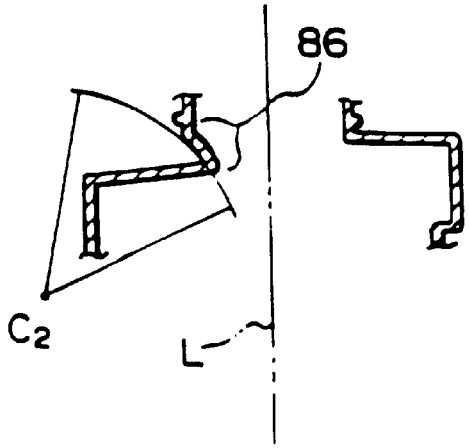
FIG. 21C is an enlarged cross-sectional view of a part of the toner bottle 20, shown in FIG. 21A.

Further, the bottle 20 has another raised portion 86 contiguous with the raised portion 85 in the circumferential direction, as indicated by hatching different in direction from the hatching indicative of the portion 86 in FIG. 21B. Specifically, as shown in FIG. 21A, the inner peripheral portion of the circumferential wall contiguous with the raised portion 85 in the circumferential direction is raised toward the axis or center line of rotation L of the bottle 20 over the edge of the mouth portion 23. As shown in FIG. 20G, when the bottle 20 is seen from the outside in the axial direction, i.e., along the center line L, with the cap and lid thereof removed, the raised portion 86 appears in the mouth portion 23.

Figure 21D:
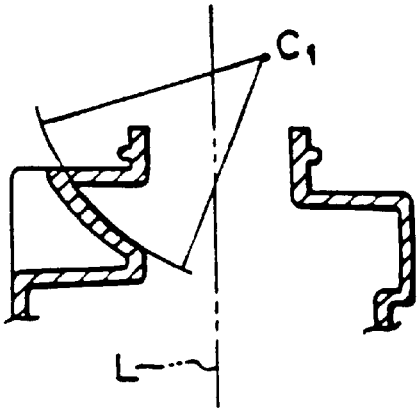
FIG. 21D is a cross-sectional view taken along line 21D—21D of FIG. 23C.

Preferably, the contiguous raised portions 85 and 86 should be provided with a ramp surface configuration which protrudes more toward the axis or centerline L as the distance thereof from the mouth portion 23 increases. Further, as shown in FIG. 21D, it is preferable that the raised portions 85 and 86 be provided with concavity which at least partly appears, in a section containing the axis or centerline L, as a curve whose center of curvature $C_1$ is close to the axis or centerline L. FIG. 21D is a cross-section along line 21D—21D of FIG. 23C and representative of the raised portion 85. FIG. 21 is a fragmentary enlarged view of FIG. 21A and a cross-section along line 21A—21A of FIG. 23C. As shown in FIG. 21D, the raised portion 86 should preferably have the end portion thereof provided with convexity appearing, in the section containing the axis or centerline L, as a curve whose center of curvature $C_2$ is remote from the axis or centerline L. The curve with the center of curvature $C_2$ allows the toner to be forced out to the collar 24 smoothly. Moreover, it is preferable that the raised portions 85 be contiguous with the spiral guide groove 27. Then, the toner guided along the spiral guide groove 27, which has a constant width, to the vicinity of the mouth portion 23, will be continuously raised to the edge of the mouth portion 23 and then guided to the raised portion 86.

Figure 24B:
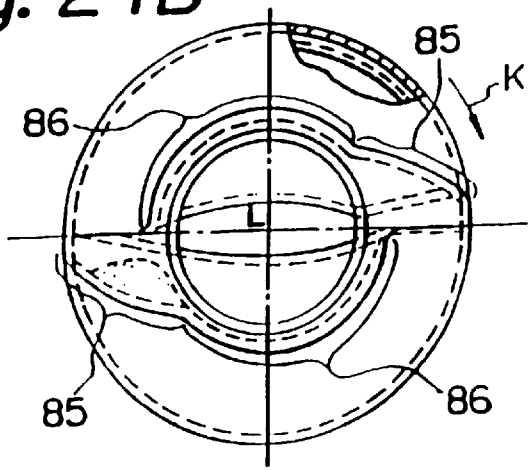
FIGS. 24A–24C are partial cross-sectional, top plan, and front views, respectively, showing a modified form of the toner bottle 20.
Figure 24A:
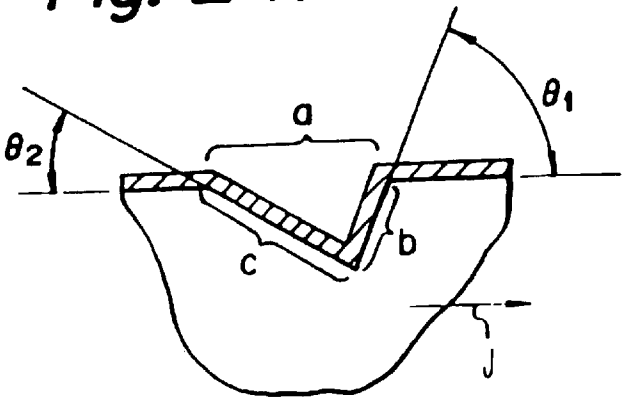

FIG. 24A shows a preferred configuration of a wall a forming the spiral guide groove 27 of the bottle 20. As shown, the wall a includes a portion b for driving the toner in the guiding direction indicated by an arrow J (i.e. toward the mouth portion 23). The portion b protrudes toward the axis of the bottle 20 at an angle $\theta_1$ substantially perpendicular to the flat inner periphery of the bottle 20, e.g., 80 degrees to 90 degrees. The other portion c of the wall a, which the toner being conveyed gets over, protrudes toward the axis of the bottle 20 at a small angle $\theta_2$, e.g., less than 80 degrees, preferably 10 degrees to 30 degrees, and in the guiding direction J. The wall a with such a configuration causes the toner to fall from the inner periphery thereof easily, while the bottle 21 is in rotation, thereby allowing a minimum of toner to remain in the bottle 20.

Figure 22C:
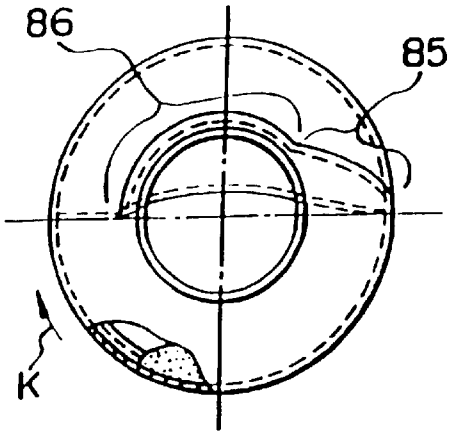
FIG. 22C is a side elevational view of the toner bottle 20, shown in FIG. 22A, as seen from the right.
Figure 22D:
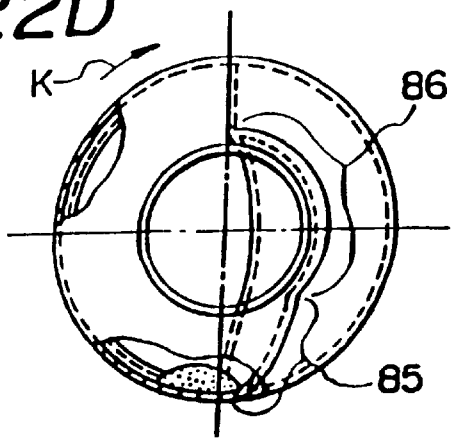
FIG. 22D is a side elevational view of the toner bottle 20, shown in FIG. 22B, as seen from the right.

How the raised portions 85 and 86 guide the toner will be described with reference to FIGS. 22A–22D and 23A–23D. FIGS. 22C and 23C are side elevations, as viewed from the right, of the bottle 20 shown in front views in FIGS. 22A and 23A. FIGS. 22D and 23D are side elevations, as viewed from the right, of the bottle 20 shown in front views in FIGS. 22B and 23B. It is to be noted that FIGS. 22B and 23B show the bottle 20 in a position rotated 90 degrees from the position shown in FIGS. 22A and 23A. The arrow K is indicative of the direction in which the bottle 20 is rotated by the toner supply unit 17.

Figure 22A:
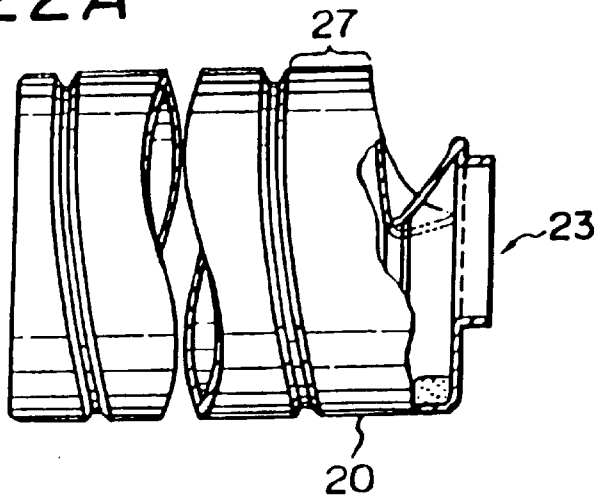
FIG. 22A is a front view demonstrating how the toner bottle 20 guides a toner via raised portions (85 and 86 shown in FIGS. 22C and 22D)
Figure 22B:
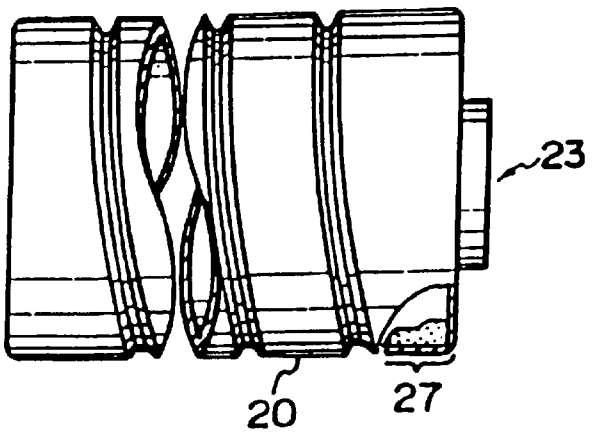
FIG. 22B is a front view of the toner bottle 20 rotated 90 degrees from the position of FIG. 22A.
Figure 23C:
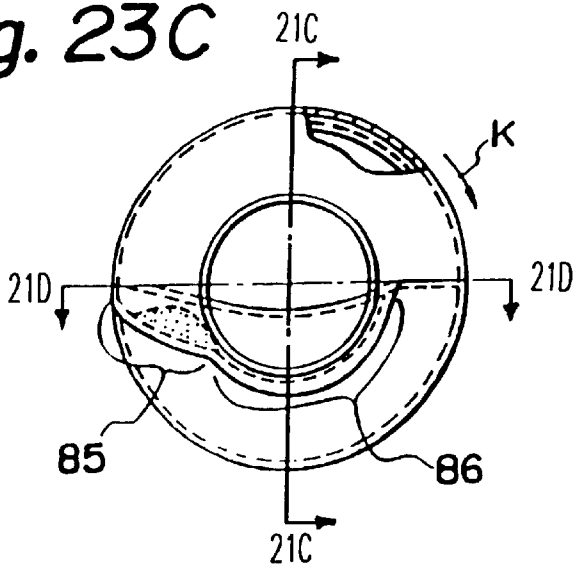
FIG. 23C is a side elevational view of the toner bottle 20, shown in FIG. 23A, as seen from the right.
Figure 23D:
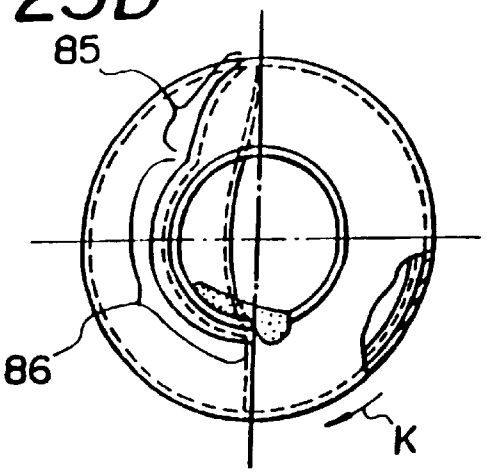
FIG. 23D is a side elevational view of the toner bottle 20, shown in FIG. 23B, as seen from the right.
Figure 23A:
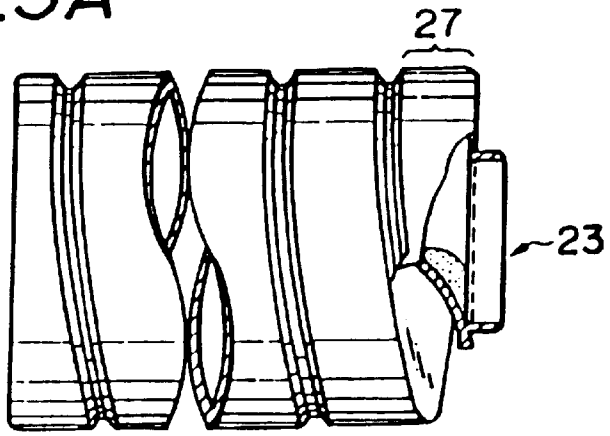
FIG. 23A is a front view of the toner bottle 20 rotated 90 degrees from the position shown in FIG. 23B.
Figure 23B:
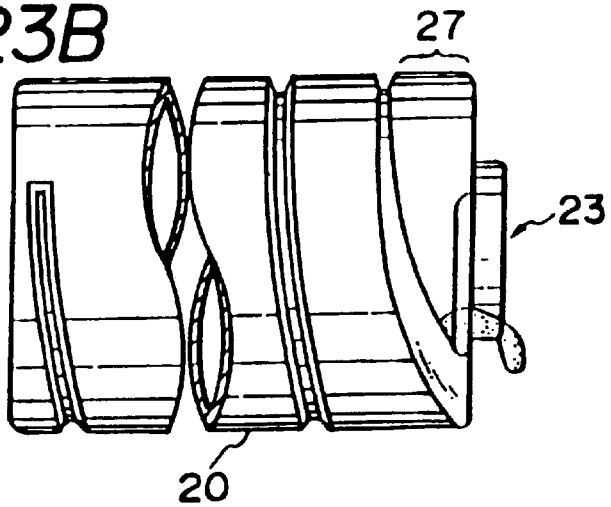
FIG. 23B is a front view of the toner bottle 20 rotated 90 degrees from the position shown in FIG. 23A.

In the condition shown in FIGS. 22A and 22C, the maximum diameter portion of the shoulder is located at the bottom in the vertical direction. Hence, the spiral guide groove 27 guides the toner to the bottom of the maximum diameter portion of the head portion of the bottle 20. As shown in FIGS. 22B and 22D, when the bottle 20 is rotated 90 degrees in the direction K, the boundary between the maximum diameter portion of the shoulder and the raised portion 85 is positioned at the bottom in the vertical direction. The toner from the spiral guide groove 27 partly rides on the raised portion 85. As shown in FIGS. 23A and 23C, while the bottle 20 is further rotated 90 degrees in the direction K toward the position of FIGS. 23A and 23C, the raised portion 85 raises the toner to the edge of the mouth portion 23 as if it were a spoon. When the bottle 20 is further rotated 90 degrees in the direction K to around the position of FIGS. 23B and 23D, the toner is partly transferred from the raised portion 85 to the inclined raised portion 86. As a result, the toner is guided by the raised portion 86 toward the outside of the bottle 20 in the direction M and then, is discharged via the mouth portion 23.

As best shown in FIG. 23C, the raised portion 85 itself is provided with a spoon-like concave configuration. When the bottle 20 has such a configuration adjacent to the mouth portion 23, the toner powder is prevented from dropping from the mouth portion 23 in masses and raising a cloud in the hopper 16. That is, the toner powder is discharged little by little from the bottle 20 in a loose state. Moreover, hardly any of the toner is left in the bottle 20. In addition, while the bottle 20 is in rotation, only a so-to-speak spoonful of toner is scooped up to the mouth portion 23. As a result, a constant amount of toner is discharged from the mouth portion 23 at all times.

As shown in FIG. 24B, two pairs of raised portions 85 and 86 may be formed on the inner periphery of the shoulder of the bottle 20. In this case, the toner will be discharged in a quantity twice as great as the quantity available with a single pair of raised portions 85 and 86 for the same quantity of rotation of the bottle 20.

Figure 24C:
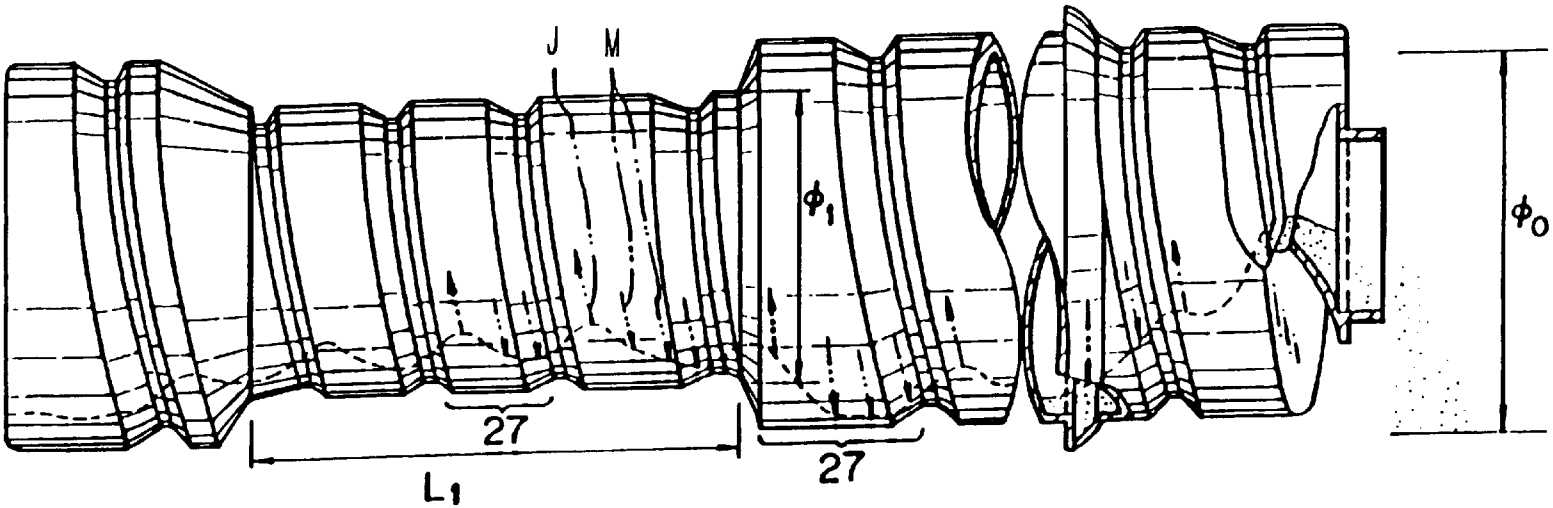

Further, as shown in FIG. 24C, the outer periphery of the bottle 20 may additionally include a grip portion $L_1$ having a diameter $\Phi_1$ smaller than the diameter $\Phi_0$ (greater than 100 mm) of the other portion. The outside diameter $\Phi_1$ of the grip portion $L_1$ should advantageously be 80 mm to 100 mm and the length should advantageously be 80 mm to 100 mm. In FIG. 24C, the wall a, forming the spiral guide groove 27, has the same inner peripheral configuration as the configuration shown in FIG. 24A. In FIG. 24C, the arrow N is indicative of the toner being entrained upwardly, by the inner periphery of the bottle 20, due to the rotation of the bottle 21, while the arrow P is indicative of the toner falling therealong.

Figure 25:
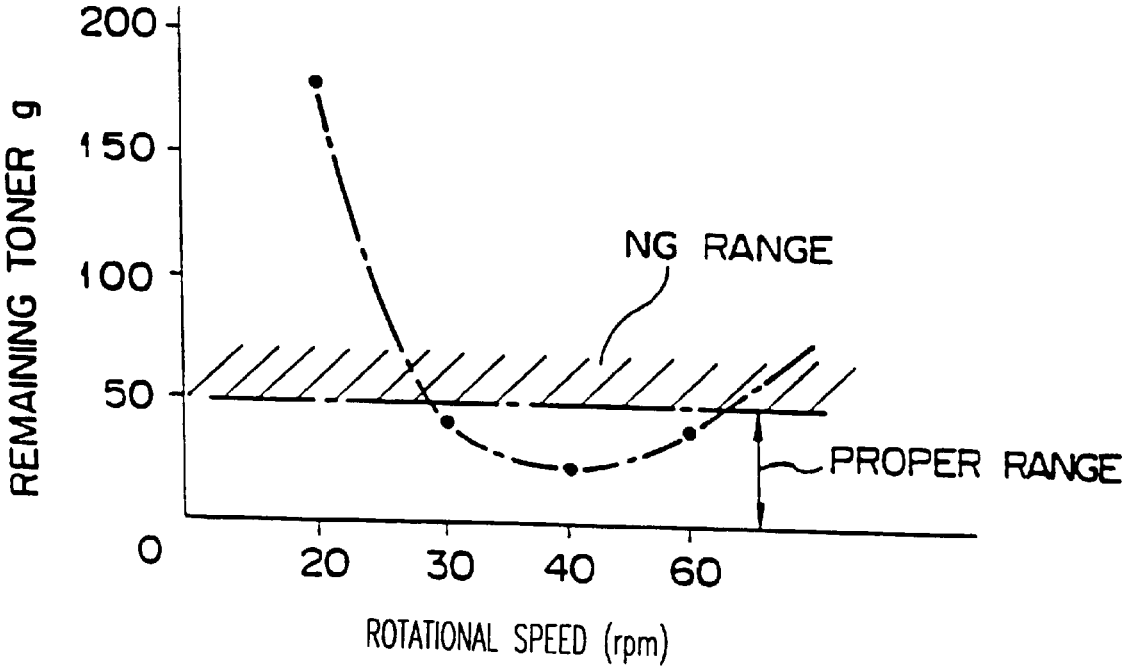
FIG. 25 is a graph indicative of a relationship between the rotational speed of the toner bottle 20 and the quantity of toner left in the toner bottle 20, without being discharged.

FIG. 25 is a graph indicative of a relationship between the rotational speed (number of rotations per minute) of the bottle 20 during toner supply and the amount of toner left in the bottle 20, without being discharged. As shown, the amount of toner left in the bottle 20 depends on the rotational speed. For example, assuming that the allowable amount of toner to remain in the bottle 20 is up to 50 g, it is preferable to rotate the bottle 20 thirty rotations to forty rotations for a minute. Of course, the adequate rotational speed of the bottle 20 for reducing the amount of remaining toner is determined by, for example, the diameter of the mouth portion 23 and the configuration of the raised portions 85 and 86. In practice, therefore, the adequate rotational speed is determined by experiments beforehand, and the bottle 20 is rotated at such a speed.

Figure 26A:
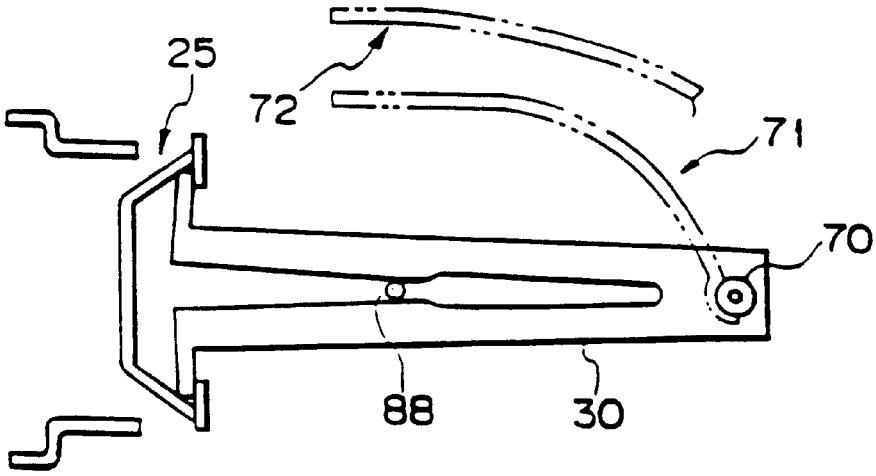
FIGS. 26A and 26B are cross-sectional views demonstrating a particular operation available with a modified collet chuck 30.
Figure 26B:
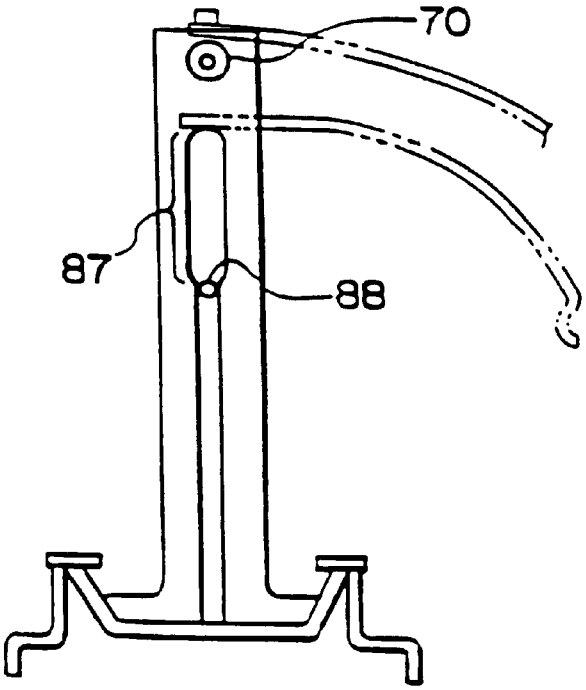

In the illustrative embodiment, the toner supply unit 17 is constructed such that the collet chuck 30 retains the lug 26 of the lid 25, when the tip thereof is squeezed. Alternatively, as shown in FIG. 26A, the collet chuck 30 may cause the tip thereof to abut the inner periphery of the annular wall of the lid 25 and retain the lid 25, when opened. FIG. 26B shows a condition wherein the tip of such a collet chuck 30 has been squeezed to release the lid 25. In the collet chuck 30 shown in FIGS. 26A and 26B, the slit has a rear portion 87 which is broader than the front or tip portion. A pin 88 is studded in a predetermined position of, for example, the stop cover 48. When the collet chuck 30 is moved relative to the pin 88, such that the pin 88 enters the narrower tip portion of the slit, the slit, i.e., the tip portion thereof is opened. When the collet chuck 30 is moved such that the pin 88 enters the rear portion 87 of the slip, the tip of the collet chuck 30 does not contact the lid 25. FIGS. 26A and 26B show a position matching position B of the bottle holder 21 and a position matching position A of the bottle holder 21, respectively.

Referring to FIGS. 27–30, a modified form of the toner supply unit 17 will be described. In the figures, the same or similar constituents as or to the constituents of the previous configuration are designated by the same reference numerals.

In the modification, the toner supply unit 17 is also rotatable substantially 90 degrees between positions A and B in a substantially horizontal plane about the axis or center of rotation Z. To rotatably support the bottle holder 21 about the axis or center of rotation Z, the mechanism described previously may also be used. Again, the toner supply unit 17 has the locking mechanism for positioning the bottle 20 on the bottle holder 21, a motor 37 for rotating the bottle 20, a gear link 38 for transmitting the rotation of the motor 37 to the bottle 20, a collet chuck 30 for retaining the lid 25 of the bottle 20, a core 39 slidably mounted on the collet chuck 30, and a cam device for moving the collet chuck 30 back and forth.

Figure 27:
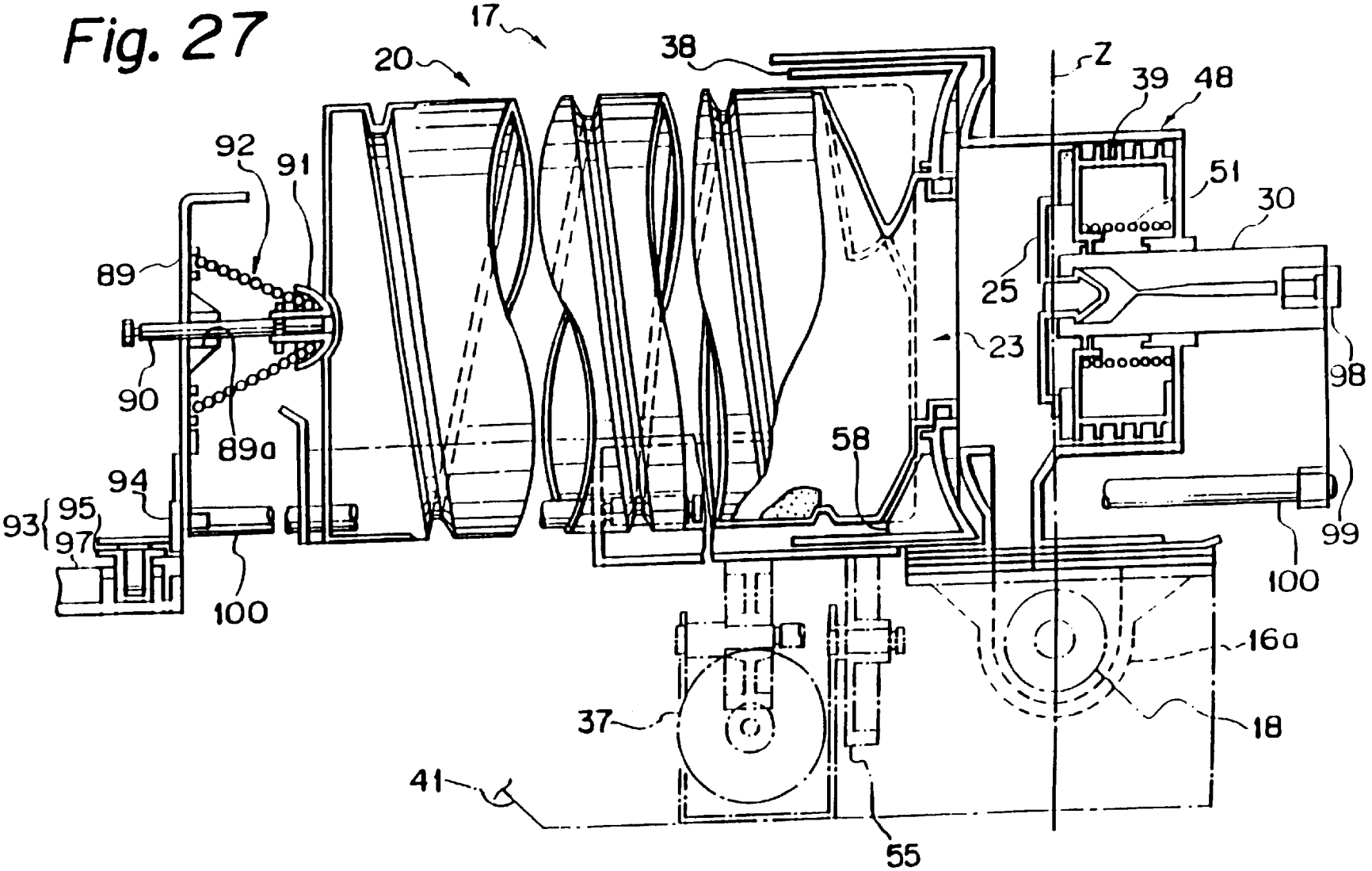
FIG. 27 is a front view of another specific arrangement of the toner supply unit 17 held in a toner replenishing position.
Figure 28:
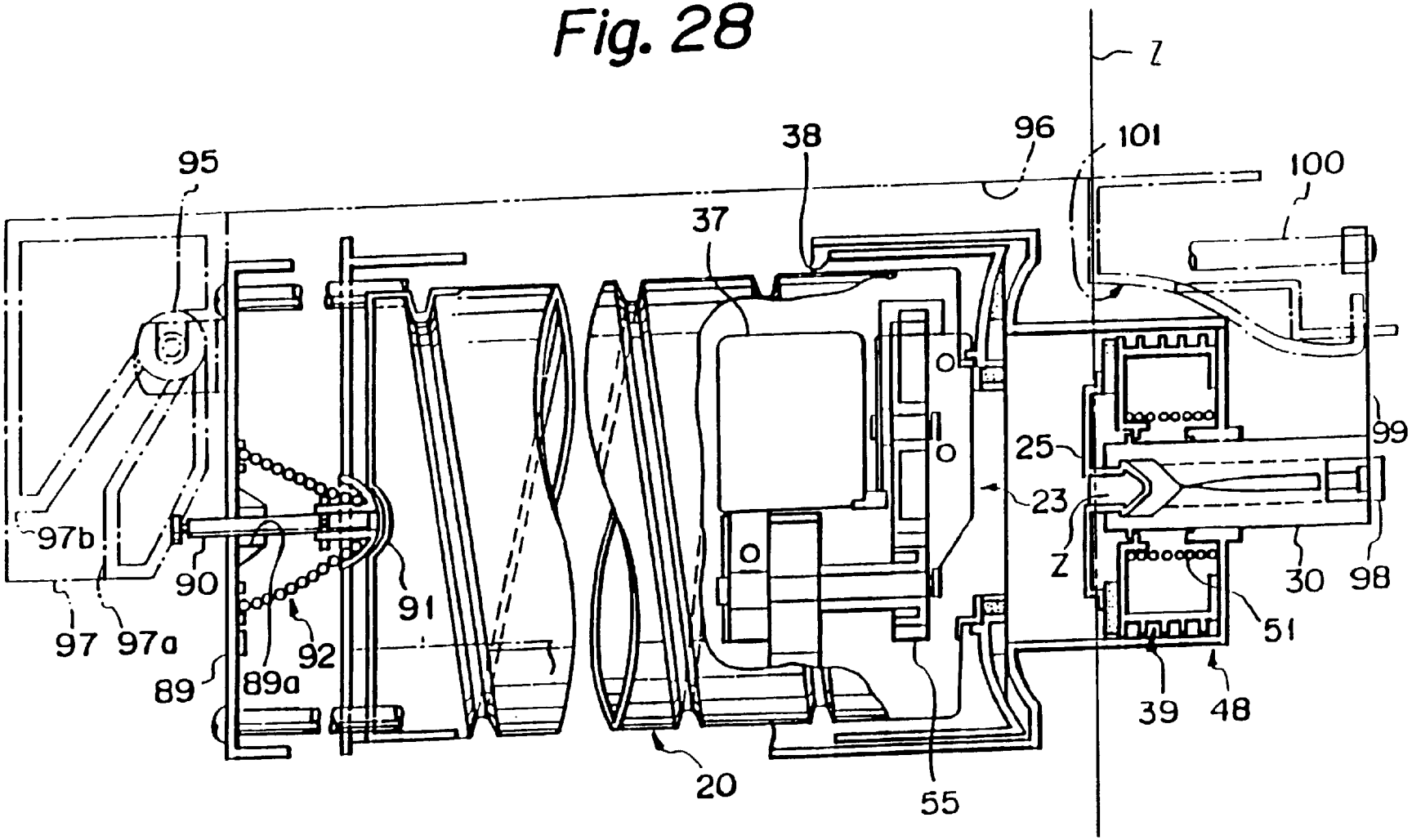
FIG. 28 is a plan view of the toner supply unit 17, shown in FIG. 27.

The modification differs from the previous embodiment, as follows. To begin with, in the previous embodiment, the cam device for moving the collet chuck 30 back and forth is located adjacent to the axis or center of rotation Z of the bottle holder 21. By contrast, in the modification, the cam device is located at a position comparatively remote from the axis or center of rotation Z in the longitudinal direction of the bottle holder 21. Specifically, as shown in FIGS. 27 and 28, the cam device, generally 93, has a cam member 97 affixed to the portion of a copier front wall 96 that will face the end of the bottle holder 21 remote from the axis or center of rotation Z, when the holder 21 is held in position B (referred to as movable end hereinafter). In addition, the cam device 93 has a roller 95 mounted on the movable end of the bottle holder 21 and provided with a flange. Specifically, the roller 95 is rotatably mounted on a plate 94 which is in turn affixed to a bracket 89. The bracket 89 is affixed to the bottle holder 21 or the movable bracket 41 in the vicinity of the rear end of the bottle 20 (opposite to the end where the mouth portion 23 is positioned) in such a manner as to be movable toward and away from the Tear end of the bottle 20. The bracket 89 and an arm member 99 fastened to the rear end of the collet chuck 30 by a screw 98 are connected together by a shaft 100 extending in the lengthwise direction of the bottle holder 21.

Figure 29A:
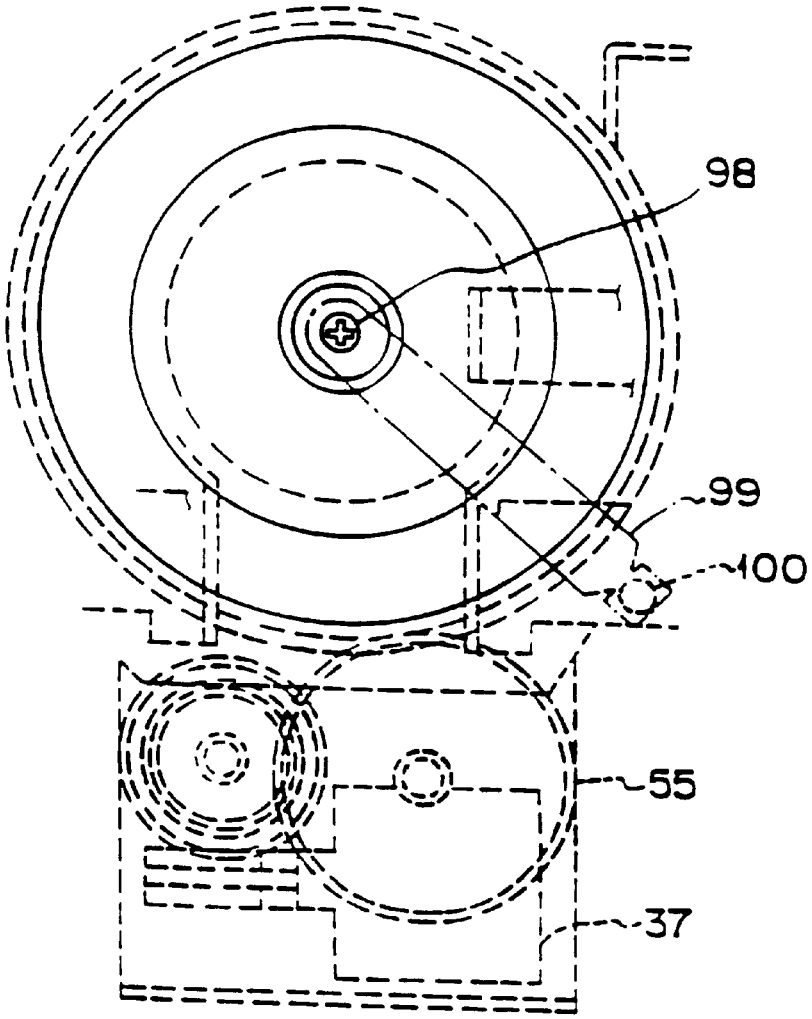
FIG. 29A is a side elevational view of the toner supply unit 17, shown in FIG. 27, as seen from the right.
Figure 29B:
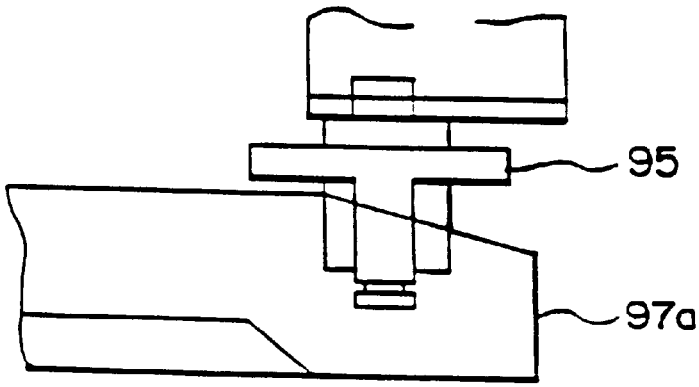
FIG. 29B is a partial cross-sectional view of a roller 95 and fence member 97*a*, as seen in a direction M, shown in FIG. 28.

The cam member 97 is made up of a pair of fence members 97*a* and 97*b* facing each other. The fence members 97*a* and 97*b* guide the roller 95 from the side and support the flange of the roller 95 from below the roller 95. The fence members 97*a* and 97*b* are configured such that the distance from the axis or center of rotation Z decreases with the decrease in the distance to the front wall 96. As shown in FIG. 29B, the front end portion of the fence member 97*a* is inclined downwardly toward the front end such that the roller 95 can start contacting it smoothly just before the bottle holder 21 is fully moved from position A to position B.

The bracket 89 has a boss 89*a* on the vertical wall thereof. A rod 90 is slidably received in a hole surrounded by the boss 89*a* of the bracket 89. An abutment 91 is affixed to the rod 90 and is capable of abutting the rear end of the bottle 20. A spring is loaded between the vertical wall of the bracket 89 and the abutment 91 and constantly biases them away from each other.

In operation, when the bottle holder 21 is held in position B, the roller 95 with the flange is held in a position closest to the base end of the bottle holder 21 by the cam member 97, as shown in FIGS. 27 and 28. The collet chuck 30, connected to the roller 95 by the shaft 100, is also located at a position closest to the base end of the bottle holder 21. In this condition, the collet chuck 30 retains the lid 25 at a position remote from the mouth portion 23 of the bottle 20, thereby preventing the toner from being discharged from the mouth portion 23. The bottle 20 has the rear end thereof urged, by the abutment 91 and spring 92, toward the base end of the bottle holder 21. The end of the bottle 20, having the mouth portion 23, abuts the end of the stop cover 48. Therefore, the bottle 20 is positioned in the longitudinal direction of the bottle holder 21. In this sense, the abutnent 91, as well as the members associated therewith, constitute a mechanism for positioning the bottle 20 on the bottle holder 21.

When the bottle holder 21 is moved from position B to position A, the roller 95 is guided by the cam member 97 toward the movable end of the bottle holder 21. At the same time, the collet chuck 30 is moved toward the mouth portion 23 of the bottle 20. While the roller 95 is being guided by the cam member 97, the lid 25, held by the collet chuck 30, is fully inserted into the mouth portion 23, when the distance between the bracket 89 and the stop cover 48 is shorter than the sum of the length of the bottle 20 and the unstressed length of the spring 92, and when the abutment 91 is positioning the bottle 20. If desired, to generate a sufficient force for inserting the lid 25, a cam member (not shown) may be provided. The rear end of the rod 90 abuts the cam member (not shown), when the bottle holder 21 is moved from position B to position A. Then, the rod 90, as compared to the bracket 89, will be continuously urged toward the collet chuck 30 and cause the rear end of the bottle 20 to abut the abutment 91 of the rod 90.

Figure 30:
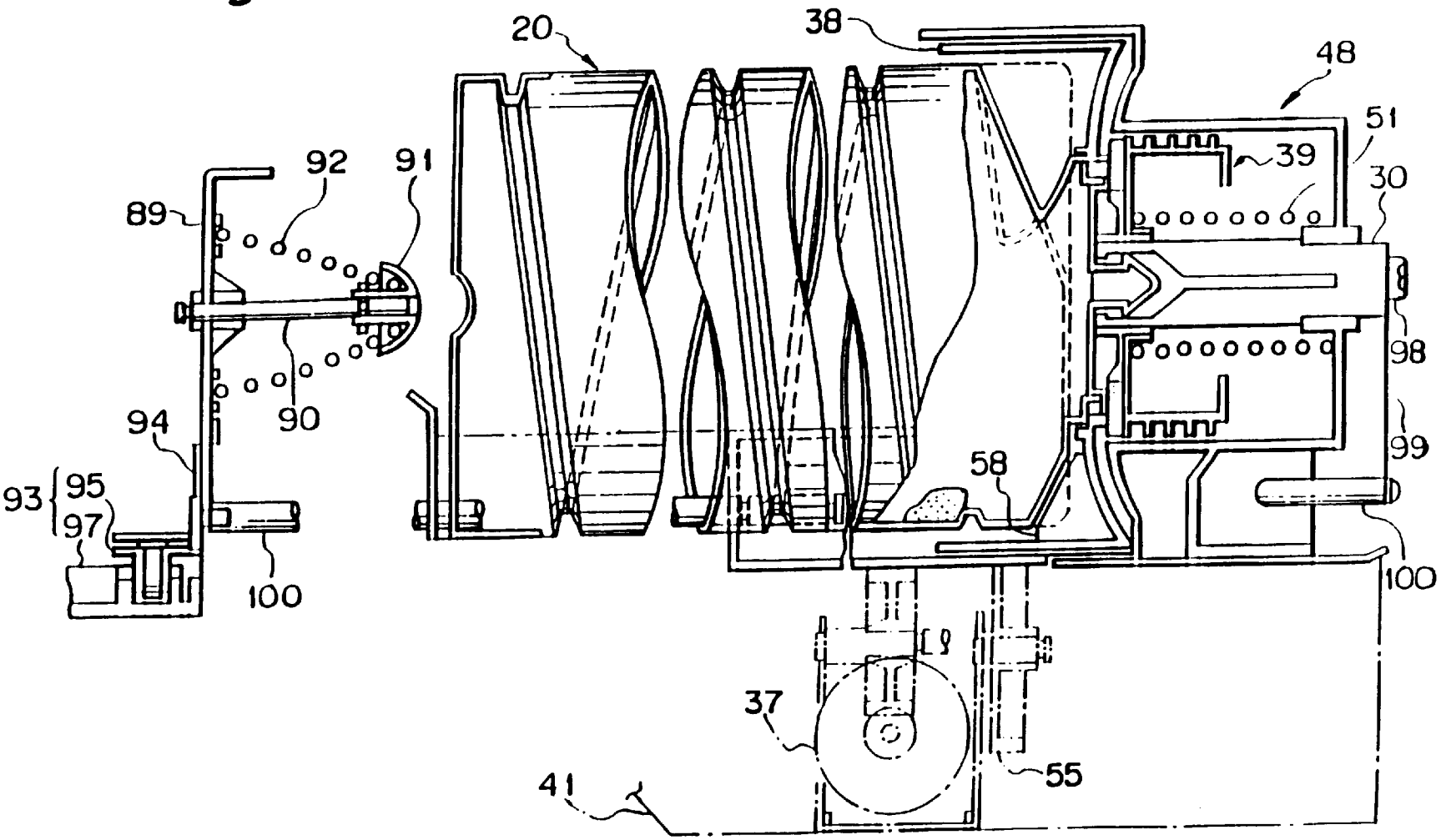
FIG. 30 is a front view of the toner supply unit 17 held in a position for mounting a toner bottle 20.

As the bottle holder 21 is further moved toward position A, the roller 95 is released from the cam member 97. FIG. 30 shows a condition wherein the bottle holder 21 has arrived at position A. In this condition, the mouth portion 23 of the bottle 20 has been fully sealed by the lid 25, the chucking portion of the collet chuck 30 has been opened wide enough to release the lug 26 of the lid 25, and the abutment 91 has been moved away from the rear end of the bottle 20.

Assuming that the collet chuck 30 has been accidentally retracted toward the base end of the bottle holder 21 after the roller 95 had been released from the cam member 97, the larger diameter portion 63 of the collet chuck 30 (see FIG. 31A) will be engaged with and squeezed by the core 39, which is stopped by the stop cover 48, thereby chucking the lug 26 of the lid 25. This obstructs the removal of the bottle 20 and the insertion of a new bottle 20. In light of this, as shown in FIG. 28, a cam member 101 is additionally located adjacent to the axis or center of rotation Z and is provided with a particular cam surface. Specifically, while the roller 95 and cam member 97 are released from each other, the cam surface of the cam member 101 restricts the rear end of the collet chuck 30, such that the collet chuck 30 does not retract toward the base end of the bottle holder 21. The cam member 101 may also implement the relative position of the collet chuck 30 and core 39 for opening the chucking portion 33 thereof, if desired.

When the bottle holder 21 is moved from position A to position B, the roller 95 is brought into contact with the cam member 97. Subsequently, the bracket 89 and collet chuck 30 are each moved toward the base end of the bottle holder 21. As a result, the bottle 20 is positioned on the bottle holder 21, while the lid 25 is removed from the bottle 20. The resulting condition is shown in FIGS. 27 and 28.

Another difference between the previously described toner supply unit 17 and the toner supply unit 17 described above is as follows. The previous toner supply unit 17 maintains the chucking portion 33 of the collet chuck 30 sufficiently open by setting up a condition which prevents an external force, tending to squeeze the chucking portion 33, from acting. By contrast, the toner supply unit 17 described above applies an external force tending to open the chucking portion 33 of the collet chuck 30 positively.

Figure 31A:
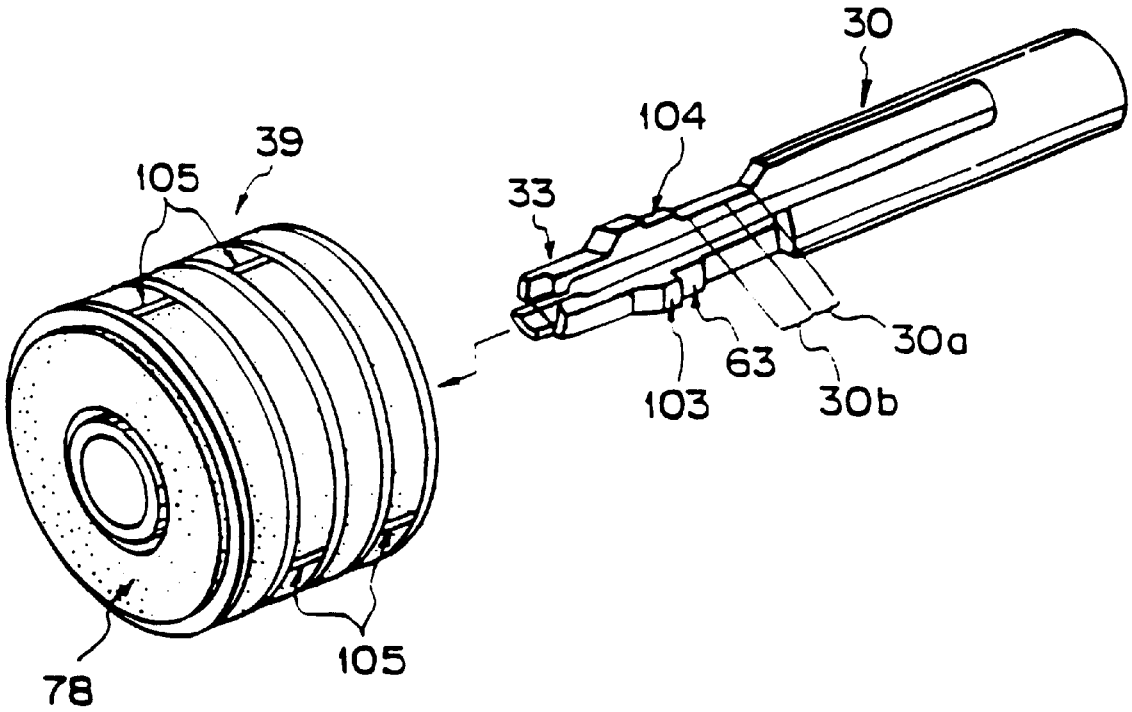
FIG. 31A is an exploded perspective view of a collet chuck 30 and a core 39 included in the toner supply unit 17 of FIG. 27.
Figure 31B:
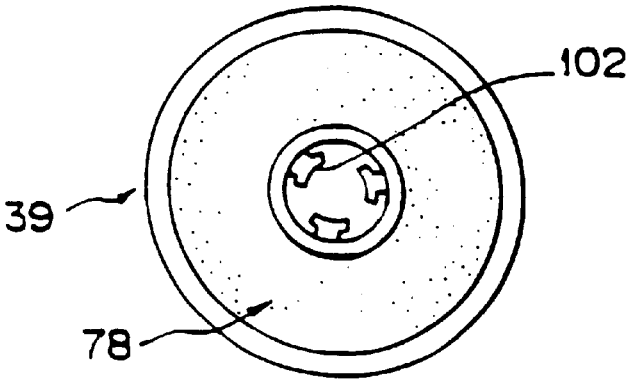
FIG. 31B is a front view of the core 39.

Specifically, as shown in FIG. 31A, the collet chuck 30 has a slit portion 30*a* positioned at the rear of a slit portion 30*b*, which is contiguous with the portion 30*a* and which has a greater width than the portion 30*a*. The collet chuck 30 is slidable in the bore formed in the core 39. As shown in FIG. 31B, the inner periphery of the core 39 is formed with projections 102, which are received in the individual (three in this case) slits of the collet chuck 30. Further, the collet chuck 30 has a portion 103, even larger in diameter than the larger diameter portion 63, and a substantially vertical abutment or shoulder 104 between the portion 103 and the larger diameter portion 63.

The core 39, shown in FIG. 31A, is substantially identical with the core 39 of FIG. 14A, except for the projections 102. In FIG. 31A, the reference numeral 105 designates the opposite ends of each seal member which abut each other.

Figure 32A:
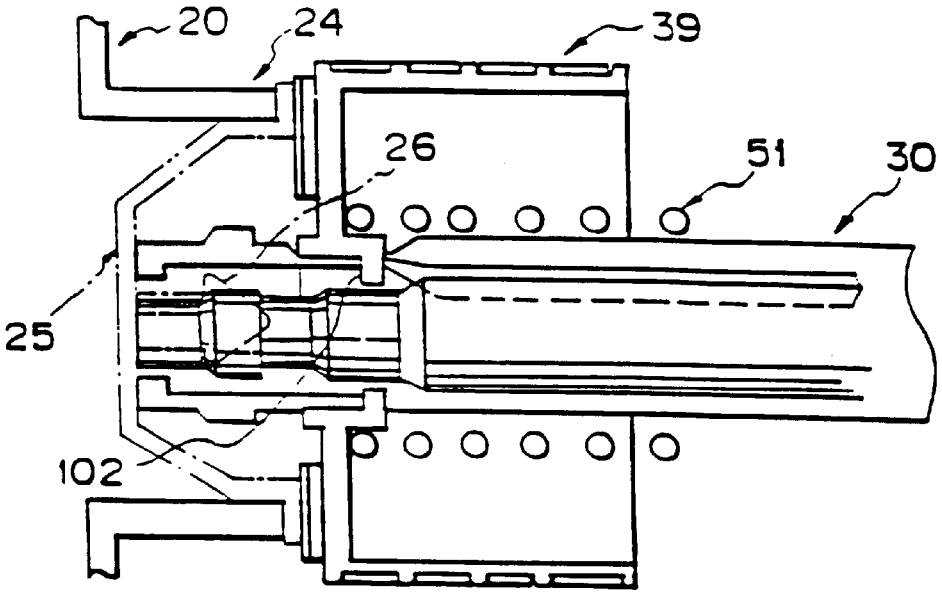
FIGS. 32A and 32B are cross-sectional views demonstrating a specific operation of the collet chuck 30, shown in FIG. 31A.
Figure 32B:
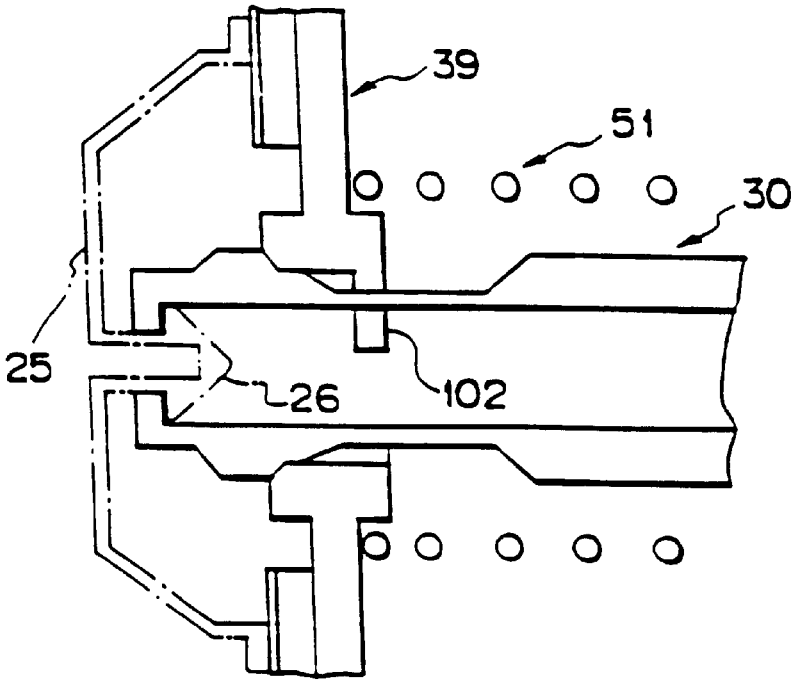

FIGS. 32A and 32B are views representative of a relationship between the collet chuck 30, the core 39, and the position of the chucking portion 33. Specifically, FIG. 32A shows a condition wherein the core 39 abuts and is stopped by the stop cover 48 (not shown) when, for example, the bottle holder 21 is held in position A. In this condition, the projections 102 of the core 39 are positioned in the individual narrow slit portions 30*a*, opening the chucking portion 33 positively by wedging them. On the other hand, FIG. 32B shows a condition wherein the collet chuck 33 is retracted a certain distance due to the contact of the roller 95 and cam member 97, when, for example, the bottle holder 21 is brought from position A to position B. In this condition, the boss 50 of the core 39, biased by the spring 51, is stopped by the shoulder 104 of the collet chuck 30, thereby squeezing the chucking portion 33.

Figure 33:
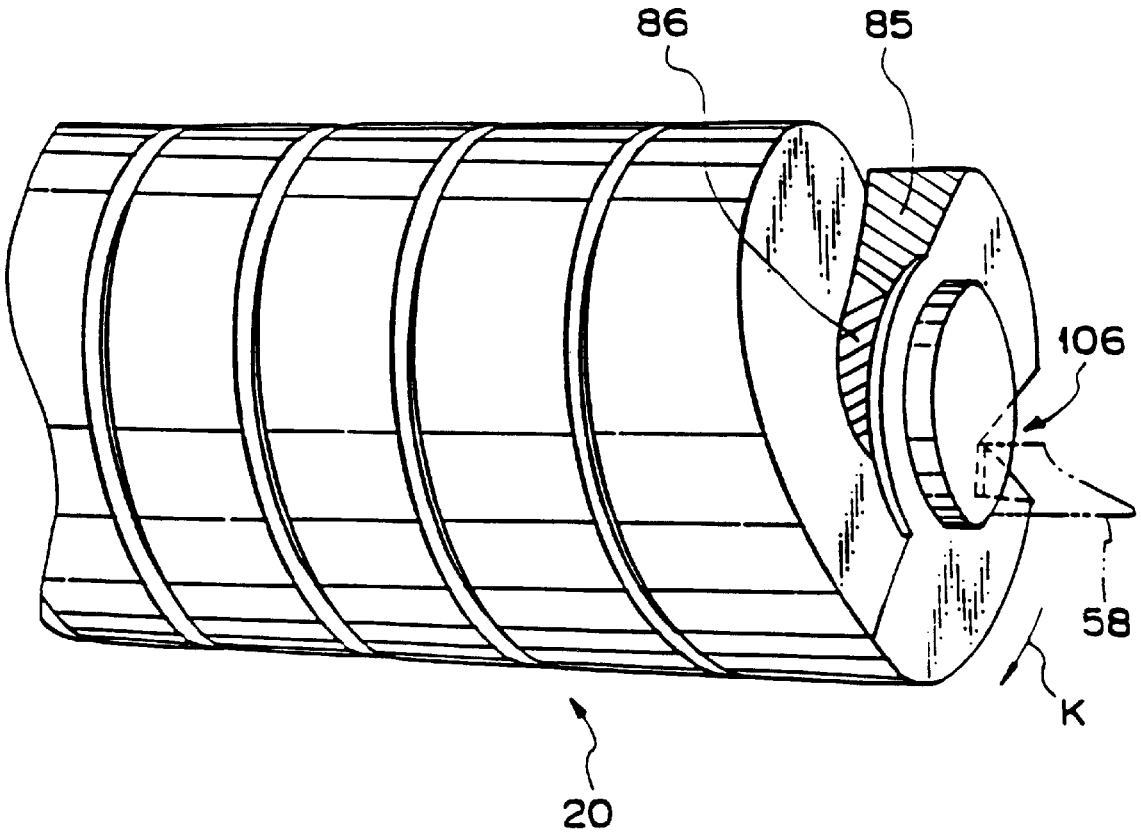
FIG. 33 is a partial perspective view of a toner bottle 20 for use with the toner supply unit 17 of FIG. 27.

Furthermore, the previous toner supply unit 17 transmits the rotation of the gear link 38 to the bottle 20 by forming the bottle ribs 57 on the end of the bottle 20 having the mouth portion 23 and forming the link ribs 58 on the end of the gear link 38. On the other hand, as shown in FIG. 33, the modified toner supply unit 17 provides the bottles 20 with a recess 106 in place of the bottle rib 57 and causes the link rib 58 to mate with the recess 58. However, a transmission mechanism, similar to the mechanism of the previous embodiment, may also be used, as shown in FIG. 34A–34D. FIG. 34D shows the inner peripheral configuration of the gear link 38, as viewed in the direction indicated by an arrow Q in FIG. 34C.

Figure 34B:
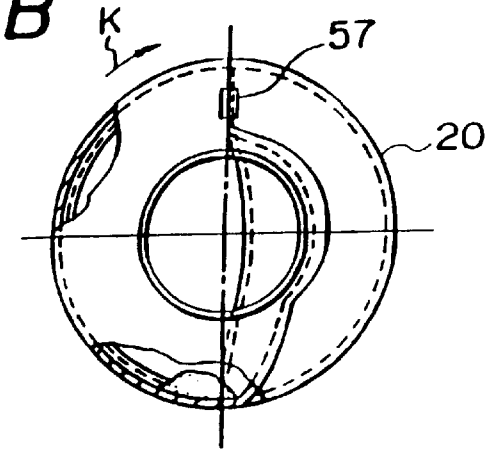
FIG. 34B is a top plan view of the toner bottle 20.
Figure 34D:
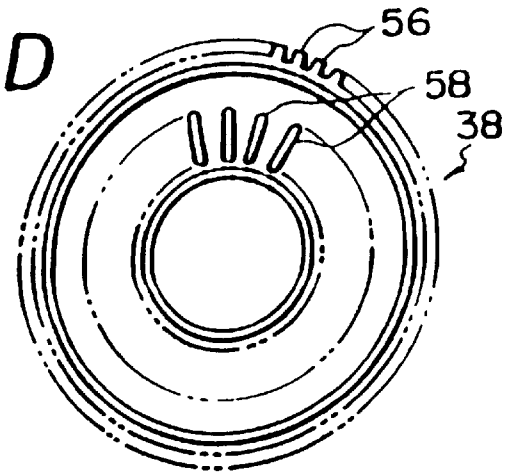
FIG. 34D is a top plan view of the toner bottle 20, as seen in a direction N, shown in FIG. 34C.
Figure 34A:
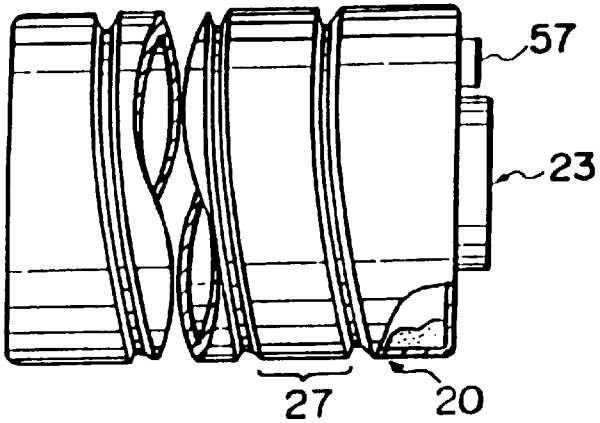
FIG. 34A is a front view showing a modified toner bottle 20 for use with the toner supply unit 17 of FIG. 27.
Figure 34C:
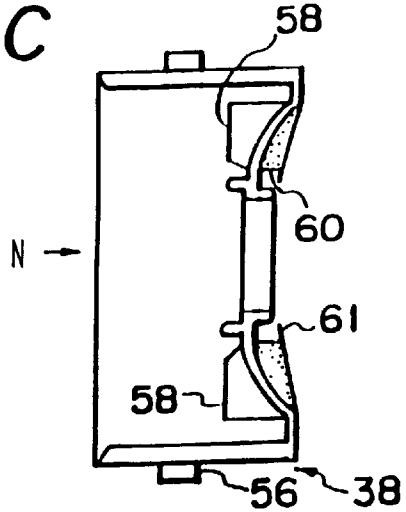
FIG. 34C is a cross-sectional view of a gear link 38 associated with the toner bottle 20.
Figure 35A:
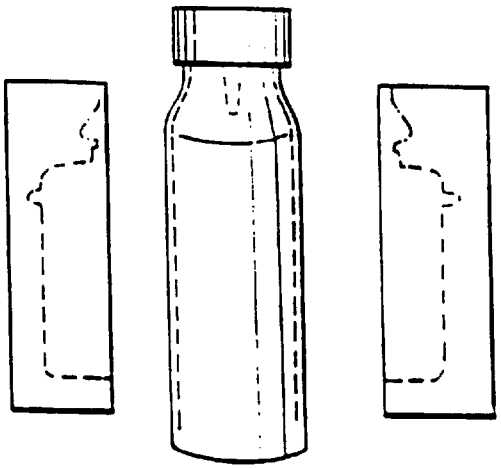
FIGS. 35A–35E are front views of the toner bottle 20 and mold, for producing the toner bottle 20, showing a sequence of steps in accordance with the method of the present invention.
Figure 35B:
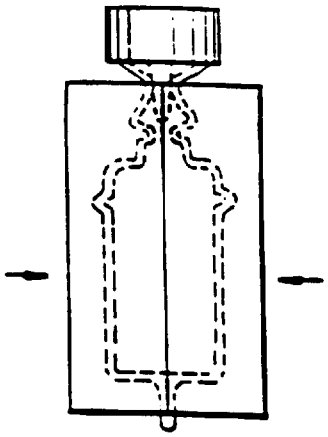
Figure 35C:
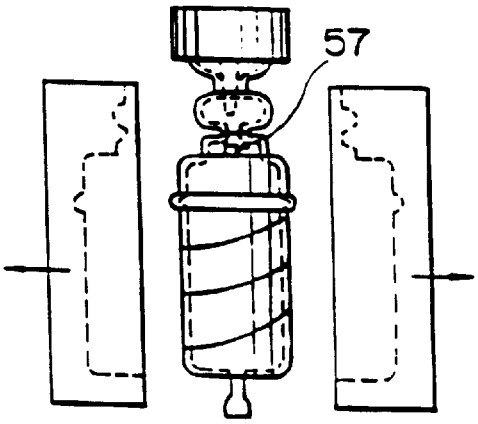
Figure 35D:
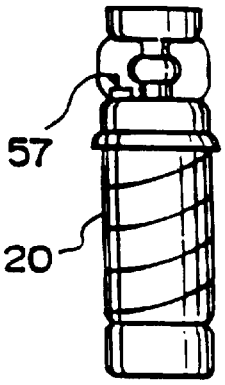
Figure 35E:
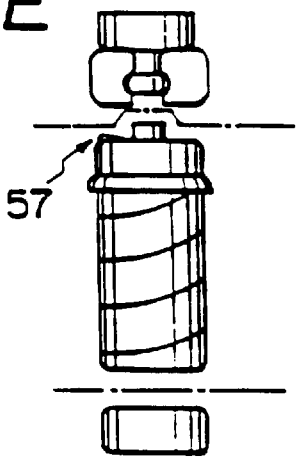

Assuming that the bottle rib 57 is formed on the outer periphery of the bottle 20, as shown in FIGS. 34A and 34B, and that the bottle 20 is molded by use of resin, as shown in FIGS. 35A–35E, it is preferable to form the bottle rib 57 in a parting line portion between mold parts. This allows the bottle 20 to have a relatively thick wall at the portion where the bottle rib 57 is positioned, as compared to a case where the bottle rib 57 is located in any other position. Any desired number of bottle ribs 57 may be formed, if they are provided at the parting portions of cooperative mold parts. Specifically, two parting lines are available with the two bisected mold parts shown in FIGS. 35A–35E. Four parting lines will be available when four mold parts are used.

Figure 36A:
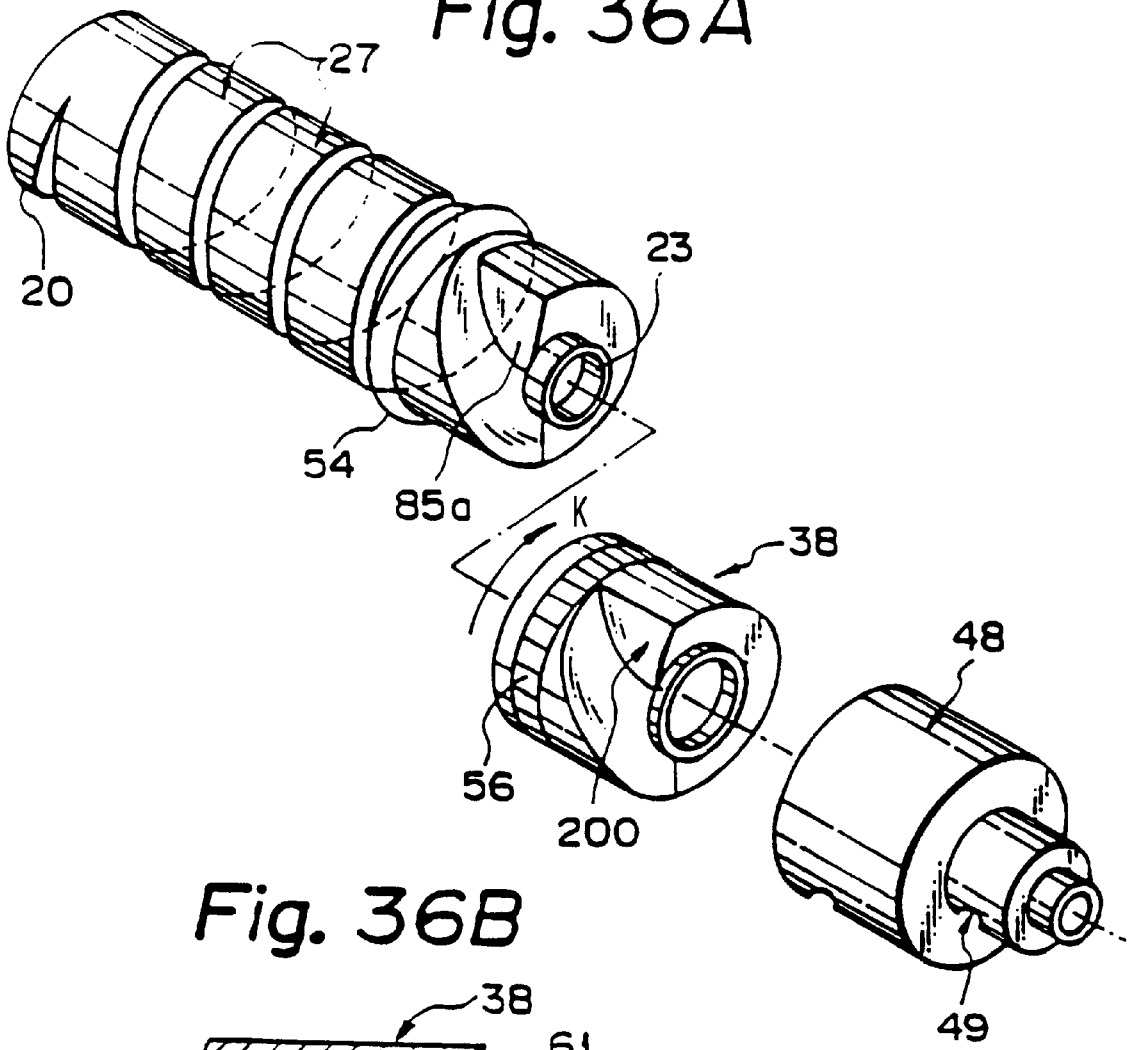
FIG. 36A is a perspective view of a toner bottle 20, an annular gear link 39, and a stop cover 48, included in a modification of the present invention.
Figure 36B:
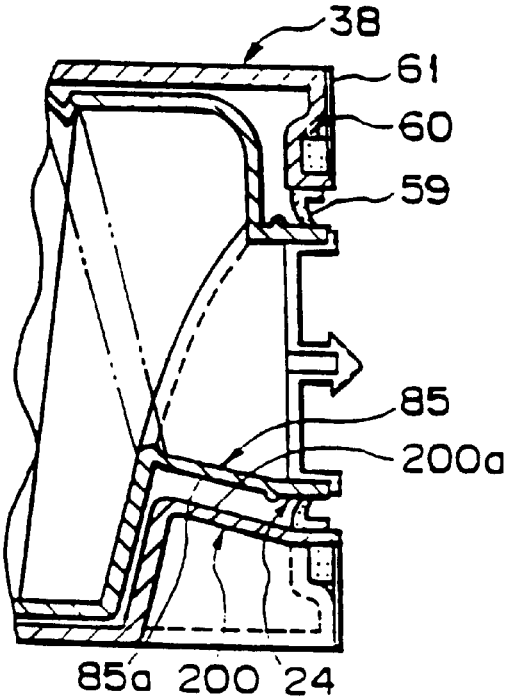
FIG. 36B is a cross-sectional view showing the toner bottle 20 inserted into the annular gear link 39.

The recess 106, shown in FIG. 33, and formed in the bottle 20, is a specific implementation for transmitting the rotation of the gear link 38 to the bottle 20. Alternatively, at the shoulder of the bottle 20, the part of the outer periphery, corresponding to the inner peripheral raised portion 85, may be brought into engagement with the link rib 58 or similar engaging portion of the gear link 38, as shown in FIGS. 36A and 36B, by way of example. As shown in FIG. 36A, the gear link 38 has an engaging portion 200, engageable with the portion 85*a* of the outer surface of the bottle 20, corresponding to the inner raised portion 85. When the head portion of the bottle 20 is inserted into the gear link 38, the engaging portion 200 engages with the portion 85*a* of the bottle 20. FIG. 36B shows the portion 85*a* of the bottle 20 and the portion 200 of the gear link 38 abutting each other. In FIG. 36B, the reference numeral 200*a* designates the surface of the portion 200 directly contacting the portion 85*a*. When the portions 85*a* and 200, substantially perpendicular to the direction of rotation, are brought into engagement, the bottle 20 is caused to be rotated about the axis thereof, together with the gear link 38. This kind of drive transmission makes it needless to form the bottle rib 57 or similar projection on the bottle 20 and, therefore, reduces the production cost of the bottle 20. In addition, drive transmission is insured since the engaging portion 200 of the gear link 38 abuts the portion 85*a* of the bottle 20.

Figure 37:
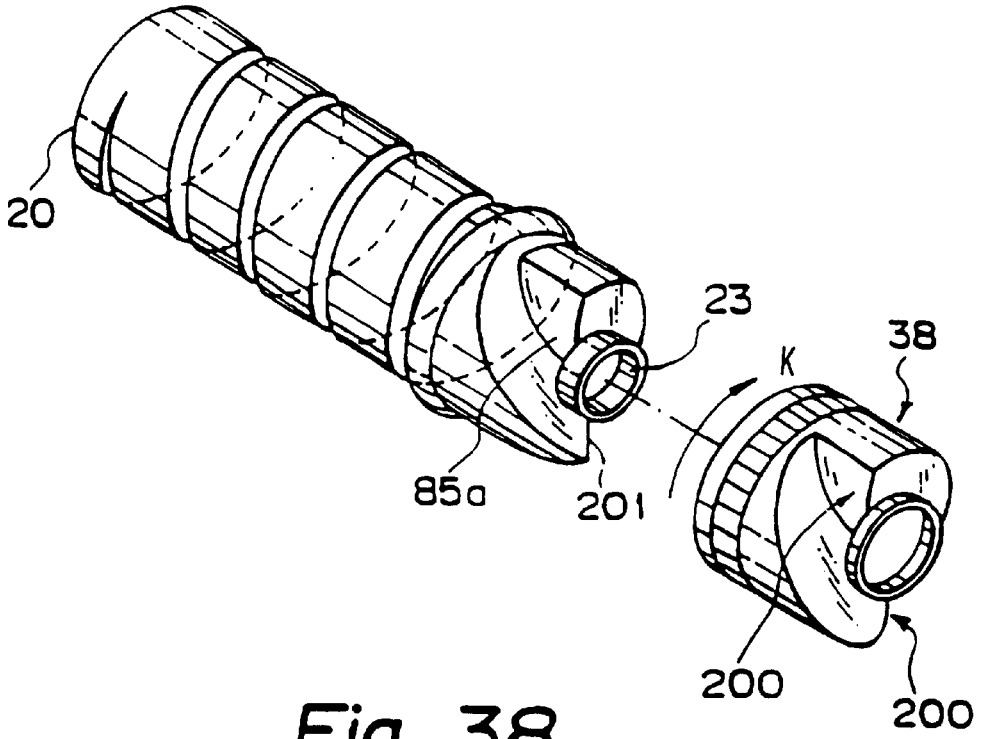
FIGS. 37 and 38 are perspective views each showing a toner bottle 20 and an annular gear link 39, included in another modification of the present invention.
Figure 38:
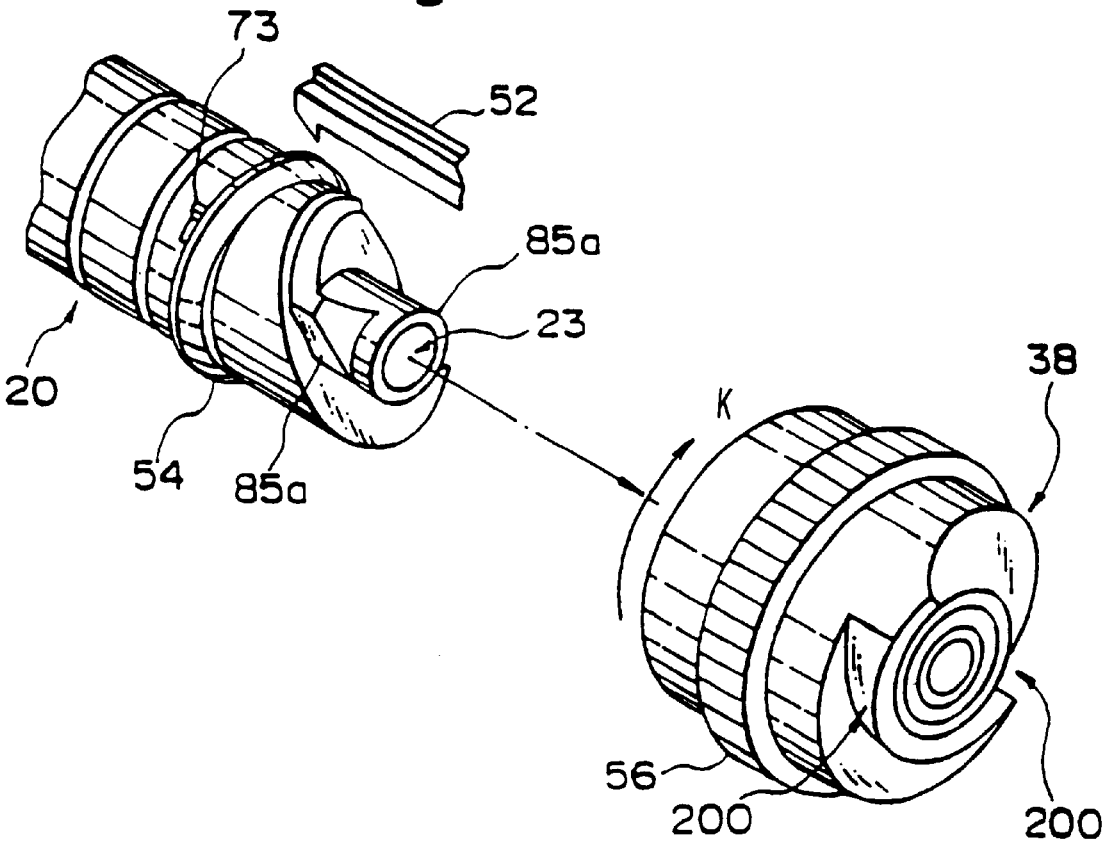
Figure 39A:
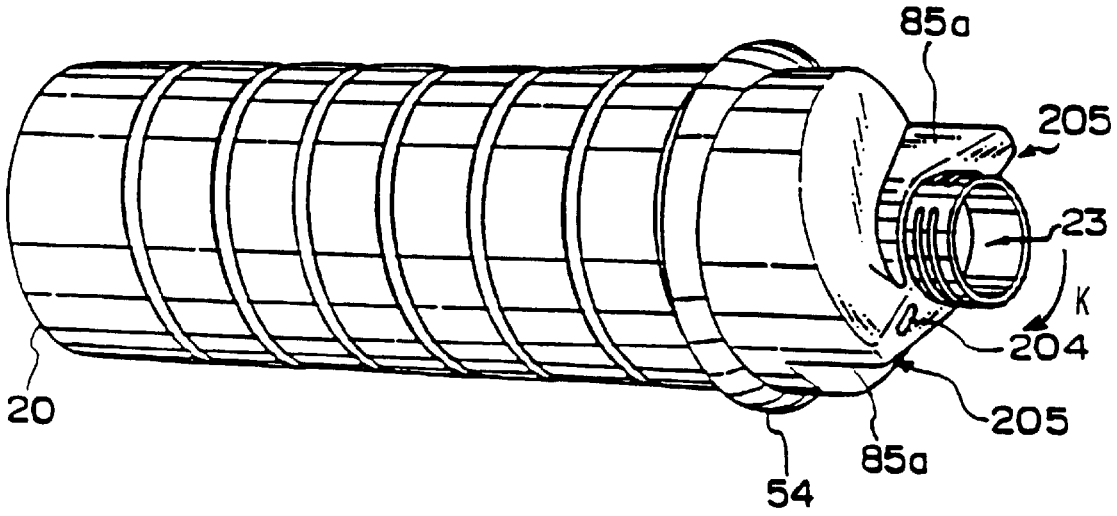
FIG. 39A is a perspective view showing another specific configuration of the toner bottle 20.
Figure 39B:
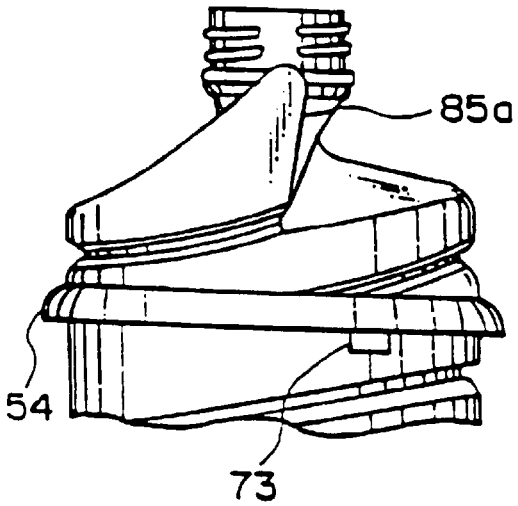
FIG. 39B is a partial front view of the toner bottle 20.
Figure 39C:
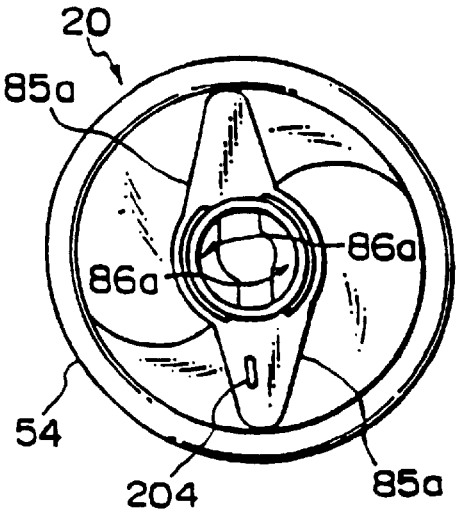
FIG. 39C is a top plan view of the toner bottle 20.

As shown in FIG. 37, the bottle 20 may be provided with two contact surfaces on the end thereof. As shown, a contact surface 201 is formed at a position 180degrees spaced apart from the above-stated portion 85*a* in the direction of rotation K of the bottle 20. The gear link 38 is formed with two engaging portions 200 engaging the surfaces 85*a* and 201 of the bottle 20. In this case, the inner periphery of the bottle 20, corresponding to the additional contact surface 201, may also be configured as a raised portion for raising the toner.

FIGS. 38 and 39A–39C show another specific configuration of the bottle 20. As shown, the bottle 20 has two raised portions 85 (represented by the corresponding outer peripheral portions 85*a*), which are spaced apart 180 degrees in the direction of rotation K of the bottle 20 and are symmetrical to each other with respect to the axis of the bottle. In the figures, the same portions, as the portions of any one of the previous specific configurations, are designated by the same reference numerals. In this configuration, while the bottle 20 performs one rotation, the toner is guided twice to the mouth portion 23 along the raised portions 85. Hence, when only a small quantity of toner is left in the bottle 20, it can be discharged from the mouth portion 23 more positively. Moreover, since the bottle 20 and the gear link 38 are engaged with each other at two spaced positions, the sure drive transmission, from the link 38 of the bottle 20, is further promoted.

Generally, the characteristic of a toner, e.g., chargeability and color, depend on the developing unit. Therefore, it is necessary to prevent a bottle 20, containing a toner different in characteristic from an expected toner, from being mounted on the toner supply unit 17. For this purpose, the bottle 20, shown in FIGS. 38 and 39A–39C, is provided with a lug 204 in a portion thereof extending from the circumferential edge of the collar 24 to a shoulder 205. The lug 204 is sized and positioned in matching relation to the characteristic of the toner to be contained in the bottle 20. The end wall of the gear link 38 is formed with a recess in the inner surface thereof, which can receive the lug 204 of a bottle 20, containing an expected toner, when the bottle 20 is inserted into the link 38. When a bottle 20 containing an unexpected toner is put on the toner supply unit 17, it cannot be fully inserted into the gear link 38 since the lug 204 does not match the recess of the gear link 38 in size or position. If desired, the bottle 20 and the gear link 38 may be provided with the recess and the lug, respectively.

Figure 40A:
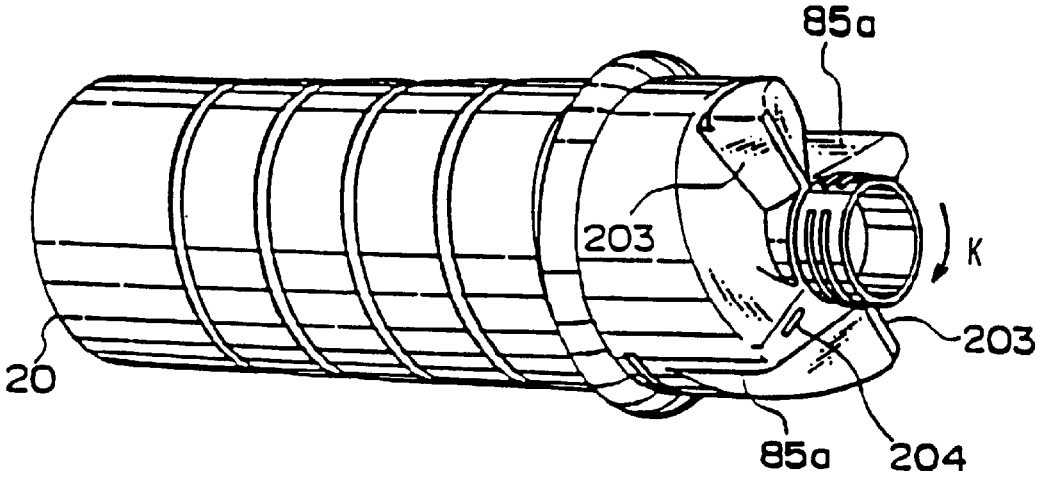
FIG. 40A is a perspective view showing another specific configuration of the toner bottle 20.
Figure 40B:
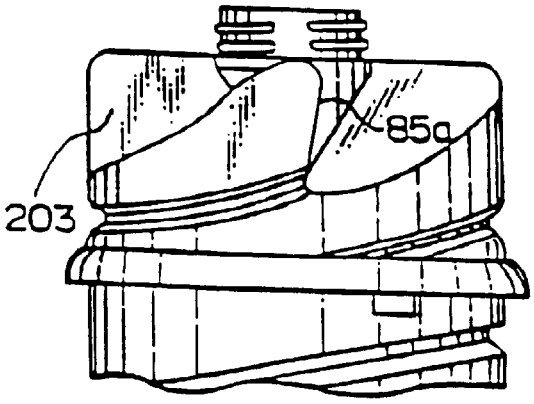
FIG. 40B is a partial front view of the toner bottle 20.
Figure 40C:
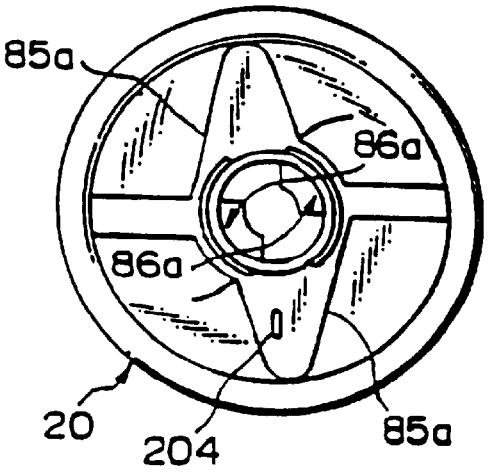
FIG. 40C is a top plan view of the toner bottle 20.

The bottle 20 may be provided with three or more engaging portions, engageable with the gear link 38, or three or more raised portions 85, in order to more surely transmit the rotation of the gear link 38 to the bottle 20, or to further promote the discharge of a small quantity of toner remaining in the bottle 20. Again, such engaging portions or raised portions should preferably be located at equally spaced locations in the direction of rotation K of the bottle 20. Specifically, FIGS. 40A–40C show the bottle 20 having the raised portions (represented by the outer surfaces 85*a* corresponding thereto) and engaging portions 203, which alternate with each other at angular intervals of 90 degrees. In these figures, the same portions, as the portions of any one of the specific bottle configurations shown and described, are designated by the same reference numerals.

Figure 41:
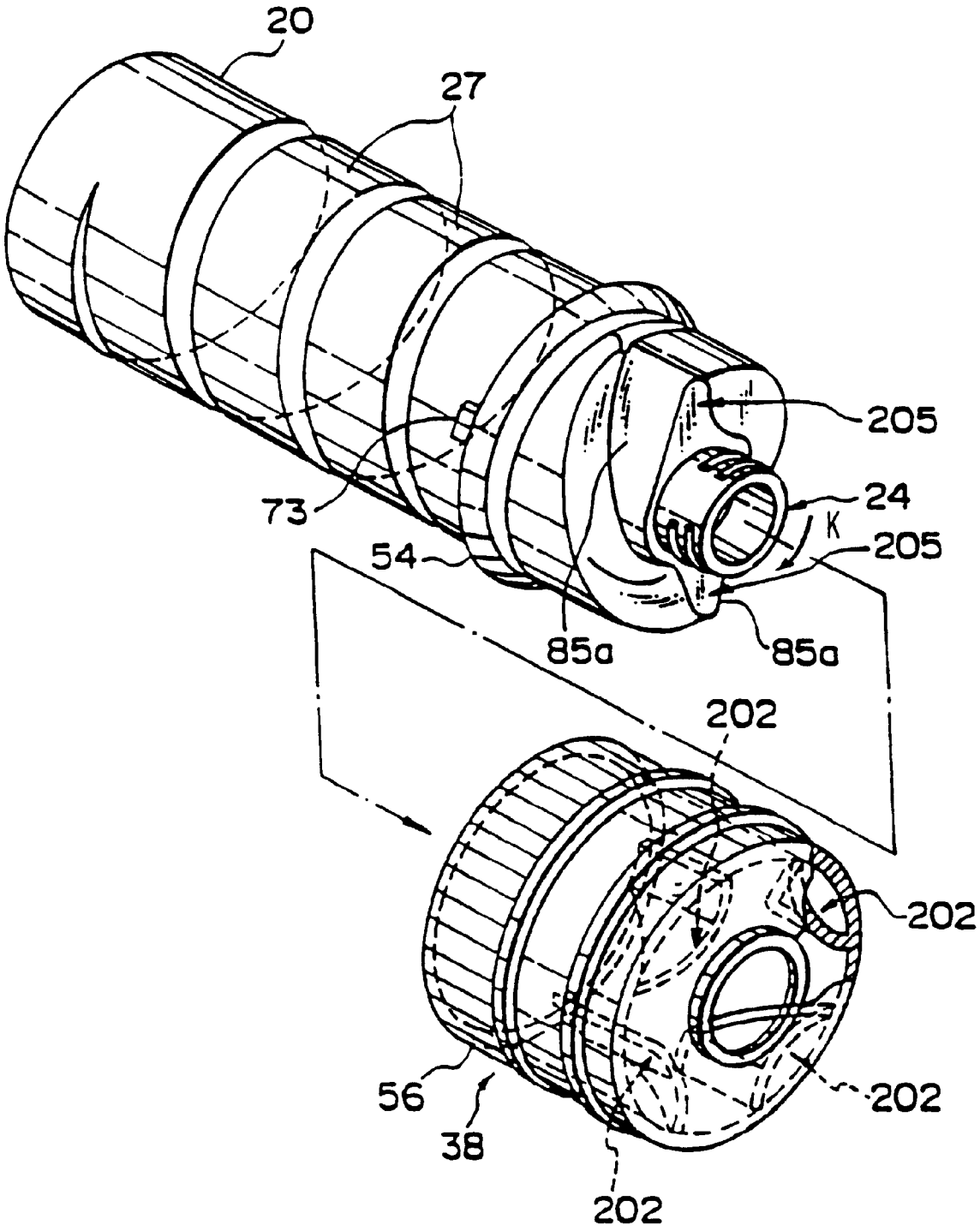
FIG. 41 is a perspective view of a toner bottle 20 and an annular gear link 39, included in another modification of the present invention.
Figure 42A:
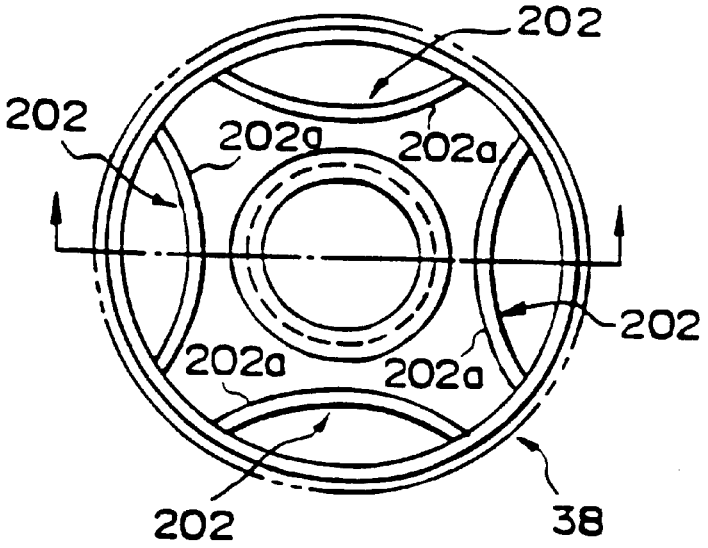
FIGS. 42 is a cross-sectional view showing the internal arrangement of the annular gear link 39, shown in FIG. 41.
FIG. 42B is a cross-sectional view of the annular gear link 39.
FIG. 42C is a partial front view of the toner bottle 20 shown inserted into a cross-sectional view of the annular gear link 39.
Figure 42B:
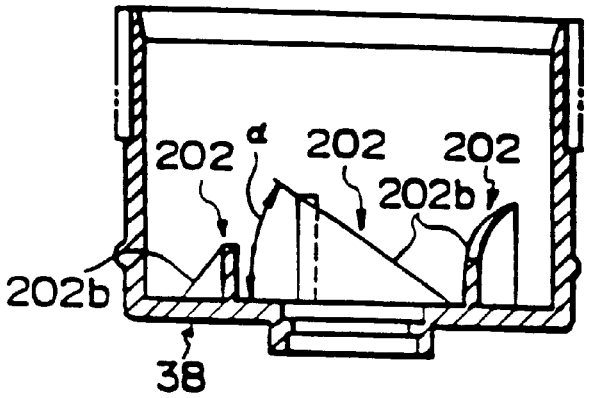
Figure 42C:
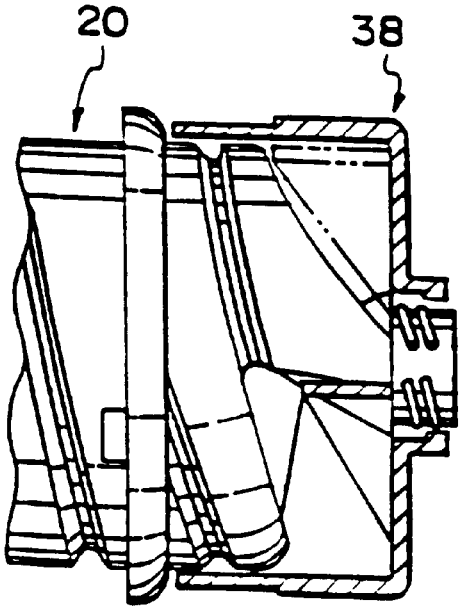

The gear link 38 may be provided with a greater number of engaging portions than the bottle 20 in order to promote smooth insertion of the front end of the bottle 20 into the gear link 38. Specifically, as shown in FIG. 41, the bottle 20, like the bottle 20 shown in FIG. 39, has two raised portions 85 spaced about 180 degrees apart and symmetrical to each other. The outer surfaces 85*a* of the raised portions 85 are each used as an engaging surface. The end wall of the gear link 38 is formed with four arcuate rims 202 on the inner periphery thereof. The rims 202 are convex toward the axis of the gear link 38, as viewed in cross-section, and are arranged symmetrically with respect to the axis of the gear link 38. As shown in FIG. 42B, the rims 202 are each inclined at an angle $\alpha$, at the upper edge 202*b* thereof facing the bottle inlet of the gear link 38. Assuming that when the bottle 20 is inserted into the gear link 38, the portions of the bottle 20 between the circumferential edge of the collar 24 and the shoulders 205 abut the upper edges 202*b* of the rims 202, such portions of the bottle 20 slide on the rims 202 along the angle of inclination $\alpha$, while rotating about the axis thereof. As a result, the bottle 20 is inserted into the gear link 38 smoothly. For smooth insertion, the angle a should preferably be less than 30 degrees. Each rim 202 has a surface 202*a* facing the axis of the gear link 38. Such surfaces 202*a* of the rims 202 abut the outer surfaces 85*a* of the bottle to transmit the rotation of the gear link 38 to the bottle 20.

In summary, it will be seen that the present invention has various unprecedented advantages, as enumerated below.

(1) A holding means for holding a developer container is rotatable in a substantially horizontal plane for the replacement of a developer container. This eliminates the requisite that the holding means and the developer container each should have a length smaller than the height of an image forming apparatus, particular to a conventional system, which requires the holding means to move both horizontally and vertically. Hence, the developer container can be provided with a sufficient length.

(2) A lid is automatically attached to and detached from a mouth portion included in the developer container. Therefore, only if a person mounts the developer container on the holding means, a developer can be replenished. This not only facilitates the replacement of the developer container, but also prevents the developer from falling out of the mouth portion of the developer container. In addition, the developer deposited on, for example, the inner surface of the mouth portion is prevented from falling to the outside.

(3) While the holding means is held in a position for mounting the developer container, the container can be removed with the mouth portion thereof sealed by a lid. This also prevents the developer, deposited on the inner surface of the mouth portion, from falling to the outside.

(4) The developer can be discharged from the developer container via the mouth portion effectively. In addition, the quantity of developer, to be left unused on the inner periphery of the container, is reduced.

(5) Drive transmission to the developer container is insured.

(6) In the event of replacement of the developer container, the holding means can be moved between the above-mentioned loading position and a toner replenishing position by a minimum of force. Further, when a motor, solenoid, or similar actuator is used to move the holding means, use can be made of a miniature actuator.

(7) The developer container can be surely unlocked in position and, therefore, can be surely released from the holding means.

(8) The developer container can have the mouth portion thereof reduced in size, as compared to a conventional container having a mouth portion whose diameter is substantially equal to the maximum diameter of the inner surface of the shoulder. The small sized mouth portion allows a minimum of developer to deposit on the inner surface thereof and prevents the developer from flying around or falling accidentally as far as possible. When the container is transported, for example, the lid closing the mouth portion of the container can be as miniature as the mouth portion. Hence, the lid can be attached and detached by a small force, facilitating manual attachment and detachment. This is also true when a mechanism for attaching and detaching the lid automatically is installed in a developer replenishing device. In addition, such a mechanism is reduced in size.

(9) A shoulder forming a part of the developer container and having a greater diameter than the mouth portion has the inner surface thereof partly raised to the edge of the mouth portion. When the container is rotated, the inner surface of the raised portion raises the developer around the shoulder to the mouth portion, thereby causing the toner to fall via the mouth portion. As a result, the whole developer stored in the container can be used for development. Moreover, since the rate of discharge of the developer via the mouth portion is determined by, for example, the size of the raised portion, the developer can be discharged via the mouth portion stably.

(10) A person intending to replace the developer container is prevented from removing the lid of the developer container by accident. Otherwise, the developer would fall from the container to smear the surroundings.

Various modifications will become possible for those skilled in the art after receiving the teachings of the present disclosure without departing from the scope thereof.

What is claimed is:

1. A developer container comprising:

a hollow body;

a shoulder portion forming a wall adjacent a first end of said hollow body;

a mouth portion provided adjacent to said first end of said hollow body, wherein said mouth portion is smaller in diameter than said shoulder portion;

a toner guide provided adjacent to said first end of said hollow body, wherein said toner guide extends toward said mouth portion;

an internal spiral mounted at a position to guide a toner toward said toner guide when said developer container is rotated.

2. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent said first end of said hollow body, wherein said toner discharge mouth has a toner discharge mouth diameter smaller than said hollow body diameter; and a ramp surface located adjacent to said first end of said hollow body, wherein said ramp surface extends radially into said hollow body to such a position that a toner in said toner bottle is raised to said toner discharge mouth by said ramp surface when said toner bottle is rotated.

3. A developer container comprising:

a hollow body;

a shoulder portion forming a wall adjacent to a first end of said hollow body;

a mouth portion provided adjacent said first end of said hollow body, wherein said mouth portion is smaller in diameter than said shoulder portion;

a toner guide mounted on said mouth portion; and an internal spiral mounted at a position to guide a toner toward said toner guide when said developer container is rotated.

4. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter; and a ramp surface mounted on said toner discharge mouth, wherein said ramp surface extends radially to such a position that a toner in said toner bottle is raised to said toner discharge mouth by said ramp surface when said toner bottle is rotated.

5. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter; and a ramp surface located adjacent to said first end of said hollow body, wherein said ramp surface extends radially into said hollow body to such a position that a toner in said toner bottle is raised to said toner discharge mouth by said ramp surface when said toner bottle is rotated about an axis of said hollow body, and wherein said ramp surface includes a ramp portion shaped to guide the toner axially toward said toner discharge mouth when said toner bottle is rotated about said axis of said hollow body; and an internal spiral mounted at a position to guide the toner toward said ramp portion when said toner bottle is rotated.

6. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion;

a toner guide including a portion shaped to guide a toner axially toward said mouth portion when said developer container is rotated about an axis thereof; and an internal spiral mounted at a position to guide the toner toward said toner guide when said developer container is rotated.

7. A toner bottle for use with a toner replenishing device having a bottle holder and a drive unit which rotatably drives said toner bottle when said toner bottle is horizontally mounted on said toner replenishing device, said toner bottle comprising:

a hollow body containing toner;

a shoulder portion forming a wall adjacent to a first end of said hollow body;

a mouth portion provided adjacent to said first end of said hollow body, wherein said mouth portion is smaller in diameter than said shoulder portion and wherein said mouth portion is configured to cooperate with said toner replenishing device when said toner bottle is horizontally mounted on said toner replenishing device;

a toner guide mounted on said mouth portion, wherein said toner guide extends radially from said mouth portion; and at least one element projecting from said shoulder portion at a location to cooperate with said drive unit of said toner replenishing device when said toner bottle is horizontally mounted on said toner replenishing device.

8. A toner bottle for use with a toner replenishing device having a bottle holder and a drive unit which rotatably drives said toner bottle when said toner bottle is horizontally mounted on said toner replenishing device, said toner bottle comprising:

a hollow body containing toner;

a shoulder portion forming a wall adjacent to a first end of said hollow body;

a mouth portion provided adjacent to said first end of said hollow body, wherein said mouth portion is smaller in diameter than said shoulder portion and wherein said mouth portion is configured to cooperate with said toner replenishing device when said toner bottle is horizontally mounted on said toner replenishing device;

a toner guide mounted on said mouth portion, wherein said toner guide extends radially from said mouth portion;

an internal spiral mounted on said hollow body at a position to guide a toner toward said toner guide when said hollow body is rotated; and at least one element projecting from said shoulder portion at a location so as to cooperate with said drive unit of said toner replenishing device when said toner bottle is horizontally mounted on said toner replenishing device.

9. A toner bottle for use with a toner replenishing device having a bottle holder and a drive unit which rotatably drives said toner bottle when said toner bottle is horizontally mounted on said toner replenishing device, said toner bottle comprising:

a hollow body containing toner;

a shoulder portion forming a wall adjacent to a first end of said hollow body;

a mouth portion provided adjacent to said first end of said hollow body, wherein said mouth portion defines a mouth opening, wherein said mouth portion is smaller in diameter than said shoulder portion, and wherein said mouth portion is configured to cooperate with said toner replenishing device when said toner bottle is horizontally mounted on said toner replenishing device;

a manually removable cap closing said mouth portion; and a lid exposed by removal of said manually removable cap, wherein said lid is mounted over said mouth opening to close said mouth opening.

10. The toner bottle of claim 9, wherein said lid includes a lug positioned and shaped to cooperate with said toner replenishing device such that said toner replenishing device separates said lid from said mouth opening, to open said mouth opening, when said toner bottle is horizontally mounted on said toner replenishing device.

11. The toner bottle of claim 10, further comprising an internal spiral mounted on said hollow body at a position to guide a toner toward a toner guide when said toner bottle is rotated.

12. The toner bottle of claim 11, further comprising at least one element projecting from said shoulder portion at a location to cooperate with said drive unit of said toner replenishing device when said toner bottle is horizontally mounted on said toner replenishing device.

13. The toner bottle of claim 10, further comprising at least one element projecting from said shoulder portion at a location to cooperate with said drive unit of said toner replenishing device when said toner bottle is horizontally mounted on said toner replenishing device.

14. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion; and a toner guide provided adjacent to said first end of said hollow body, wherein said toner guide extends toward said mouth portion.

15. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion; and a toner guide mounted on said mouth portion.

16. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter; and a ramp surface located adjacent to said first end of said hollow body, wherein said ramp surface extends radially into said hollow body to such a position that a toner in said toner bottle is raised to said toner discharge mouth by said ramp surface when said toner bottle is rotated about a hollow body axis of said hollow body, and wherein said ramp surface includes a ramp portion shaped to guide the toner axially toward said toner discharge mouth when said toner bottle is rotated about said hollow body axis.

17. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion; and a toner guide including a portion shaped to guide a toner axially toward said mouth portion when said developer container is rotated about an axis thereof.

18. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion;

a toner guide provided adjacent to said first end, wherein said toner guide extends toward said mouth portion;

a conveying device mounted at a position to guide a toner toward said toner guide when said developer container is rotated.

19. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion;

a toner guide mounted on said mouth portion; and a conveying device mounted at a position to guide a toner toward said toner guide when said developer container is rotated.

20. A toner bottle for use with a toner replenishing device having a bottle holder and a drive which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter;

a ramp surface located adjacent to said first end of said hollow body, wherein said ramp surface extends radially into said hollow body to such a position that a toner in said toner bottle is raised to said toner discharge mouth by said ramp surface when said toner bottle is rotated about an axis of said hollow body, and wherein said ramp surface includes a ramp portion shaped to guide the toner axially toward said toner discharge mouth when said toner bottle is rotated about said axis of said hollow body; and a conveying device mounted at a position to guide the toner toward said ramp portion when said toner bottle is rotated.

21. A developer container comprising:

a hollow body;

a shoulder portion forming a wall adjacent to a first end of said hollow body;

a mouth portion provided adjacent to said first end of said hollow body, wherein said mouth portion is smaller in diameter than said shoulder portion;

a toner guide including a portion shaped to guide a toner axially toward said mouth portion when said developer container is rotated about an axis thereof; and a conveying device mounted at a position to guide the toner toward said toner guide when said developer container is rotated.

22. A toner container storing toner therein, wherein said toner container comprises:

an opening located on an axis of rotation of said toner container, wherein said toner container is held in a horizontal position, wherein said toner container is rotated to discharge said toner via said opening, wherein said opening has an opening diameter smaller than a toner container diameter of said toner container, and wherein said toner container has a toner guide provided at a position to guide the toner toward said opening when said toner container is rotated about said axis of rotation of said toner container.

23. A developer container comprising:

a hollow body;

a shoulder portion forming a wall adjacent to a first end of said hollow body;

a mouth portion provided adjacent to said first end of said hollow body, wherein said mouth portion has a mouth portion diameter which is smaller than a shoulder portion diameter of said shoulder portion, and wherein said shoulder portion diameter of said shoulder portion corresponds to a shoulder portion outermost locus diameter of an outermost locus that said shoulder portion draws when said developer container is rotated;

a toner guide provided adjacent to said first end of said hollow body, wherein said toner guide extends toward said mouth portion;

an internal spiral mounted at a position to guide a toner toward said toner guide when said developer container is rotated.

24. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter, and wherein said hollow body diameter of said hollow body corresponds to a hollow body outermost locus diameter of an outermost locus that said hollow body draws when said toner bottle is rotated; and a ramp surface located adjacent to said first end of said hollow body, wherein said ramp surface extends radially into said hollow body to such a position that a toner in said toner bottle is raised to said toner discharge mouth by said ramp surface when said toner bottle is rotated.

25. A developer container comprising:

a hollow body;

a shoulder portion forming a wall adjacent to a first end of said hollow body;

a mouth portion provided adjacent to said first end of said hollow body, wherein said mouth portion has a mouth portion diameter which is smaller than a shoulder portion diameter of said shoulder portion, and wherein said shoulder portion diameter of said shoulder portion corresponds to a shoulder portion outermost locus diameter of an outermost locus that said shoulder portion draws when said developer container is rotated;

a toner guide mounted on said mouth portion; and an internal spiral mounted at a position to guide a toner toward said toner guide when said developer container is rotated.

26. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter, and wherein said hollow body diameter corresponds to a hollow body outermost locus diameter of an outermost locus that said hollow body draws when said toner bottle is rotated; and a ramp surface mounted on said toner discharge mouth, wherein said ramp surface extends radially to such a position that a toner in said toner bottle is raised to said toner discharge mouth by said ramp surface when said toner bottle is rotated.

27. A toner bottle for use with a toner replenishing device having a bottle holder and a drive unit which rotatably drives said toner bottle when said toner bottle is horizontally mounted on said toner replenishing device, said toner bottle comprising:

a hollow body having a hollow body diameter at a first end thereof;

a toner discharge mouth adjacent to said first end of said hollow body, wherein said toner discharge mouth has a toner discharge mouth diameter smaller than said hollow body diameter, and wherein said hollow body diameter corresponds to a hollow body outermost locus diameter of an outermost locus that said hollow body draws when said toner bottle is rotated;

a ramp surface located adjacent to said first end of said hollow body, wherein said ramp surface extends radially into said hollow body to such a position that a toner in said toner bottle is raised to said toner discharge mouth by said ramp surface when said toner bottle is rotated about an axis of said hollow body, and wherein said ramp surface includes a ramp portion shaped to guide the toner axially toward said toner discharge mouth when said toner bottle is rotated about said axis of said hollow body; and an internal spiral mounted at a position to guide the toner toward said ramp surface when said toner bottle is rotated.

28. A developer container comprising:

a hollow body;

a shoulder portion forming a wall adjacent to a first end of said hollow body;

a mouth portion provided adjacent to said first end of said hollow body, wherein said mouth portion has a mouth portion diameter which is smaller than a shoulder portion diameter of said shoulder portion, and wherein said shoulder portion diameter of said shoulder portion corresponds to a shoulder portion outennost locus diameter of an outermost locus that said shoulder portion draws when said developer container is rotated;

a toner guide including a portion shaped to guide a toner axially toward said mouth portion when said developer container is rotated about an axis thereof; and an internal spiral mounted at a position to guide the toner toward said toner guide when said developer container is rotated.

29. A toner bottle for use with a toner replenishing device having a bottle holder and a drive unit which rotatably drives said toner bottle when said toner bottle is horizontally mounted on said toner replenishing device, said toner bottle comprising:

a hollow body containing toner, a shoulder portion forming a wall adjacent to a first end of said hollow body;

a mouth portion provided adjacent to said first end of said hollow body, wherein said mouth portion has a mouth portion diameter which is smaller than a shoulder portion diameter of said shoulder portion, wherein said shoulder portion diameter of said shoulder portion corresponds to a shoulder portion outermost locus diameter of an outermost locus that said shoulder portion draws when said toner bottle is rotated, and wherein said mouth portion is configured to cooperate with said toner replenishing device when said toner bottle is horizontally mounted on said toner replenishing device;

a toner guide mounted at said mouth portion, wherein said toner guide extends radially from said mouth portion; and at least one element projecting from said shoulder portion at a location to cooperate with said drive unit of said toner replenishing device when said toner bottle is horizontally mounted on said toner replenishing device.

30. A toner bottle for use with a toner replenishing device having a bottle holder and a drive unit which rotatably drives said toner bottle when said toner bottle is horizontally mounted to said toner replenishing device, said toner bottle comprising:

a hollow body containing toner;

a shoulder portion forming a wall adjacent to a first end of said hollow body;

a mouth portion provided adjacent to said first end of said hollow body, wherein said mouth portion has a mouth portion diameter which is smaller than a shoulder portion diameter of said shoulder portion, wherein said shoulder portion diameter of said shoulder portion corresponds to a shoulder portion outermost locus diameter of an outermost locus that said shoulder portion draws when said toner bottle is rotated, and wherein said mouth portion is configured to cooperate with said toner replenishing device when said toner bottle is horizontally mounted on said toner replenishing device;

a toner guide mounted at said mouth portion, wherein said toner guide extends radially from said mouth portion;

an internal spiral mounted at a position to guide the toner in said hollow body toward said toner guide when said toner bottle is rotated; and at least one element projecting from said shoulder portion at a location to cooperate with said drive unit of said toner replenishing device when said toner bottle is horizontally mounted on said toner replenishing device.

31. A toner bottle for use with a toner replenishing device having a bottle holder and a drive unit which rotatably drives said toner bottle when said toner bottle is horizontally mounted on said toner replenishing device, said toner bottle comprising:

a hollow body containing toner;

a shoulder portion forming a wall adjacent to a first end of said hollow body;

a mouth portion provided adjacent to said first end of said hollow body, wherein said mouth portion defines a mouth opening, wherein said mouth portion is configured to cooperate with said toner replenishing device when said toner bottle is horizontally mounted on said toner replenishing device, wherein a mouth opening diameter of said mouth opening is smaller than a shoulder portion diameter of said shoulder portion, wherein said shoulder portion diameter of said shoulder portion corresponds to a shoulder portion outermost locus diameter of an outermost locus that said shoulder portion draws when said toner bottle is rotated;

a toner guide mounted on said mouth portion, wherein said toner guide extends radially from said mouth portion;

a manually removable cap closing said mouth portion; and a lid exposed by removal of said manually removable cap, wherein said lid is mounted to close said mouth opening.

* * * * *

UNITED STATES PATENT AND TRADEMARK OFFICE

CERTIFICATE OF CORRECTION

PATENT NO. : 6,289,195 B1
DATED : September 11, 2001
INVENTOR(S) : Ichikawa et al.

It is certified that error appears in the above-identified patent and that said Letters Patent is hereby corrected as shown below:

Title page,
Item [45], and the Notice information should read:
-- (45) Date of Patent: *Sep. 11, 2001 --

-- (*) Notice: Subject to any disclaimer, the term of this patent is extended or adjusted under 35 U.S.C. 154(b) by 0 days.

This patent is subject to a terminal disclaimer. --

Signed and Sealed this

Second Day of April, 2002

*Attest:*

*Attesting Officer*

JAMES E. ROGAN
*Director of the United States Patent and Trademark Office*